US007819504B2

(12) United States Patent
Deguchi et al.

(10) Patent No.: US 7,819,504 B2
(45) Date of Patent: Oct. 26, 2010

(54) INKJET HEAD AND METHOD FOR MANUFACTURING THE SAME

(75) Inventors: Haruhiko Deguchi, Tenri (JP); Shigeru Nishio, Yamatokoriyama (JP); Hidetsugu Kawai, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 758 days.

(21) Appl. No.: 11/792,436

(22) PCT Filed: Dec. 6, 2005

(86) PCT No.: PCT/JP2005/022366

§ 371 (c)(1),
(2), (4) Date: Jun. 6, 2007

(87) PCT Pub. No.: WO2006/062092

PCT Pub. Date: Jun. 15, 2006

(65) Prior Publication Data

US 2008/0049074 A1 Feb. 28, 2008

(30) Foreign Application Priority Data

Dec. 7, 2004 (JP) ..... 2004-354574
Jun. 10, 2005 (JP) ..... 2005-171724

(51) Int. Cl.
*B41J 2/06* (2006.01)

(52) U.S. Cl. ..... 347/55

(58) Field of Classification Search ..... 347/55, 347/54, 56–59, 61–63, 50, 44, 20, 5, 9, 65, 347/14; 29/25.35
See application file for complete search history.

(56) References Cited

U.S. PATENT DOCUMENTS 6,767,473 B2 7/2004 Fujita et al.

FOREIGN PATENT DOCUMENTS

| | | |
|---|---|---|
| JP | 06-023987 | 2/1994 |
| JP | 09-156109 | 6/1997 |
| JP | 09-0193400 | 7/1997 |
| JP | 09-300615 | 11/1997 |
| JP | 2002-096474 | 4/2002 |
| JP | 2003-311944 | 11/2003 |
| JP | 2004-042396 | 2/2004 |

*Primary Examiner*—K. Feggins
(74) *Attorney, Agent, or Firm*—Edwards Angell Palmer & Dodge LLP; David G. Conlin; David A. Tucker

(57) ABSTRACT

An inkjet head (1) has a liquid flow path section (3) for receiving liquid and, in response to application of a voltage, ejecting the liquid to an object on which a drawing is to be made. The degree of design freedom of the shape of the liquid channel section (3) or the shape of a liquid channel in the liquid channel section (3) can be improved because the liquid channel section (3) is formed on the upper surface of a substrate. Furthermore, the inkjet head can have a structure corresponding to the properties of liquid to be ejected or to an object to which the liquid is to be ejected.

29 Claims, 22 Drawing Sheets

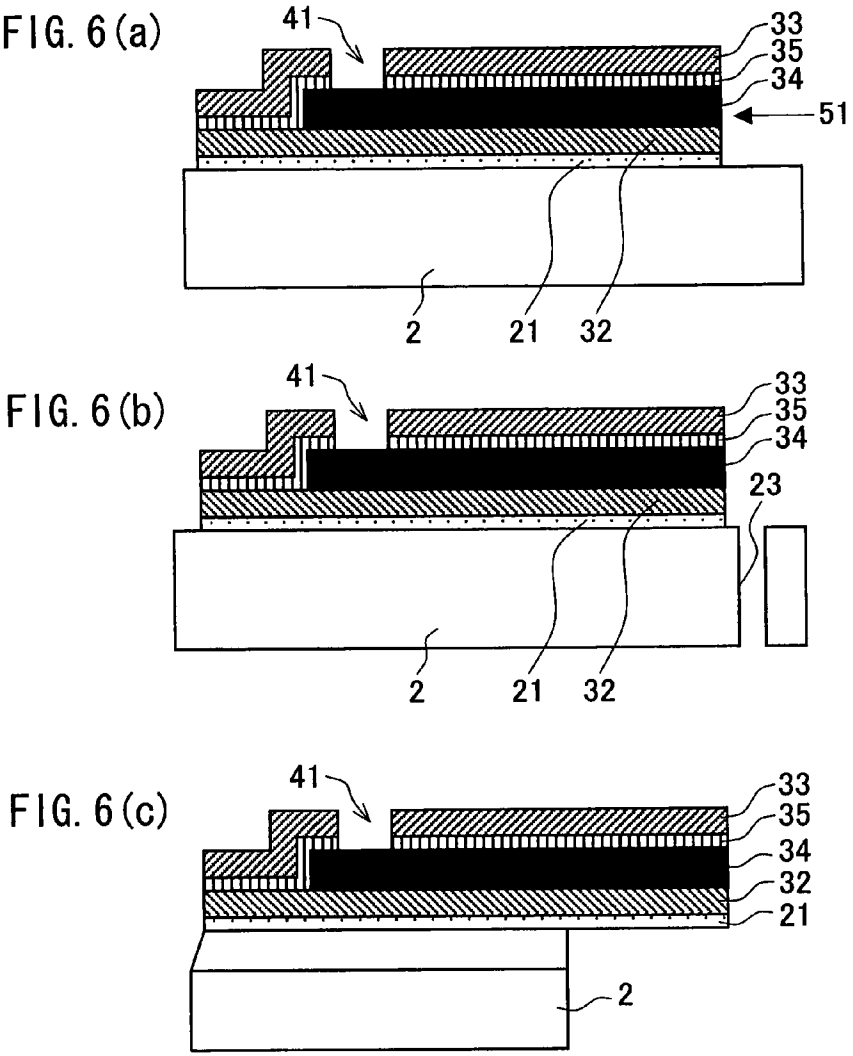
FIG. 6(a)
FIG. 6(b)
FIG. 6(c)
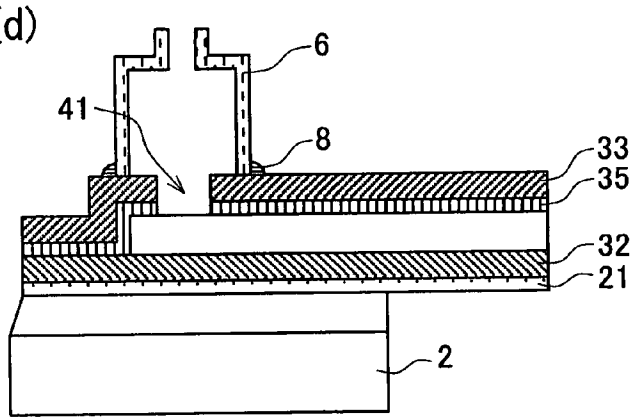
FIG. 6(d)
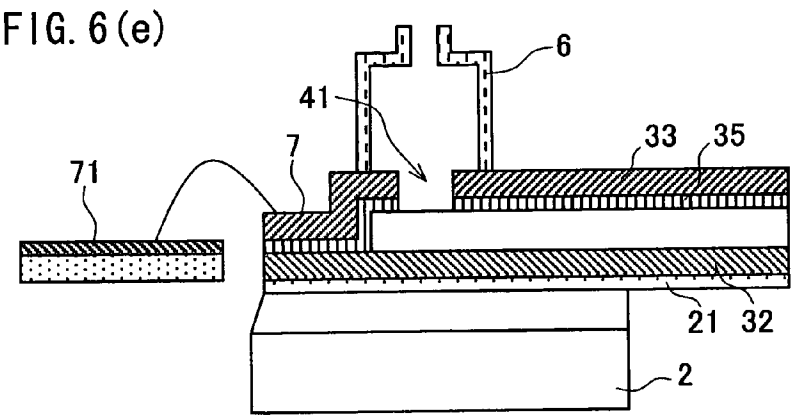
FIG. 6(e)

RESIST PATTERNING

PLANE VIEW

RESIST PATTERNING

CROSS SECTIONAL VIEW

AFTER ETCHING AND RESIST REMOVAL

PLANE VIEW

AFTER ETCHING AND RESIST REMOVAL

CROSS SECTIONAL VIEW

RESIST PATTERNING

PLANE VIEW

RESIST PATTERNING

CROSS SECTIONAL VIEW

AFTER ETCHING AND RESIST REMOVAL

PLANE VIEW

AFTER ETCHING AND RESIST REMOVAL

CROSS SECTIONAL VIEW

| Flow Path Width A (μm) | Flow Path Height B (μm) | B／A | Change In Flow Path Shape (Before & After Filler Removal) |
|---|---|---|---|
| 2 | 2 | 1 | Unchanged |
| 7 | 2 | 0.29 | Unchanged |
| 12 | 2 | 0.17 | Unchanged |
| 17 | 2 | 0.12 | Unchanged |
| 22 | 2 | 0.091 | Unchanged |
| 27 | 2 | 0.073 | Unchanged |
| 32 | 2 | 0.063 | Unchanged |
| 37 | 2 | 0.054 | Unchanged |
| 42 | 2 | 0.048 | Changed |
| 47 | 2 | 0.043 | Changed |
| 52 | 2 | 0.038 | Changed |

(WALL THICKNESS OF FLOW PATH 2 μm)

INKJET HEAD AND METHOD FOR MANUFACTURING THE SAME

TECHNICAL FIELD

The present invention relates to inkjet heads, each of which ejects liquid to print a fine pattern of fine dots and manufacturing methods of such heads.

BACKGROUND ART

So-called "inkjet printers" are widely used now to print characters, or images, etc. on sheets or the other article. The inkjet printer prints by spraying print paper with fine droplets of ink.

Recent applications of the inkjet printer technology are found in, among others, the forming of fine patterns on liquid crystal display color filters and conductor patterns on printed wiring boards. Conventionally, these patterns were formed by photolithography.

Active development programs are being implemented to apply the inkjet technology to, for example, fine dot forming devices which are able to form fine patterns with high accuracy by applying fine ink dots to a print target object (for example, a liquid crystal display color filter or a printed wiring board).

The fine dot forming device needs an inkjet head which ejects ink at a print target object in a stable manner and delivers ink dots to desired positions with high accuracy.

Incidentally, to apply fine ink dots to a print target object, the droplet of ink ejected from the inkjet head needs to be controlled so that it has as small a diameter as, for example, 10 μm or even less. However, as the shape of liquid is in a smaller size, a ratio between a cross-sectional area of the shape of the liquid over the inertial mass of the liquid becomes larger. The cross-sectional area accounts for air resistance of the liquid. In any ejection method that does not accelerate fluid while it is flying in the air, such a smaller size of the liquid therefore results in poor accuracy in the delivery of ink dots at desired positions.

Accordingly, to precisely deliver the fine ink dots as described above onto a print target object, an inkjet scheme based on electrostatic attraction is used in which an electrostatic force is applied to the fluid while it is flying in the air.

To spray fluid to the print target object using the inkjet head of the electrostatic attraction scheme like the one above, there is needed an electrolysis highly concentrated at the fluid's meniscus formed at a surface of a nozzle of the inkjet head.

To effectively develop a high concentration of electrolysis at the meniscus, the nozzles suitably have a tubular structure whose fluid outlet is protruded as much as possible. For the smaller size of the ink dots to be ejected at the print target object, the size of the openings of the nozzles is desirably as small as possible.

A fine pattern forming device, e.g., as illustrated in FIG. 18, has been proposed as an inkjet device for ejecting fine ink dots as described above (Patent Literature 1 (Japanese Patent Application Publication, Tokukai, No. 2003-311944, published on Nov. 6, 2003). Patent Literature 1 discloses a structure in which a through-hole as a flow path (i.e., ejection fluid flow path) for a fluid to be ejected is formed in a silicon substrate and the through-hole has at one end an opening as a fluid outlet. Note that FIG. 18 illustrates a conventional art and is a cross sectional view illustrating various parts of the fine pattern forming device.

More specifically, as illustrated in FIG. 18, the fine pattern forming device as illustrated in Patent Literature 1, includes a silicon substrate 102, a main electrode 106, a supporting member 108, a counter electrode 107, and a flow path 109. The main electrode 106 and the supporting member 108 are provided to a surface 102*a* of the silicon substrate 102. The counter electrode 107 is provided to face a reverse side of the silicon substrate 102 with a predetermined distance between the counter electrode 107 and the reverse side 102*b*. The flow path 109 is configured to supply an ejection fluid into a space formed between the silicon substrate 102 and the supporting member 108.

The silicone substrate 102 has a plurality of fine holes 103 that pass through the silicone substrate 102 from the surface 102*a* to the reverse surface 102*b*. Inside each of the fine holes 103, a silicon oxide layer 104 is formed. Each of the fine holes 103 has an opening 103*b* opened in the reverse surface 102*b*. The opening 103*b* is exposed from that surface of the inkjet head which faces toward a print target object. Nozzles 105, made of silicon oxide, are formed to protrude from the reverse surface 102*b* of the silicone substrate. The nozzles 105 are integrated with the silicon oxide layers 104, respectively.

Patent Literature 2 (Japanese Unexamined Patent Application Publication, Tokukai, No. 2002-96474, published on Apr. 2, 2002) discloses a method for producing fine nozzles for a fine pattern forming device in which, as illustrated in FIGS. 19(*a*) to 19(*e*), a plating film is formed on a side wall of a through hole of a substrate, and the plating film forms a flow path. One end of the flow path acts as a fluid outlet. Note that FIGS. 19(*a*) to 19(*e*) illustrate a conventional art and are views illustrating the method for producing the fine nozzles.

More specifically, the method for producing the fine nozzles is realized with the following steps.

Firstly, silicon oxide is formed on a whole surface of a silicon substrate 202 (FIG. 19(*a*)). After that, a metal thin film is formed on one side surface of the silicon substrate 202, and then patterned by photolithography and etching, thereby to form fine openings on the metal thin film (FIG. 19(*b*)).

Then, the silicon substrate 202 is deep-etched with the metal thin film used as a mask, thereby to etch part of the silicon substrate 202 where the fine openings are to be formed. Thereby, through fine holes are formed (FIG. 19(*c*)). Further, the metal thin film is removed and a silicon oxide layer is formed on an internal surface of each of the through fine holes (FIG. 19(*d*)). Subsequently, a reverse surface of the silicone substrate 202 is etched, so that only the silicon substrate 202 is partially etched away while the silicon oxide layers formed inside the through fine holes are remained to be exposed and protruded from the etched surface of the silicone substrate 202 (FIG. 19(*e*)).

Patent Literature 3 (Japanese Patent Application Publication, Tokukaihei, No. 9-193400, published on Jul. 29, 1997) discloses an inkjet printer. The inkjet printer includes a nozzle head 301 made of a resin. The nozzle head 301 has a nozzle hole 303, which passes through the nozzle head 301 from a surface to a reverse surface thereof. A Ni plating film 304 is formed on an internal wall of the nozzle hole 303 and partly protruded in a cone-like shape from a tip portion of the nozzle hole.

The inkjet printer includes the nozzle holes 303 in plurality (two channels of nozzle holes 303 are illustrated in FIG. 20). The Ni plating film 304 is formed with all channels. Moreover, all the channels are electrically short-circuited with each other.

In the inkjet printer described in Patent Literature 3, each channel is configured such that ejection liquid 307 is held in a liquid flow path constituted by the nozzle head 301 and the Ni plating film 304. An ejection signal applying means 306 is connected to the Ni plating films 304, while a counter electrode 305 is provided to face with the nozzle head 301. The ejection liquid 307 is ejected toward the counter electrode 305 by electrostatic attraction caused by voltage applied by the ejection signal applying means 306, the result of which the ejection liquid 307 attaches to a print medium 308.

Moreover, Patent Literature 3 describes, as illustrated in FIGS. 21(*a*) to 21(*d*), a method for producing the nozzle provided to the inkjet printer having the above structure.

In the method for producing the nozzle, a nozzle head 301 having nozzle holes 301*a* is prepared firstly, the nozzle holes 301*a* passing through a resin member of the nozzle head 301 from a surface to a reverse surface thereof as illustrated in FIG. 21(*a*).

Then, a molding hole layer 302, made of copper, is connected to the nozzle head, the molding hole layer 302 having molding holes 302*a* internally in a taper shape (FIG. 21(*b*)). After that, an Ni layer 304 is formed by plating. That Ni layer formed on that surface of the nozzle which is to face a medium is removed (FIG. 21(*c*)).

Then, only the molding hole layer 302 is etched away with an etchant, such as concentrated nitric acid or aqueous ammonia, which dissolves copper only (FIG. 21(*d*)). As a result of the removal of the molding hole layer 302, the Ni layer 304 formed on the internal wall of the molding hole layer 302 becomes an outlet 309 having a shape protruding from the resin member of the nozzle head.

Moreover, Patent Literature 4 (Japanese Unexamined Patent Application Publication, Tokukaihei, No. 9-156109, published on Jun. 17, 1997) discloses an inkjet printer of electrostatic attraction type, which includes a nozzle substrate having nozzles, and a counter electrode substrate having protrusion sections positioned in correspondence with the nozzles, wherein the nozzle substrate and the counter electrode substrate are protruded toward a sheet transport plane.

DISCLOSURE OF INVENTION

Incidentally, an inkjet head of the inkjet printer should have fine fluid outlets in order to form fine dots by ejecting liquid to a print target object.

The inkjet printers disclosed in Patent Literatures 1 to 4 are configured such that the flow paths of the nozzles, that is, liquid flow paths are formed along a thickness direction of the substrate. In the configuration in which the liquid flow paths are formed along the thickness direction of the substrate, fine fabrication process to form deep holes of a high aspect ratio is required to give the fluid flow paths a longer flow path length. Production process for such a deep hole formation is highly complicated.

This increases production cost of the inkjet head and makes it difficult to stably produce the inkjet head in the inkjet printers disclosed in Patent Literatures 1 to 4.

In addition to the difficulty of the production process for deep hole formation, the configurations of Patent Literatures 1 to 4 are limited in terms of the plating in that the plating bottom parts of the deep holes is difficult.

Therefore, the inkjet printers disclosed in Patent Literatures 1 to 4 have problems in that the difficulty in the deep hole formation and the limit in the plating imposes a limitation in the shape of the liquid flow path, thereby lowering a degree of freedom in designing the flow path.

The present invention was accomplished in the aforementioned problems. An object of the present invention is to provide a method for producing an inkjet and inkjet head, which method improves the degree of freedom in designing the shape of the liquid flow path.

An inkjet head according to the present invention is an inkjet head, which receives liquid and has at least one outlet for ejecting, in response to voltage application, the liquid to a printing target object. In order to attain the object, the inkjet head according to the present invention includes a substrate; and at least one outer shell on the substrate, each outer shell respectively forming a liquid flow path section along an upper surface of the substrate.

The liquid is a liquid material such as ink, or the like that is to be ejected to a printing target object. The liquid flow path section is a flow path for the liquid.

Moreover, the outer shell forming the liquid flow path section is disposed on the upper surface of the substrate in such a manner that the outer shell at least secures a hollow portion between the outer shell and the upper surface of the substrate, the hollow portion constituting the liquid flow path.

With this configuration, the inkjet head is provided with the outer shell being disposed on the substrate and forming the liquid flow path section. The inkjet head according to the present invention, therefore, allows easy design change in the shape of the outer shell on the substrate by changing in the pattern or the like.

Therefore, the inkjet head of the present invention can have a greater degree of freedom in designing the shape of the liquid flow path section.

A method according to the present invention is a method for manufacturing an inkjet head, which receives liquid and ejects, in response to voltage application, fine droplets of the liquid to a printing target object. In order to attain the object, the method according to the present invention includes: forming a filler member along an upper surface of a substrate, the filler member defining a shape of a flow path of the liquid; forming an outer shell, so that the filler member is concealed with the outer shell and the surface of the substrate; and removing the filler member.

According to the method, the filler member is formed on the surface of the substrate. Thus, a shape of the filler member as desired can be easily attained by etching. Moreover, a shape of the upper flow path layer that conceals the filler member with the surface of the substrate can be attained easily by etching.

As described above, the method according to the present invention can improve the degree of the freedom in designing, because it makes it possible to have a desired shape of the liquid flow path or a desired shape of the upper flow path layer easily.

Additional objects, features, and strengths of the present invention will be made clear by the description below. Further, the advantages of the present invention will be evident from the following explanation in reference to the drawings.

BRIEF DESCRIPTION OF DRAWINGS

FIG. 5(*b*) illustrates the method for producing the inkjet head according to the present embodiment, and is a cross sectional view taken on line A-A' in FIG. 1 at a production step for the inkjet head.

FIG. 5(*c*) illustrates the method for producing the inkjet head according to the present embodiment, and is a cross sectional view taken on line A-A' in FIG. 1 at a production step for the inkjet head.

FIG. 5(*d*) illustrates the method for producing the inkjet head according to the present embodiment, and is a cross sectional view taken on line A-A' in FIG. 1 at a production step for the inkjet head.

FIG. 5(*e*) illustrates the method for producing the inkjet head according to the present embodiment, and is a cross sectional view taken on line A-A' in FIG. 1 at a production step for the inkjet head.

FIG. 5(*f*) illustrates the method for producing the inkjet head according to the present embodiment, and is a cross sectional view taken on line A-A' in FIG. 1 at a production step for the inkjet head.

FIG. 5(*g*) illustrates the method for producing the inkjet head according to the present embodiment, and is a cross sectional view taken on line A-A' in FIG. 1 at a production step for the inkjet head.

FIG. 6(*a*) illustrates the method for producing the inkjet head according to the inkjet head according to the present embodiment, and is a cross sectional view taken along a longitudinal direction of a liquid flow path at a production step for the inkjet head.

FIG. 6(*b*) illustrates the method for producing the inkjet head according to the inkjet head according to the present embodiment, and is a cross sectional view taken along the longitudinal direction of the liquid flow path at a production step for the inkjet head.

FIG. 6(*c*) illustrates the method for producing the inkjet head according to the inkjet head according to the present embodiment, and is a cross sectional view taken along the longitudinal direction of the liquid flow path at a production step for the inkjet head.

FIG. 6(*d*) illustrates the method for producing the inkjet head according to the inkjet head according to the present embodiment, and is a cross sectional view taken along the longitudinal direction of the liquid flow path at a production step for the inkjet head.

FIG. 6(*e*) illustrates the method for producing the inkjet head according to the inkjet head according to the present embodiment, and is a cross sectional view taken along the longitudinal direction of the liquid flow path at a production step for the inkjet head.

FIG. 7(*b*) illustrates the method for producing the manifold according to the present embodiment, and is a perspective view of the manifold at a production step of the manifold.

FIG. 7(*c*) illustrates the method for producing the manifold according to the present embodiment, and is a perspective view of the manifold at a production step of the manifold.

FIG. 10(*b*) is a cross sectional view taken on the longitudinal direction of the liquid flow path section, and explains in the step for fabricating the ejection section of the inkjet head according to the present embodiment.

FIG. 11(*b*) is a cross sectional view of the ejection section of the inkjet head according to the present embodiment taken on the longitudinal direction thereof, and illustrates the ejection section after the etching process and resist removal in the fabrication of the inkjet head.

FIG. 12(*b*) is a cross sectional view of the liquid flow path section, and explains the resist patterning process in the fabrication of the ejection section of the inkjet head according to the present embodiment.

FIG. 13(*b*) is a cross sectional view of the ejection section of the inkjet head according to the present embodiment taken on the longitudinal direction thereof, and illustrates the cross sectional section after the etching process and resist removal in the fabrication of the ejection section.

FIG. 19(*b*) illustrates the conventional art, and is a cross sectional view illustrating the method for producing fine nozzles.

FIG. 19(*c*) illustrates the conventional art, and is a cross sectional view illustrating the method for producing fine nozzles.

FIG. 19(*d*) illustrates the conventional art, and is a cross sectional view illustrating the method for producing fine nozzles.

FIG. 19(*e*) illustrates the conventional art, and is a cross sectional view illustrating the method for producing fine nozzles.

FIG. 21(*b*) illustrates the conventional art and is a view illustrating the method for producing the nozzle.

FIG. 21(*c*) illustrates the conventional art and is a view illustrating the method for producing the nozzle.

FIG. 21(*d*) illustrates the conventional art and is a view illustrating the method for producing the nozzle.

FIG. 22(*b*) illustrates the method for producing the inkjet head according to the present embodiment, and is a cross sectional view taken on line B-B' of FIG. 1 at a step of the production of the inkjet head.

FIG. 22(*c*) illustrates the method for producing the inkjet head according to the present embodiment, and is a cross sectional view taken on line B-B' of FIG. 1 at a step of the production of the inkjet head.

FIG. 22(*d*) illustrates the method for producing the inkjet head according to the present embodiment, and is a cross sectional view taken on line B-B' of FIG. 1 at a step of the production of the inkjet head.

FIG. 22(*e*) illustrates the method for producing the inkjet head according to the present embodiment, and is a cross sectional view taken on line B-B' of FIG. 1 at a step of the production of the inkjet head.

FIG. 22(*f*) illustrates the method for producing the inkjet head according to the present embodiment, and is a cross sectional view taken on line B-B' of FIG. 1 at a step of the production of the inkjet head.

FIG. 22(*g*) illustrates the method for producing the inkjet head according to the present embodiment, and is a cross sectional view taken on line B-B' of FIG. 1 at a step of the production of the inkjet head.

FIG. 23(*b*) is a view illustrating an example of another cross sectional shape regarding the liquid flow path section according to the present embodiment.

FIG. 24(*b*) is another method for producing the inkjet head according to the present embodiment, and is a cross sectional view taken on line A-A' of FIG. 1 at a step in the production of the inkjet head.

FIG. 24(*c*) is another method for producing the inkjet head according to the present embodiment, and is a cross sectional view taken on line A-A' of FIG. 1 at a step in the production of the inkjet head.

FIG. 24(*d*) is another method for producing the inkjet head according to the present embodiment, and is a cross sectional view taken on line A-A' of FIG. 1 at a step in the production of the inkjet head.

FIG. 24(*e*) is another method for producing the inkjet head according to the present embodiment, and is a cross sectional view taken on line A-A' of FIG. 1 at a step in the production of the inkjet head.

FIG. 25(*b*) illustrates an embodiment of the present invention, and is a view illustrating another cross sectional shape regarding a liquid flow path section according the present embodiment.

FIG. 25(*c*) illustrates an embodiment of the present invention, and is a view illustrating another cross sectional shape regarding a liquid flow path section according the present embodiment.

FIG. 29(*b*) illustrates the method for producing the inkjet head according to the present embodiment, and a cross sectional view taken on the longitudinal direction of a liquid flow path section at a step in the production of the inkjet head.

FIG. 29(*c*) illustrates the method for producing the inkjet head according to the present embodiment, and a cross sectional view taken on the longitudinal direction of a liquid flow path section at a step in the production of the inkjet head.

FIG. 29(*d*) illustrates the method for producing the inkjet head according to the present embodiment, and a cross sectional view taken on the longitudinal direction of a liquid flow path section at a step in the production of the inkjet head.

BEST MODE FOR CARRYING OUT THE INVENTION

One present embodiment of the present invention is described below in reference to drawings.

Figure 1:
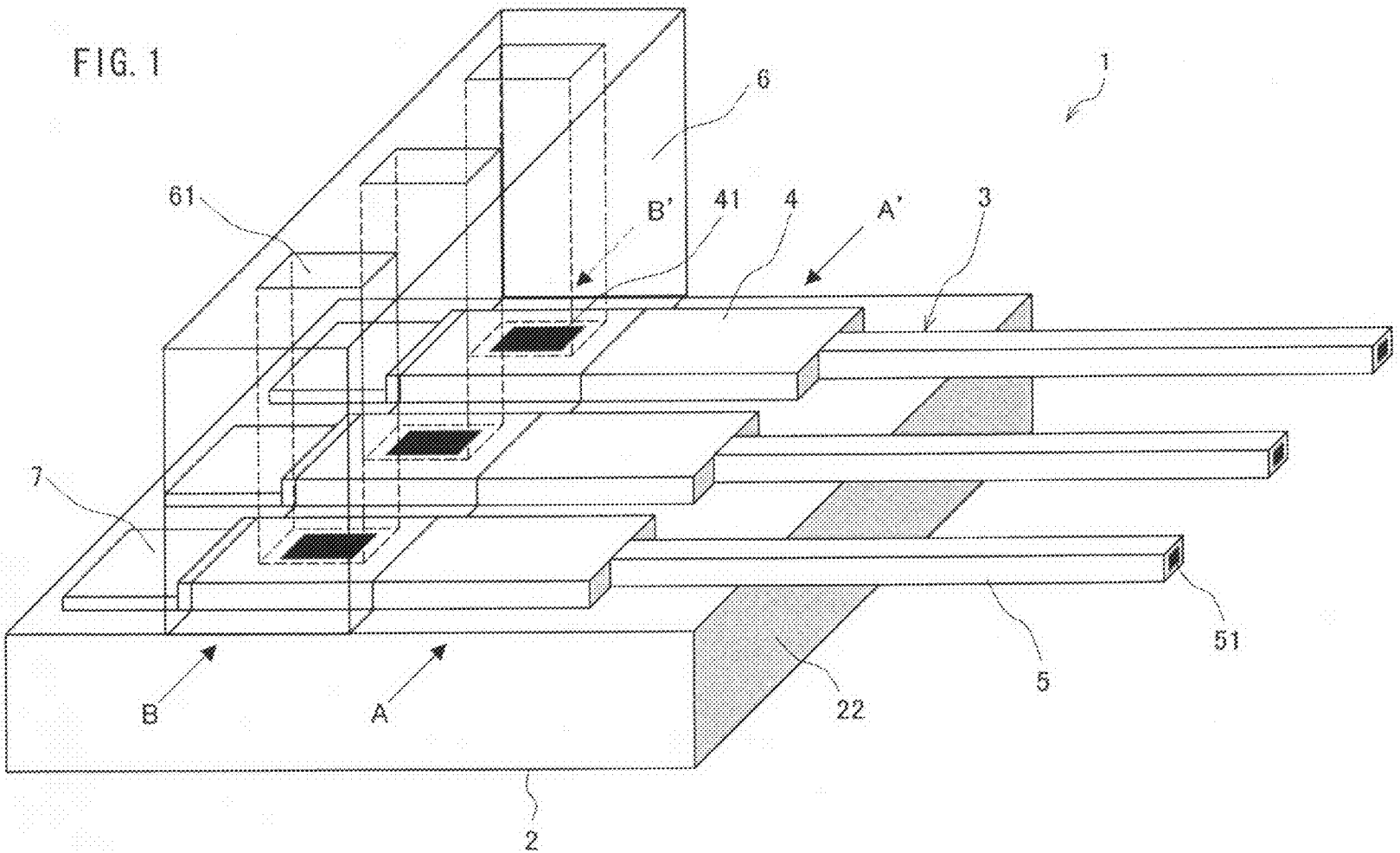
FIG. 1 illustrates an present embodiment of the present invention and is a perspective view schematically illustrating a structure of an inkjet head.
Figure 2:
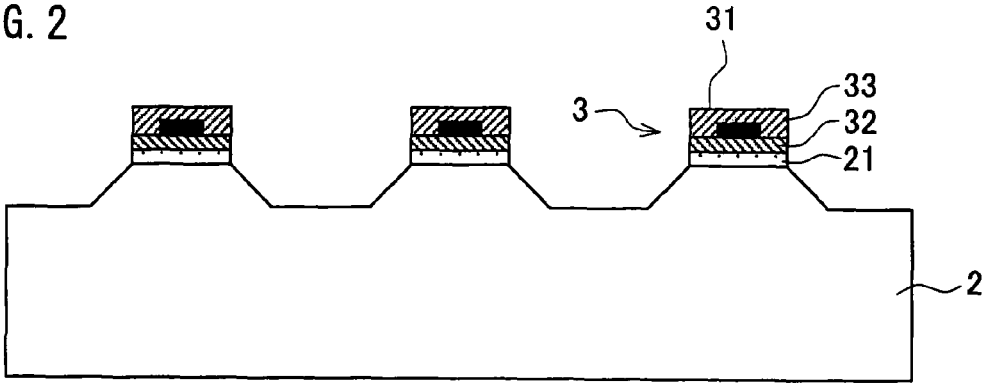
FIG. 2 is a cross sectional view taken on line A-A' in the perspective view of the inkjet head according to the present embodiment illustrated in FIG. 1.

Firstly, an inkjet head 1 according to the present embodiment is described in terms of its structure referring to FIGS. 1 and 2. FIG. 1 illustrates the present embodiment of the present invention, and is a perspective view schematically illustrating the structure of the inkjet head 1, whereas FIG. 2 is a cross sectional view taken on line A-A' of the inkjet head illustrated in FIG. 1.

(Structure of Inkjet Head)

The inkjet head 1 according to the present embodiment is configured to eject fine liquid droplets to a print target object. More specifically, the inkjet head 1 is a head of a so-called electrostatic ejection type inkjet, which ejects the liquid droplets by electrostatic repulsion caused by electric field application on the liquid droplets. In the inkjet head 1, voltage application results in concentration of an electric field in the vicinity of an outlet 51 of a liquid flow path section 3 provided to the inkjet head 1. The concentration of the electric field causes the ejection of fine liquid droplets to the print target object.

Incidentally, the inkjet head 1 is configured to be provided to a fine dot forming device (not illustrated) for forming, on a print target object (e.g., color filter for liquid crystal display, a printed wired board, etc.), a fine pattern with fine dots. The inkjet head 1 is configured as below.

As illustrated in FIG. 1, the inkjet head 1 includes a substrate 2, a liquid flow path section 3, a manifold 6, and a mounting section 7. In this present embodiment, the inkjet head 1 is configured such that three liquid flow paths 3 are provided on a surface of the substrate 2 with 169 μm pitches therebetween.

The substrate 2 is made of monocrystal silicone and has the liquid flow path section 3 on the surface thereof. The liquid flow path section 3 has an ejection section 5, part of which is protruded beyond an edge portion 22 of the surface on which the liquid flow section 3 is formed.

The crystal lattice shows a Miller indices of (100) on that surface of the substrate 2 on which the liquid flow path section 3 is formed.

The liquid flow path section 3 is a path to let the liquid (liquid material) to pass therethrough to be ejected toward the print target object. The liquid flow path section 3 has a through hole whereby the liquid passes through the inside of the liquid flow path section 3. One end portion of the liquid flow path section 3 constitutes a supplying section 4 having a liquid inlet 41 via which the liquid to be ejected toward the print target object is supplied. The other end portion of the liquid flow path section 3 constitutes the ejection section 5 having an outlet 51 via which the liquid is ejected toward the print target object.

At end portion (i.e., ejection section 5-side) of the liquid flow path section 3 in which the outlet 51 is formed, the ejecting portion 5 is partly protruded beyond the edge portion 22 of the substrate 2. In a specific example of the present embodiment, the length (protrusion amount) of the protrusion of the ejection section 5 beyond the edge portion 22 of the substrate 2 is 100 μm.

As a whole, the ejection section 5 has such a shape that is 120 μm in length, 7 μm is width, and 6 μm in height.

Here, the length is along the direction in which the liquid flows toward the outlet 5 from the supplying section 4 (i.e., the longitudinal direction of the liquid flow path section 3). The height is along the direction perpendicular with respect to that surface of the substrate 2 on which the liquid flow path section 3 is formed. Moreover, the width is along the direction perpendicular to the direction from the supplying section 4 to the outlet section 5 and to the direction of the height.

The liquid flow path section 3 is so configured to have such an internal cross sectional area (taken on the direction of width) that is smaller at a portion with the supplying section 4 than at a portion with the ejection section 5. More specifically, a specific example is arranged such that the liquid flow path section 3 is configured such that an internal width is 3 μm in the vicinity of the outlet 51, but an internal width is 70 μm in the vicinity of the liquid inlet 41 whereas internal height of the liquid flow path section 3 is 2 μm substantially constantly, thereby having different internal cross section areas at the outlet 51 and at the liquid inlet 41. Moreover, the outlet 51, which is opened at one edge surface of the ejection section 5, has a substantially rectangular shape with a 3 μm width and a 2 μm height.

Moreover, as illustrated in FIG. 2, an outer shell 31, which constitutes an outer periphery of the liquid flow path section 3, includes a lower flow path layer 32 and an upper flow path layer 33 at the cross section of the liquid flow path section 3 taken on line A-A'. The lower flow path layer 32 and the upper flow path layer 33 are respectively 2 μm in thickness and made of a conductive material whose main component is Ni.

It is only required that at least one of the lower flow path layer 32 and the upper flow path layer 33 is made of Ni as described above. It is preferable that both the layers be made of such a material containing Ni, in order to prevent both the layers from being eroded with an etching solution in etching the substrate 2 as later described.

Furthermore, an insulating layer 21 is provided at a portion where the liquid flow path section 3 will junction with the substrate 2. The insulating layer 21 is in a range of 0.2 μm to 2 μm in thickness, and is a Si oxide film, Si nitride film, or the like.

Further, the liquid inlet 41 of the supplying section 4 is in a substantially square shape of 50 μm×50 μm in size and opens through the upper liquid flow path layer 33. Further, each liquid flow path section 3 has the liquid inlet 41 at the substantially same position in the supplying section 4 thereof. Thus, the liquid inlets 41 of the liquid flow path sections 3 are aligned in a substantially straight line.

The manifold 6 is configured to supply, to the respective liquid flow path sections 3, the liquid to be ejected toward the print target object. The manifold 6 is made of an insulating material.

The manifold 6 is provided on the substrate 2 such that the manifold 6 covers the liquid flow path sections 3 that are provided on the substrate 2, and reaches the substrate 2 at its edge portion, as illustrated in FIG. 1.

In the present embodiment, the manifold 6 has the same number of liquid supplying holes 61 as the number of the liquid flow path sections 3. Each liquid supplying hole 61 has an internal cross sectional area of 80 μm×80 μm and a length of 3 mm. The liquid supplying holes 61 are respectively provided corresponding to the liquid inlets 41, and connected, at their edge surface, to the respective supplying sections 4.

This cross section of each liquid supplying hole 61 is an area of a portion thereof that is in contact with the liquid inlet 41 of the liquid flow path section 3. The length of each liquid supplying hole 61 is along the direction perpendicular with respect to that surface of the substrate 2 on which the liquid flow path sections 3 are provided.

Moreover, at the other end thereof which is opposite to the end connected with the supplying section 4, each liquid supplying hole 61 of the manifold 6 is connected with a common liquid room (not illustrated) at one end and to the supplying section 4 at the other end. The common liquid room is configured to supply the liquid to all the liquid supplying holes 61.

Figure 3:
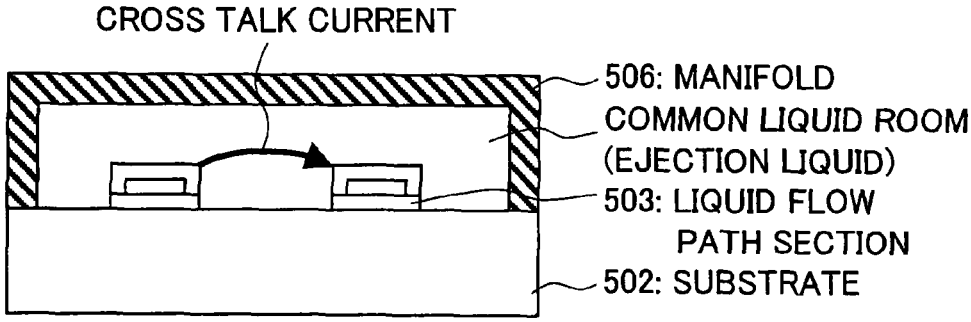
FIG. 3 illustrates a comparative example with respect to the inkjet head according to the present embodiment, and is a cross sectional view of a manifold formed on a substrate.

It is an option that the present invention is so configured that a manifold 6 also acts as a common liquid room, as illustrated in FIG. 3. FIG. 3 illustrates a comparative example with respect to the inkjet head 1 of the present embodiment, and is a cross sectional view of a manifold 506 formed on a surface of a substrate 502.

In the configuration in which the manifold 506 also acts as the common liquid room as illustrated in FIG. 3, voltage application on a given liquid flow path section 503 also causes voltage application on another liquid flow path section 503 via ink in the common liquid room. As a result, so-called "cross talk" occurs in which the liquid is also ejected from the another liquid flow path section 503 undesirably.

On the contrary, the cross talk can be prevented in the configuration, as in the inkjet head 1 of the present embodiment, that each liquid supplying hole 61 is respectively provided to the corresponding liquid flow path section 3 and connected to the common liquid room at one end and to the supplying section 4 on the other end.

Figure 4:
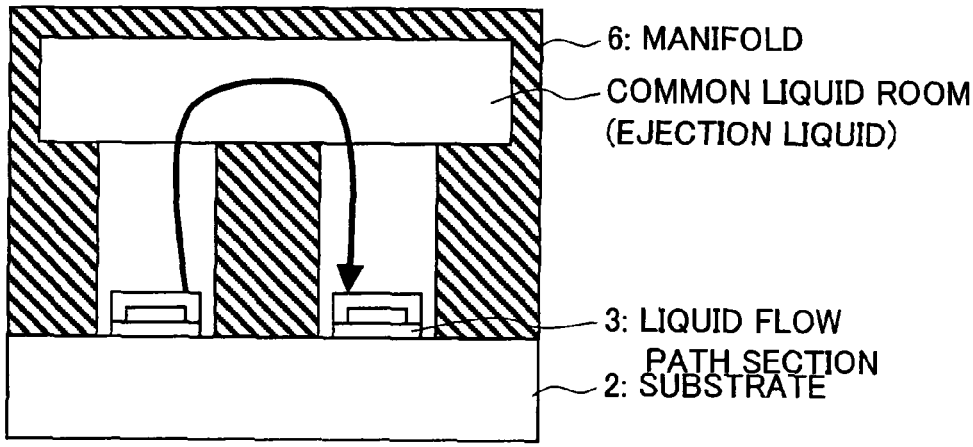
FIG. 4 is a cross sectional view of a manifold of the inkjet head according to the present embodiment.
Figure 5E:
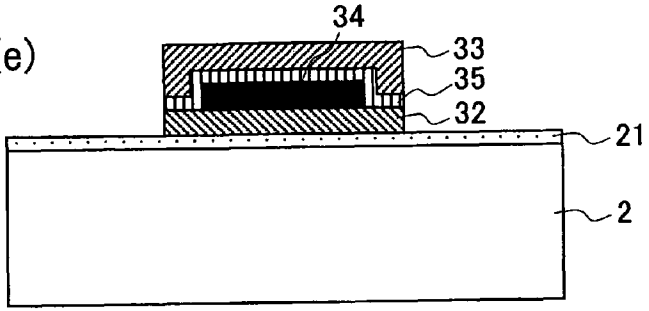
FIG. 5(*a*) illustrates a method for producing the inkjet head according to the present embodiment, and is a cross sectional view taken on line A-A' in FIG. 1 at a production step for the inkjet head.
Figure 5F:
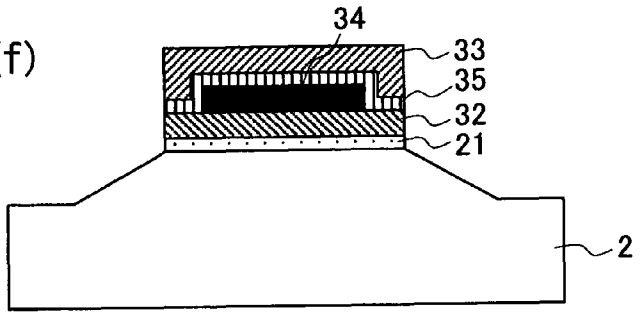
Figure 5G:
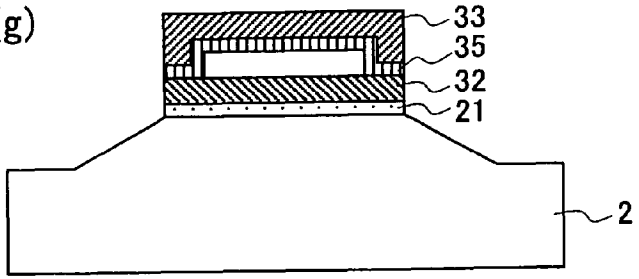
Figure 5A:
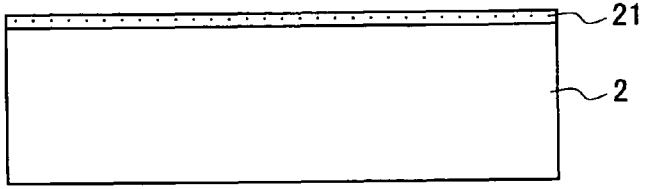
Figure 5B:
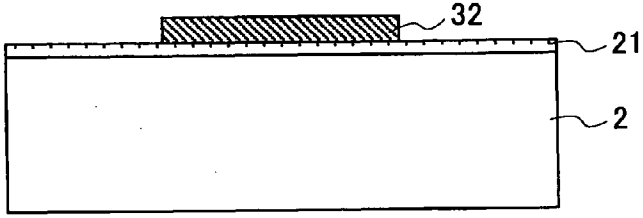
Figure 5C:
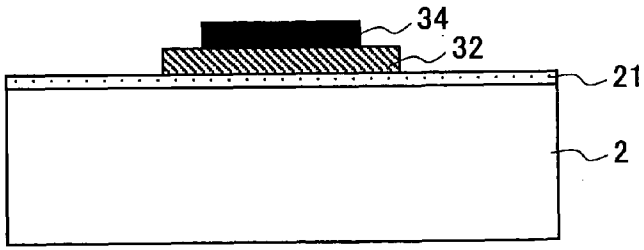
Figure 5D:
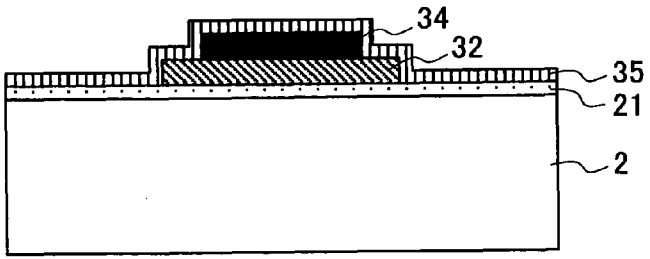

More specifically, the inkjet head 1 of the present embodiment is configured that, as illustrated in FIG. 4, leakage of the voltage from one liquid flow path section 3 to another adjacent liquid flow path section 3 via the liquid requires the voltage to travel in a long way from (i) the flow path of the liquid supplying hole 61 that corresponds to the liquid flow path section 3 to which the voltage is applied, via (ii) the common liquid room, to (iii) the flow supplying hole 61 that corresponds to the liquid flow path section 3 to which no voltage is applied.

Thus, it is possible to prevent such cross talk in the inkjet head 1 according to the present embodiment, because the leakage of the voltage from one liquid flow path section 3 to another liquid flow path section 3 adjacent thereto is encountered with a large resistance against the leakage of the voltage form one liquid flow path section 3 to another flow path section 3 adjacent thereto.

The mounting section 7 is configured to receive an ejection signal for controlling the ejection of the liquid to the print target object.

Along the longitudinal direction of the liquid flow path section 3, the outer shell 31 constituting the liquid flow path section 3 is extended on a rear side with respect to the supplying section 4 (in the opposition direction to the direction toward the outlet 5 in the longitudinal direction of the liquid flow path section 3). The extended portion of the outer shell 31 constitutes the mounting section 7. The mounting section 7 is electrically connected with an external signal transmitting means (not illustrated) such as a flexible substrate by a mounting technique such as wire bonding.

The mounting section 7 may be constituted by any one of the lower flow path layer 32 and upper flow path layer 33 of the outer shell 31. That is, the mounting section 7 is only required to be electrically connected with at least one of the lower flow path layer 32 and the upper flow path layer 33, which are electrically conductive.

With this, the inkjet head 1 according to the present embodiment is capable of applying the ejection signal to the outer shells 31 that respectively constitute the liquid flow path sections 3 that are electrically independent of each other. This makes it easy to apply the ejection signal to one liquid flow path section 3 specifically.

Further, the outer shell 31 of the liquid flow path section 3 is made of Ni, whereby the liquid flow path section 3 has a lower electric resistance against electric charge transport, thereby making it easy for the electric charge to be transported. This concentrates the electric charge at the outlet 51 via the outer shell 31. The concentrated electric charge causes electric field concentration in a liquid meniscus formed at the outlet 51. That is, the inkjet head 1 according to the present embodiment is configured such that the outer shell 31 is utilized as an electrode thereof.

The inkjet head 1 according to the present embodiment is configured such that, as described above, the liquid flow path section 3 is provided on the surface of the substrate 2. With this configuration, the shape of the liquid flow path section 3, or the shape of the liquid flow path formed with the outer shell 31 of the liquid flow path section 3 can be changed, as desired, by changing a pattern of photolithography.

This allows a greater degree of freedom in adjustment of the flow path resistance for the liquid to flow through the liquid flow path section 3, compared with the conventional structure in which the flow path is formed along the thickness direction of the substrate. Moreover, with this configuration, it is possible to change the design of the liquid flow path section 3 as appropriate according to application of the inkjet head 1.

Further as illustrated in FIG. 2, the liquid flow path section 3 of the substrate 2 is positioned on a trapezoidally-protruded portion of the substrate 2 with respect to the surface thereof. The liquid flow path section 3 is firmly attached to the substrate 2 with the insulating layer 21 therebetween.

This electrically insulates the liquid flow path 3 from the substrate 2, thereby reducing the risk of the electrical cross talk between the liquid flow path 3 and another liquid flow path section 3 adjacent thereto.

Furthermore, the liquid flow path section 3 is positioned on the trapezoidally-protruded section as described above. Compared with a structure in which the liquid flow path sections 3 are formed on a flat portion of the substrate 2, the inkjet head 1 is so configured that the liquid flow path sections 3 are positioned on the portions higher than the other portion (i.e., the flat portion) of the substrate 2, and are located on the insulating layer 21. With this configuration, the liquid flow path section 3 of the inkjet head 1 according to the present embodiment has a larger electric resistance against the flow of a current from the liquid flow path section 3 via the substrate 2 to another liquid flow path section 3 or the like adjacent thereto, compared with the structure in which the liquid flow path section 3 is provided on the flat portion of the substrate 2.

As a result, it becomes possible to reduce the risk of the cross talk caused by the current that, upon application of a high voltage on the liquid flow path section 3, would flow from one liquid flow path section 3 to the other liquid flow path section 3 via the substrate 2.

Moreover, as described above, the inkjet head 1 according to the present embodiment is configured such that part of the outlet 51 is protruded beyond the edge portion section 22 of the substrate 2. With this configuration, the electric field can be effectively concentrated in the vicinity of the outlet 51 in response to the application of the ejection signal.

This allows the inkjet head 1 to use an ejection signal of a lower voltage. This prevents such a cross talk caused by a current that would flow from one liquid flow path section 3 to another flow path section 3 or the like adjacent thereto due to electrical discharge caused by dielectric breakdown or the like.

In the inkjet head 1 in which the ejection signal of a low voltage can be used, it is possible to reduce such a risk of electric discharge toward the print target object, which would damage the print target object.

Moreover, the inkjet head 1 according to the present embodiment is so configured that the liquid supplying holes 61 are respectively provided to the corresponding liquid flow path sections 3, and each liquid supplying hole 61 is connected to the corresponding supplying sections 4 at one end and to the common liquid room at the other end. This prevents the cross talk of the ejection signal from one channel to another adjacent thereto.

Moreover, the outer shell 31 of each liquid flow path section 3 can serve as an electrode as described above in the inkjet head 1 according to the present embodiment. This shortens a time required for the electric field in the vicinity of the outlet 51 to reach electric field intensity necessary for the ejection. This improves the inkjet head 1 to eject with better responding property, thereby speeding up printing speed.

(Method for Producing Inkjet Head)

Next, a method according to the present embodiment for producing the inkjet head 1 is described, referring to FIGS. 5(*a*) to 5(*g*). FIGS. 5(*a*) to 5(*g*) illustrate the method according to the present embodiment for producing the inkjet head 1, and are cross sectional views taken on line A-A' in FIG. 1, illustrating steps of the method.

Firstly, the insulating layer 21 is formed on the substrate 2 made of (100) monocrystal silicone (FIG. 5(*a*)). In this step of forming the insulating layer 21, a silicon oxide film is formed as the insulating layer 21 in a thickness of 0.5 μm by an ordinary thermal oxidization method.

It is preferable that the thickness of the insulating layer 21 be sufficient for insulating the substrate 2 from the outer shell 31 of the liquid flow path section 3 formed on the insulating layer. However, if the thickness of the insulating layer 21 was designed to be too thick, the production process of the inkjet head 1 takes a long time unnecessarily. Thus, it is most suitable that the thickness of the insulating layer 21 is in a range of from 0.2 μm to 5 μm.

Then, the lower flow path layer 32 is formed on the insulating layer 21 (FIG. 5(*b*)). Here, the lower flow path layer 32 is made of a metal material whose main component is Ni. The lower flow path layer 32 is formed in a thickness of 2 μm on the insulating layer 21 by selective plating in which a resist or the like is used to limit where to plate. As an alternative, the lower flow path layer 32 may be formed by depositing a lower flow path formation layer on a substantially whole surface of the substrate 2, and then dry-etching or wet-etching the lower flow path formation layer into a desired pattern.

Moreover, other film formation methods such as vapor deposition, sputtering, etc, are also applicable for the deposition of the lower flow path formation layer, besides, the plating.

In case where the lower flow path formation layer is deposited by the vapor deposition, sputtering, or the like method, the lower flow path layer 32 is patterned into such a shape whose longitudinal direction is the direction perpendicular to the (110) plane of the substrate 2.

On the lower flow path layer 32, a photo resist patterned by exposure to light and development is formed as the liquid flow path layer 34 of 2 μm in thickness (FIG. 5(*c*)). The liquid flow path layer 34 is made of, for example, an organic material such as a resin material whose main component is a novolac resin or a novolac resin derivative, especially, of a photo sensitive organic material.

In a specific example, the photosensitive organic material is AZP-4330, AZP-4620 made by Clarient Japan was used.

After that, an under layer 35 for the upper flow path layer 33 is formed all over the surface on which the insulating layer 21, the lower flow path layer 32, and the liquid flow path layer 34 are formed on the substrate 2 (FIG. 5(*d*)).

The under layer 35 includes a contact layer and a seed layer. The contact layer, made of a metal material whose main component is Ti, is formed on or above the substrate 2, the lower flow path layer 32, and the liquid flow path layer 34. The seed layer, whose main component is Ni, is formed on the contact layer, allows plating to form the upper flow path layer 33 thereon. As the thickness of the under layer 35, the contact layer is 50 nm in thickness and the seed layer is 50 nm in thickness.

Moreover, the contact layer and the seed layer are deposited sequentially under the same vacuum, thereby avoiding reducing sealing between the contact layer and the seed layer. Moreover, in case the vapor deposition is carried out, it is preferable that Ar be introduced into a vapor deposition atmosphere and the deposition is carried out under vacuum in the order of 10−4 Torr, in order to facilitate the adhesion of the under layer 35 to side surfaces of the liquid flow path layer 34.

Moreover, the under layer 35 may be formed by sputtering, rather than the vapor deposition.

After that, an area where the upper flow path layer 33 is to be formed is restricted with a resist pattern patterned by photolithography. Then, in the area where the upper flow path layer 33 is to be formed, an upper flow path formation layer, whose main component is Ni, is formed in a thickness of 2 μm on the under layer 35. The plating film and the seed layer adhered to an area where they are unnecessary are then removed by wet-etching (FIG. 5(*e*)).

Here, the etching solution is a mixture solution of nitric acid: hydrogen peroxide: water. The contact layer whose main component is Ti cannot be removed by the wet-etching described above. Thus, the contact layer is removed by dry-etching in which Ar ions are used.

A very small etching amount is required to etch away the 50 nm thickness of the contact layer. Thus, use of the upper flow path layer 33 as etching mask does not badly affect the structure of the inkjet head 1, because the etching merely reduces the thickness of the upper flow path layer 33 from 2 μm to 1.95 μm. Therefore, the etching of the contact layer does not require a resist pattern particularly.

Further, the film prepared by thermal oxidation is removed by reactive etching (RIE) in which a reactive gas whose main component is $CF_4$ gas is used. Again, the upper flow path layer 33 is hardly etched by RIE using the reactive gas whose main component is $CF_4$ gas. Thus, no resist pattern is necessary particularly.

After that, the substrate 2 is immersed into an etching solution in order to etch the substrate 2 into a trapezoidal shape in an upper part of the cross-section thereof taken on the line A-A' (FIG. 5(*f*)). After that, the resist (liquid flow path layer 34) is removed by using a resist-dissoluble solution such as acetone, or a resist stripping solution such as stripper 106 made by Tokyo Ohka Kogyo Co., Ltd. Thereby, a hollow is formed inside the liquid flow path section 3 (FIG. 5(*g*)).

In the following, the steps illustrated in FIGS. 5(*e*) to 5(*g*) are described in more details referring to FIGS. 6(*a*) to 6(*e*). That is, the steps from FIG. 5(*e*) are explained referring to cross sectional views of FIGS. 6(*a*) to 6(*e*) taken along the longitudinal direction of the liquid flow path section 3 of the inkjet head 1.

Here, the insulating layer 21, lower flow path layer 32, liquid flow path layer 34, under layer 35 and upper flow path layer 33 have been respectively formed on the substrate 2 via the steps illustrated in FIGS. 5(*a*) to 5(*d*) described above. The lower flow path layer 32 and the upper flow path layer 33 have been patterned by then.

With this circumstances, the formation of the outlet 51 (shape of the tip surface of the outlet 51) is carried out by removing tip portions of the upper flow path layer 33 and the lower flow path layer 32 along the longitudinal direction of the pattern and the insulating layer 21 under the tip portions (FIG. 6(*a*)). The removal is carried out by dry-etching in which Ar is used, or RIE in which $CF_4$ gas is used. A specific example is arranged such that the tip surfaces of the liquid flow path sections 3 where the outlets 51 are to be formed are aligned in a straight line parallel to the (110) surface. As an alternative for the dry-etching in which Ar is used, the formation of the outlet 51 (the shape of the edge surface of the outlet 51) may be carried out by wet-etching. In either etching, an area not to be etched should be covered with a resist layer (not illustrated) on the upper flow path layer 33. Thus, a step for forming the resist layer and a step for removing the resist layer after the formation of the outlet are necessary.

Next, by a cutting means such as dicing, the substrate 2 is cut at a position beyond the position of the formation of the outlet 51 in the direction of the tip of the pattern (FIG. 6(*b*)). The cutting of the substrate 2 exposes a (110) surface on the diced surface 23. If the substrate 2 has had already a (110) surface exposed as such, the step of cutting illustrated in FIG. 6(*b*) may be omitted.

Next, the cut tip portion is immersed in an etching solution for Si, thereby to etch away the substrate 2 made of Si (FIG. 6(*c*)). Here, the etching solution is a KOH aqueous solution of 40 wt % heated to 80° C.

By the etching solution, the (110) surface exposed by the dicing is etched away at a faster rate than the (100) surface and (111) surface. This proceeds the etching in a substantially perpendicular direction with respect to the (110) surface exposed with respect to the direction from the position of the outlet 51 and the supplying section 4. In this way, the substrate 2 is partly etched away. The etched-away portion of the substrate 2 includes that portion of the substrate 2 on which part of the ejection section 5 of the inkjet head 1 is formed. As a result, the part of the ejection section 5 is protruded from the edge section 22 of the substrate.

Moreover, excellent reproducibility of this etching makes it possible to control an amount of the protrusion of the ejection section 5 as desired by controlling etching time. This etching also etches the (100) surface (i.e., the top surface) of the substrate 2. But, the etching of the (100) surface is sped down to a 1/500 etching rate on exposure of a (111) surface, thereby being almost terminated. The (111) surface started from the pattern edge of the lower flow path layer 32.

As described above, the etching of the surface of the substrate 2 proceeds from the pattern edge of the lower flow path layer 32 until the (111) surface is exposed. As a result, the liquid flow path section 3 resides on the trapezoidal shape as illustrated in FIG. 2. At this moment, the cross section of the inkjet head 1 taken on line A-A'becomes as illustrated in FIG. 5(*f*).

The "pattern edge" is an edge portion that is in contact with a largest portion of the liquid flow path section 3 along its width direction, that is, in contact with the surface of the substrate 2 that is parallel with a <110> direction of the supplying section 4, that is, the direction from the outlet 51 toward the supplying section 4 in the specific example.

Next, as described in the explanation of the step illustrated in FIG. 5(*g*), the resist (liquid flow path layer 34) is removed with the resist striping solution, thereby to form the hollow inside the liquid flow path section 3. Then, the manifold 6 is attached to the supplying section 4 by using an adhesive agent 8 (FIG. 6(*d*)).

The manifold 6 is attached to the supplying section 4, matching the opening of the liquid supplying hole 61 with the liquid inlet 41 of the supplying section 4.

The attaching of the manifold 6 to the supplying section 4 is carried out with an epoxy based adhesive agent 8. The attaching of the manifold 6 to the supplying section 4 is carried out in such a manner that the adhesive agent and manifold do not touch the mounting section 7 of the backward edge of the inkjet head 1 (the edge portion of the inkjet head 1 in the opposite side of the outlet 51).

As described above, the inkjet head 1 is formed on the substrate 2 and no fine structure is formed on the reverse surface of the substrate 2 (i.e., that surface of the substrate 2 which is a reverse side of the surface thereof on which the inkjet 1 is formed). Thus, it is possible to apply suction to the reverse surface of the substrate 2 in order to firmly hold the inkjet head 1 with ease in the step of adhering the manifold 6 to the supplying section 4. This allows carrying out the step of adhering the manifold 6 to the liquid flow path section 3 stably.

Next, as illustrated in FIG. 6(*e*), the mounting section 7 is electrically connected to an external line 71 of, e.g., a flexible substrate connected to an ejection signal generating apparatus (not illustrated) provided out of the inject head 1. The electrical connection of the mounting section 7 to the external line 71 is carried out by mounting means such as wire bonding or the like.

The inkjet head 1 according to the present embodiment can be firmly held with ease, as described above, because no fine structure is formed on the reverse surface of the substrate 2 (i.e., that surface of the substrate 2 which is a reverse side of the surface thereof on which the liquid flow path section 3 is formed).

Moreover, in order to connect the mounting section to the external line 71, it is possible to apply pressure from above the surface of the substrate 2 (i.e., from above that surface of the substrate 2 on which the liquid flow path section 3 is to be formed) in the process for fabricating the liquid flow path section 3. Thus, it is possible to make the mounting section more reliable.

So far, the process for producing the inkjet head 1 is described referring to FIGS. 5(*a*) to 5(*g*), and 6(*a*) to 6(*e*). Note that the process for producing the inkjet head 1 is explained referring to FIGS. 6(*a*) to 6(*e*) in which the liquid inlet 41 has been already formed. In the following, how to form the liquid inlet 41 is described referring to FIGS. 22(*a*) to 22(*g*).

Figure 22:
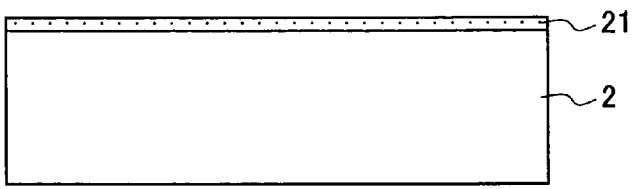
FIG. 22(*a*) illustrates a method for producing the inkjet head according to the present embodiment, and is a cross sectional view taken on line B-B' of FIG. 1 at a step of the production of the inkjet head.
Figure 22:
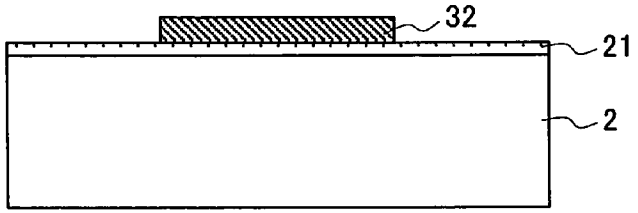
Figure 22:
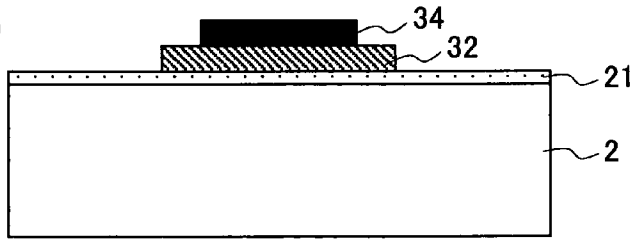
Figure 22:
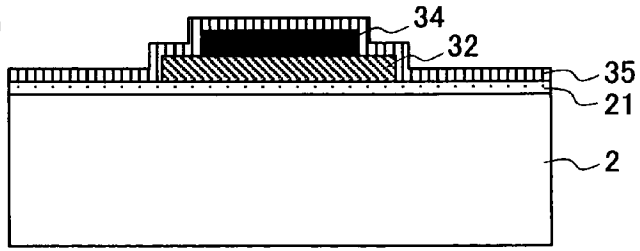
Figure 22:
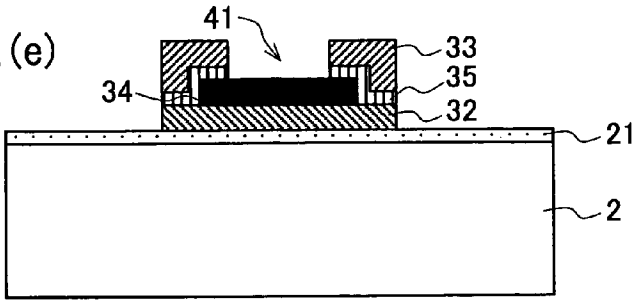
Figure 22:
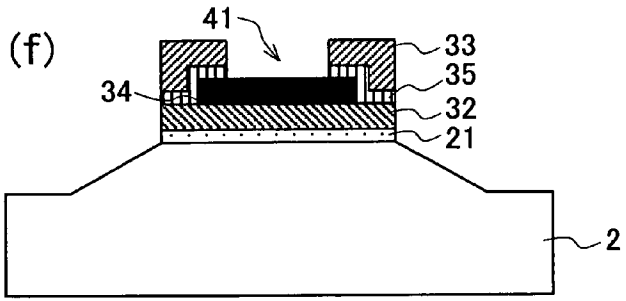
Figure 22:
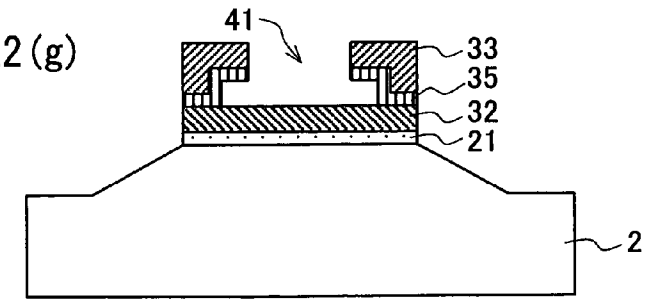

FIGS. 22(*a*) to 22(*d*) illustrate the same steps illustrated in FIGS. 5(*a*) to 5(*d*). So, their explanation is omitted here.

As described above, the area in which the upper flow path layer 33 is to be formed is restricted with the resist pattern patterned by photolithography in the step illustrated in FIG. 5(*e*). Then, the upper flow path layer 33 whose main component is Ni is formed by plating.

The formation of the liquid inlet 41 is carried out as follows. In forming the upper flow path layer 33, a resist is provided at that position on the under layer 35 at which the liquid inlet 41 of the liquid flow path section 3 is to be formed. The resist on the under layer 35 as described above prevents formation of the upper flow path layer 33 in the area on the under layer 35 in which the liquid inlet 41 is to be formed.

After the resist is removed by using an organic solvent or the like, the under layer 35 in the area in which the liquid inlet 41 is to be formed is etched away by wet-etching and dry-etching. In this way, an opening to be the liquid inlet 41 is formed (FIG. 22(*e*)).

FIGS. 22(*f*) and 22(*g*) illustrate the same steps illustrated in FIGS. 5(*f*) and 5(*g*). Thus, their explanation is omitted here.

(Process for Producing Manifold)

Here, a method for producing the manifold 6 is described below referring to FIG. 7.

Figure 7A:
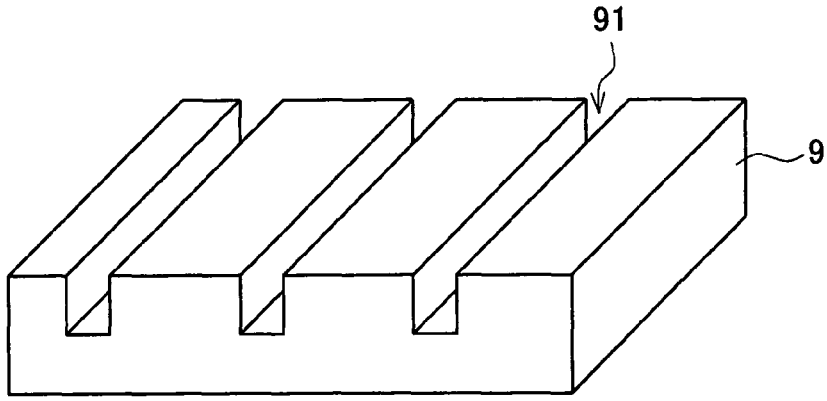
FIG. 7(*a*) illustrates a method for producing the manifold according to the present embodiment, and is a perspective view of the manifold at a production step of the manifold.
Figure 7B:
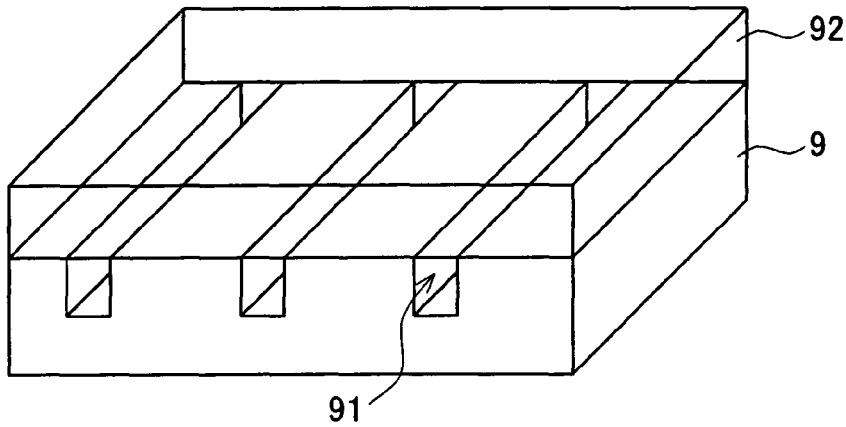
Figure 7C:
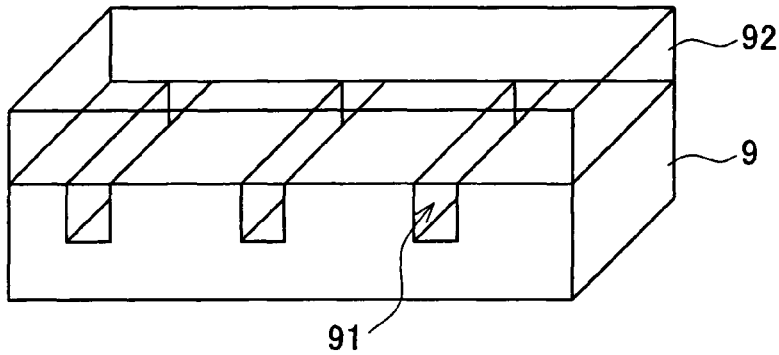

FIGS. 7(*a*) to 7(*c*) are views illustrating steps in the process for producing the manifold 6 according to the present embodiment.

To begin with, by mechanical fabricating method such as dicing, grooves 91 of 60 μm width and 60 μm depth are formed on a substrate 9 made of a glass material or the like (FIG. 7(*a*)).

The width of the groove is controlled by thickness of a blade used in dicing and the depth of the groove is controlled by an amount of the blade to cut into the substrate. Intervals of the grooves are designed to correspond to intervals of the liquid inlets 41 to which they are to be connected.

Next, a flat and ungrooved glass substrate 92 is attached to the grooved substrate 9 by using an epoxy-based adhesive agent (FIG. 7(*b*)).

Then, the adhered glass substrates 9 and 92 are cut into a predetermined length in an orthogonal direction with respect to a longitudinal direction of the grooves by dicing (FIG. 7(*c*)).

In this way, the manifold 6 according to the present embodiment can be produced.

As described above, it is possible to stably produce the inkjet head 1 according to the present embodiment by adopting the steps described above.

Moreover, the process according to the present embodiment for producing the inkjet head 1 is arranged such that the formation of the liquid flow path section 3 uses the resist (liquid flow path layer 34) to form the liquid flow path pattern. The resist is made of a material, which is easily deteriorated in quality by plasma directly applied thereon by a plasma-using depositing apparatus such as an apparatus for sputtering. For this reason, the formation of the under layer 35 for forming the upper flow path layer 33 is carried out by vapor deposition.

Moreover, in the vapor deposition, vapor-deposition particles fly highly linearly, which results in poor deposition at a stepped shape. Therefore, a specific example is arranged such that the vapor deposition is carried out with rotating the substrate tiled with respect to against vapor deposition source. This makes it possible to uniformly form the under layer even on the side surface of the resist pattern.

The lower flow path layer 32 and the upper flow path layer 33 are formed by plating. In the plating for forming the lower flow path layer 32 and upper flow path layer 33, internal stress of the Ni film formed by the plating can be controlled by controlling current density. By forming the Ni films with controlling the internal stress thereof, it is possible to take a balance between stress to be applied from the upper flow path layer 33 onto the ejection section 5 and stress to be applied from the lower flow path layer 32 onto the ejection section 5. By this, the ejection section 5 protruded from the edge portion of the substrate 2 is prevented from largely warping.

In the above-described liquid flow path layer 34 of the inkjet head 1 is formed to have a substantially rectangular cross section that is substantially perpendicular to the longitudinal direction of the liquid flow path section 3 (that is, the direction in which the liquid will flow) as illustrated in FIG. 5. The liquid flow path layer 34 is formed on the surface of the lower flow path layer 32 and the under layer 35 is formed by vapor deposition on the liquid flow path layer 34 and the lower flow path layer 32 (FIG. 5(*d*)).

Moreover, because the vapor deposition for the formation of the under layer 35 is such that the vapor particles fly highly linearly and thus deposition at a stepped shape is poor, the step of forming the under layer 35 is carried out with rotating the substrate 2 tilted with respect to the vapor deposition source.

As an alternative, the cross section of the liquid flow path layer 34 may have a different shape in order to facilitate the deposition of the under layer 34 to the liquid flow path layer 34.

Figure 23B:
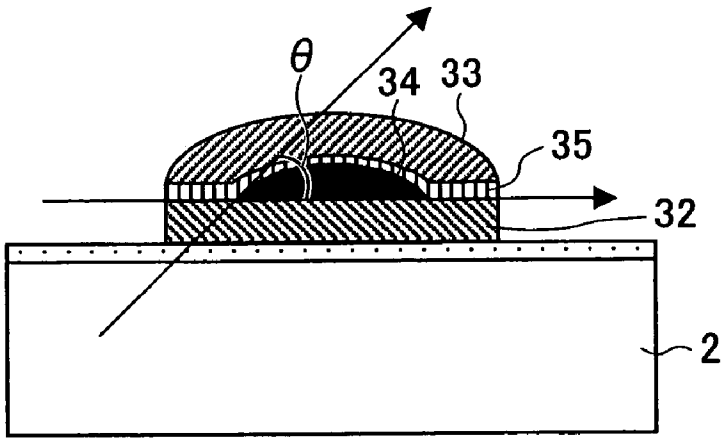
FIG. 23(*a*) is a view illustrating an example of another cross sectional shape regarding the liquid flow path section according to the present embodiment.
Figure 23A:
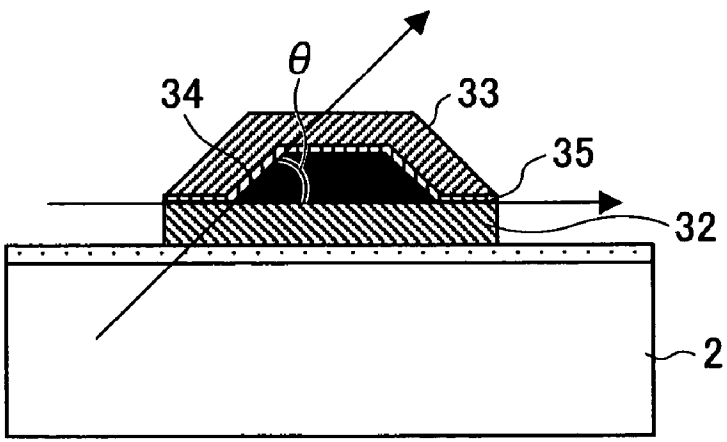
Figure 24D:
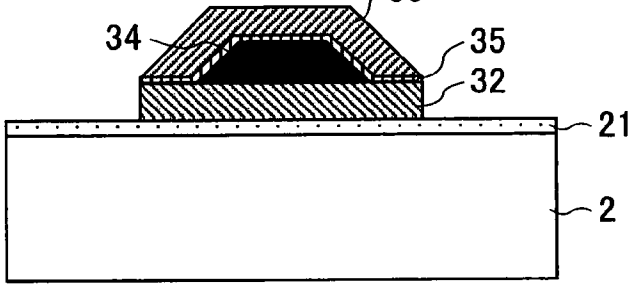
FIG. 24(*a*) is another method for producing an inkjet head according to the present embodiment, and is a cross sectional view taken on line A-A' of FIG. 1 at a step in the production of the inkjet head.
Figure 24E:
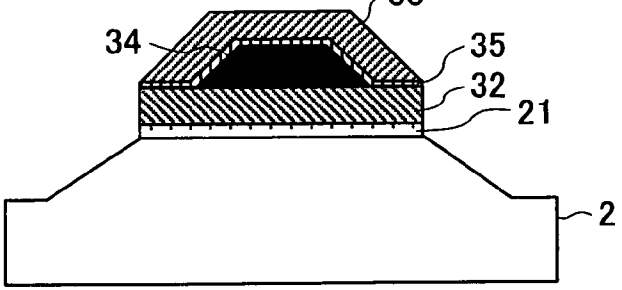
Figure 24A:
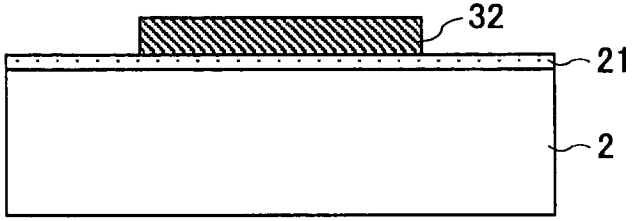
Figure 24B:
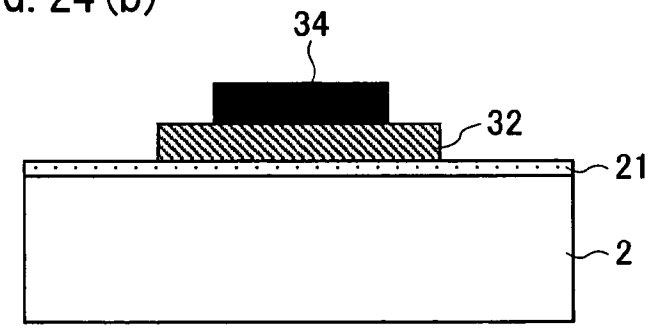
Figure 24C:
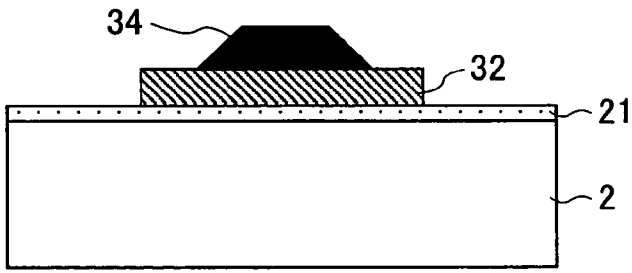

For example, as illustrated in FIG. 23(*a*), the cross section of the liquid flow path layer 34 may have a trapezoidal shape whose top part is shorter than its bottom part. This structure gives an exterior angle of greater than 90 degrees between the liquid flow path layer 34 and the lower flow path layer 32. This makes it possible to uniformly deposit the upper layer 35 onto (the side wall) of the liquid flow path layer 34 with ease.

That is, such measures as tilting the substrate 2 as described above becomes unnecessary in the step of depositing the under layer 35 (the step for forming the under layer 35 by vapor deposition (FIG. 5(*d*)).

With the configuration in which the liquid flow path layer 34 has the cross section in the trapezoidal shape as described above, it is possible to deposit the under layer 35 uniformly with respect to the liquid flow path layer 34 without tilting the substrate 2. Further, this configuration allows depositing the upper flow path layer 33 on the under layer 35 uniformly with respect to the liquid flow path layer 34. Accordingly, it is possible to stably form the shape of the liquid flow path formed with the lower flow path layer 32, the under layer 35, and the upper flow path layer 33.

Moreover, because it is possible to deposit the under layer 35 uniformly with respect to the liquid flow path layer 34 without such measures as tilting the substrate 2, it is possible to more firmly adhere (i) the upper flow path layer 33 formed on the under layer 35 and (ii) the liquid flow path layer 34.

As an alternative, the cross section of the liquid flow path layer 34 may be in a so-called "kamaboko"-like shape, or, in other words, a semi-cylindrical shape, that is, may have such a shape that has an upward curvature. The "upward" is a direction in which the liquid flow layer 34 is limited on the substrate 2.

The smaller an angle (taper angle) θ between the lower flow path layer 32 and the side portion of the liquid flow path layer 34, the easier the deposition of the under layer 35 to the side portion of the liquid flow path layer 34. However, the smaller the taper angle θ, the thinner the side portion of the liquid flow path layer 34, thereby making it more difficult to remove the liquid flow path layer 34.

On the other hand, it is necessary for an inkjet head 1 with a small taper angle θ therebetween that the liquid flow path layer 34 should have a large pattern width, in order to avoid difficulty in removing the liquid flow path layer 34 due to its thickness.

However, a pattern width of the liquid flow path layer 34 is not favorable for realizing an inkjet head 1 capable of performing finer printing.

That is, the removal of the liquid flow path layer 34 may be carried out by ultra washing, e.g., with acetone. The removal can be facilitated with a large cross sectional area and a shorter length of the flow path. On the other hand, a larger flow path is more preferable for the head of the inkjet to maintain desirable properties. In view of these, it is an option to have a large cross sectional area of the flow path for the sake of easy formation of the flow path and desirable head properties.

In order to have a large cross section of the flow path, it is preferable that the cross section have a shape squared as much as possible. With such a shape, the upper flow path layer would become too thin at the side portions to have a stable formation of the flow path.

For attaining stable formation of the flow path and easy removal of the filler member, the flow path may be provided with a taper at its side portions and a wide flow path width to compensate for the thickness to make up the cross section area. However, such a configuration would have a difficulty in assembling a plurality of inkjet heads 1 on the substrates.

Considering the deposition property of the under layer 35 with respect to the liquid flow path layer 34, the difficulty in removing the liquid flow path layer 34, and finer printing that is required in the inkjet head 1, it is preferable for the taper angle θ that $90° > \theta > 5°$.

A liquid flow path layer 34 (e.g., as illustrated in FIGS. 23(*a*) and 23(*b*)) with such a taper angle θ is formed via the following steps illustrated in FIGS. 24(*a*) to 24(*e*). FIGS. 24(*a*) to 24(*e*) illustrate another method for producing the inkjet head 1 according to the present embodiment, and are cross sectional views taken along line A-A' in FIG. 1, illustrating the steps of the process for producing the inkjet head.

To begin with, the lower flow path layer 32 is formed on the insulating layer 21 formed on the substrate 2 (FIG. 24(*a*)). This step is identical with the steps illustrated in FIGS. 5(*a*) to 5(*b*), and its explanation is omitted here. Even though it is not mentioned in the explanation referring FIG. 5, an under layer (not illustrated) may be formed between the lower flow path layer 32 and the insulating layer 21. This under layer is formed for better sealing between the under flow path layer 32 and the insulating layer 21. A Ta film and a lamination film of Ta and Ni are suitable as the under layer. Furthermore, it is preferable that the under layer be in a range of from 50 to 200 nm in thickness.

Next, the liquid flow path layer 34 is formed on the lower flow path layer 32 (FIG. 24(*b*)). This step is identical with the step illustrated in FIG. 5(*c*), and its explanation is omitted here.

After forming the liquid flow path apparatus 34 on the lower flow path layer 32 as described above, the liquid flow path layer 34 is heated to a temperature of 120° C. or higher. In a specific example, the heating is carried out by using an oven of 150° C. for 90 minutes. By heating the liquid flow path layer 34 as such, an upper portion of the resist pattern is shrunken to give the liquid flow path layer 34 a trapezoidal cross section (FIG. 24(*c*)).

Even though FIGS. 24(*a*) to 24(*e*) illustrate the arrangement in which the liquid flow path layer 34 is shaped to have a trapezoidal cross section, the cross section of the liquid flow path layer 34 is not limited to such a trapezoidal shape. For example, the cross section of the liquid flow path layer 34 may be in a semi-cylindrical shape having an upward curvature by appropriately controlling the film thickness and pattern width of the resist and heating temperature.

The heating of the liquid flow path layer 34 as such results in hardening of the resist of which the liquid flow path layer 34 is made. This causes the liquid flow path layer 34 less soluble for the dissolvent, thereby making it difficult to remove the liquid flow path layer 34 in the later step of removing the liquid flow path layer 34.

In order to prevent this hardening, it is preferable to radiate ultraviolet rays onto the liquid flow path layer 34 before heating the liquid flow path layer 34 at 120° C. or higher. This causes the resist constituting the liquid flow path layer 34 to be more soluble, thereby making it easier to remove the liquid flow path layer 34.

Moreover, the ultraviolet ray radiation softens the liquid flow path layer 34, thereby making it possible to attain a greater change in the shape thermally.

Thus, the ultraviolet ray radiation to the liquid flow path apparatus 34 makes it possible to remove the liquid flow path layer 34 with ease even if the liquid flow path layer 34 is heated at a temperature of 120° C. or higher.

Moreover, by heating of the liquid flow path layer 34 at the temperature of 120° C. or higher, it is possible to attain such a cross sectional shape of the liquid flow path layer 34 that 90° C.>θ>5° C., where θ is an interior angle of the liquid flow path layer 34, that is, between the surface of the substrate 2 and the side surface of the liquid flow path layer 34. Such cross sectional shape is exemplified by the trapezoidal shape or the semi-cylindrical shape having the upper curvature described above.

That is, this arrangement gives the liquid flow path section 34 such a cross section that the liquid flow path layer 3 has an exterior angle greater than 90 degrees between the side wall of the liquid flow path layer 34 and the lower flow path layer 32.

Because the exterior angle of greater than 90° is attained between the under layer 35 and the side wall of the liquid flow path layer 34 at their junction, it is possible to attain better deposition property with respect to a stepped-shape in depositing of the under layer 35, and further of the upper flow path layer 33 with respect to the side wall of the liquid flow path layer 34.

Therefore, in the inkjet head 1, it is possible to uniformly deposit the upper flow path layer 33 on the liquid flow path layer 34 with ease.

With this, the inkjet head 1 can stably have a uniform shape of the flow path produced by the liquid flow path layer 34 thus formed.

As described above, the under layer 35 for the upper flow path layer 33 is deposited all over the insulating layer 21, the lower flow path layer 32, and the liquid flow path layer 34 formed on the substrate 2. Then, the area in which the upper flow path layer 33 is to be formed is restricted by a resist pattern patterned by the photolithography. Then, the upper flow path formation layer, whose main component is Ni, is formed on the under layer 35. After that, the plating film and the seed layer in the area where they are not needed are removed by wet etching (FIG. 24(*d*)). The under layer 34 is preferably a lamination film of Ti and Ni, as described above. But, a single Ni film can be used as the under layer 34.

The process illustrated in FIG. 24(*d*) is identical with the process illustrated in FIGS. 5(*d*) and 5(*e*). Thus, its explanation is omitted here.

Next, the substrate 2 is immersed in an etching liquid in order to etch the substrate 2 such that its upper cross section has a trapezoidal shape along line A-A'. Then, the resist (liquid flow path layer 34) is removed by using a resist stripping solution (FIG. 24(*e*)).

The steps in the process illustrated in FIG. 24(*e*) are identical with the process illustrated in FIGS. 5(*f*) and 5(*g*), so their explanation is omitted here.

As an alternative, the removal of the resist (liquid flow path layer 34 may be performed by ultrasonic washing with acetone.

Moreover, the order of the steps is not limited to the ones described above referring FIGS. 5(*a*) to 5(*g*), 6(*a*) to 6(*e*), 22(*a*) to 22(*g*), and 24(*a*) to 24(*e*), in which the liquid flow path layer 34 is removed after the etching of the substrate 2.

For example, the etching of the substrate 2 may be carried out with a KOH aqueous solution after the removal of the liquid flow path layer 34.

Moreover, the junctions between the upper flow path layer 33 and the lower flow path layer 32 of the inkjet head 1 are positioned above both edge portions of the lower flow path layer 32 along the cross section of the liquid flow path section 3, for example, as illustrated in FIG. 23(*a*). That is, the upper flow path layer 33 is junctioned with the upper surfaces of both the edge portions of the lower flow path layer 32 with the under layer 35 therebetween. Here, the cross section of the liquid flow path section 3 is a plane substantially perpendicular with the direction in which the liquid will flow.

In structures in which a plurality of layers are laminated and junctioned respectively, as that of the liquid flow path section 3 of the inkjet head 1 according to the present embodiment, a smaller junction area would cause the following problem. Specifically, if the junction between the upper flow path layer 33 and the lower flow path layer 32 is small in area, junction intensity therebetween becomes weak, whereby (i) the etching process after the formation of the lower flow path layer 32 and the upper flow path layer 33 becomes less reliable, and the inkjet head 1 becomes less reliable in charging and/or ejecting the ink.

Therefore, in order to avoid such a problem, it is preferable in the inkjet head 1 according to the present embodiment that the upper flow path layer 33 and the lower flow path layer 32 be junctioned with each other in another fashion in order to have a greater junction intensity therebetween, and to attain better reliability of the inkjet head 1 with the greater junction intensity between the upper flow path layer 33 and the lower flow path layer 32.

Figure 25A:
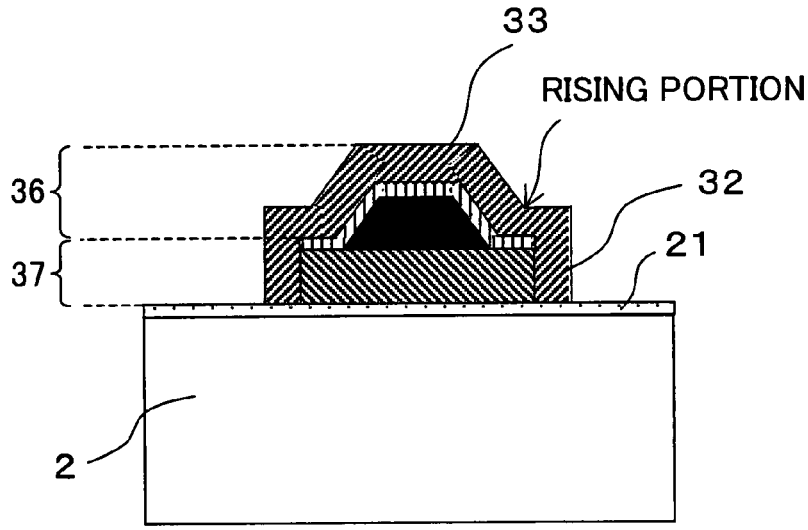
FIG. 25(*a*) illustrates an embodiment of the present invention, and is a view illustrating another cross sectional shape regarding a liquid flow path section according the present embodiment.
Figure 25B:
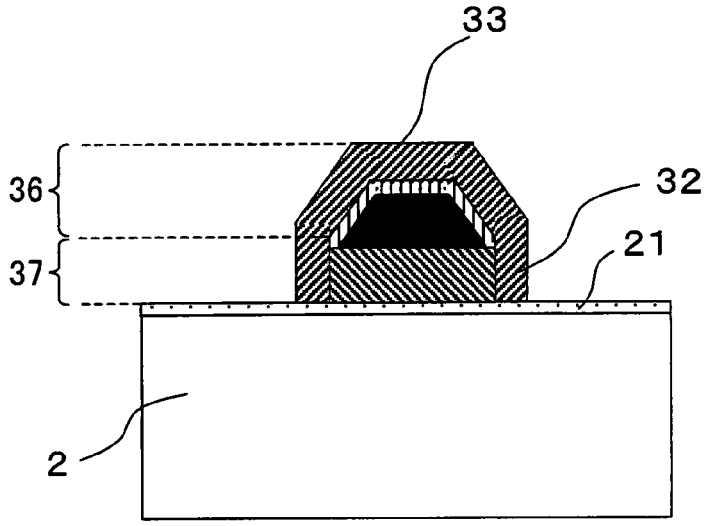
Figure 25C:
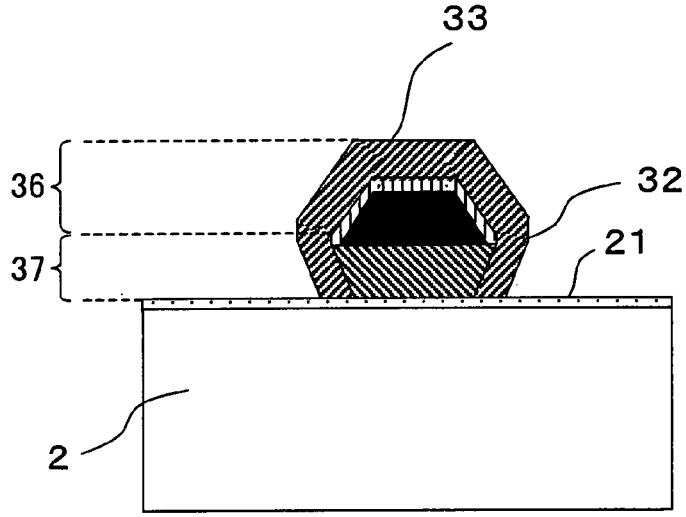

More specifically, on the side portion of the outer shell 31, the upper flow path layer 33 may cover and junction with the side surface of the lower flow path layer 32, for example, as illustrated in FIG. 25(*a*).

In the following, the junctions between the upper flow path layer 33 and the lower flow path layer 32 in the inkjet head 1 illustrated in FIGS. 23(*a*) and 25(*a*) are compared, mentioning their specific sizes by way of example.

By way of example, it is assumed that the inkjet head 1 of the junction configuration as illustrated in FIG. 23(*a*) is such that the size of the junction (width of one junction) between the upper flow path layer 33 and the lower flow path layer 32 is 1.5 μm in the width direction in the vicinity of the outlet 51. Moreover, the height of the lower flow path layer 32 is 2.0 μm. In this case, the junction between the upper flow path layer 33 and the lower path layer 32 is 1.5 μm in size in the inkjet head 1 illustrated in FIG. 23(*a*).

One the other hand, if the junction configuration between the upper flow path layer 33 and the lower flow path layer 32 is changed from that in FIG. 23(*a*) to that in FIG. 25(*a*), it is possible to dramatically increase the size of the junction between the lower flow path layer 32 and upper flow path layer 33 to 3.5 μm.

Specifically, in the later junction configuration, the upper flow path layer 33 can junction with the side surfaces of the lower flow path layer 32 and the upper surface of both the edge portions of the lower flow path layer 32. As a result, the junction between the upper flow path layer 33 and the lower flow path layer 32 is totally 3.5 μm in width on one side. Moreover, the upper flow path layer 33 can junction with the insulating layer 21 on the substrate 2.

Therefore, by adopting the junction configuration between the upper flow path layer 33 and the lower flow path layer 32 in FIG. 25(*a*) in replacement of that of FIG. 23(*a*), it is possible to have a larger junction therebetween, thereby attaining a greater junction intensity therebetween.

Moreover, in the inkjet head 1 illustrated in FIG. 25(*a*), the formation of the under layer 35 is carried out without tilting the substrate with respect to the vapor deposition source. Thus, no under layer 35 is formed on the side surface of the lower flow path layer 32. That is, in the inkjet head 1 illustrated in FIG. 25(*a*), the junction between the upper flow path layer 33 and the lower flow path layer 32 does not contribute to the formation of the cross sectional shape of the liquid flow path layer 34. Thus, it is not necessary to form the under layer 35, and the upper flow path layer 33 and the lower flow path layer 32 can be directly junctioned with each other on the side.

For example, if the upper flow path layer 33 and the lower flow path layer 32 are formed by plating in the inkjet head 1 illustrated in FIG. 25(*a*), the plating film of the upper flow path layer 33 is directed junctioned with the side surface of the lower flow path layer 32. The side surface of the lower flow path layer 32 is an exposed plating film.

Moreover, if the upper flow path layer 33 and the lower flow path layer 32 are directly junctioned with each other as described above, the etching process in the later step would not have such problems as junction intensity reduction caused by the etching solution going into a boundary between the lamination layers. Thus, the direct junction between the upper flow path layer 33 and the lower flow path layer 32 allows maintaining high junction intensity therebetween.

In the inkjet head 1 according to this present embodiment as described above, a peeling stress of the upper portion of the upper flow path layer 33 acts as a shearing stress to the portion thereof attached to the top surface of the lower flow path layer 32. This gives the upper flow path layer 33 much better resistance against peeling-off.

The inkjet head 1 can have a large junction area of the upper flow path layer 33. For example, in case where the upper flow path layer 33 is junctioned with the top surface of the lower flow path layer 32 thereby to form the outer shell 31, the junction area of the upper flow path layer 33 is restricted by the flow path width of the flow path of the upper flow path layer 33. However, in case where the upper flow path layer 33 is junctioned with the side surface of the lower flow path layer 32 thereby to form the outer shell 31, the junction area of the upper flow path layer 33 is expanded to include the area corresponding to the side surface of the lower flow path layer 32 and the area that is in contact with the substrate 2.

The side surface portion of the lower flow path layer 32 dose not contribute to the cross section of the flow path through which the liquid will flow. Further, the side surface portion of the lower flow path layer 32 is not covered with the under layer 35. By this, the lower flow path layer 32 can directly junction with the upper flow path layer 33.

Therefore, the inkjet head 1 can have a large junction area between the upper flow path layer 33 and the lower flow path layer 32, thereby attaining higher junction intensity.

Incidentally, the outer shell 31 of the liquid flow path section 3 as illustrated in FIG. 25(*a*) is in a so-called "victory stand"-like shape. In the upper flow path layer 33 portion of the cross section, it is put that the side portion substantially perpendicular with the upper surface of the substrate 2 is referred as a wall section 37, and the portion covering the wall section 37 is referred to as a roof portion 36. In the cross section of the liquid flow path section 3 as illustrated in FIG. 25(*a*), the roof portion 36 is tilted outwardly from the top surface to the lower portion (toward the substrate 2), and has a portion that is substantially parallel with the top surface of the substrate 2. That is, on an outer periphery of the outer shell 31 with respect to the cross section, there is a portion having an angle greater than 180 degrees (in FIG. 25(*a*), this portion is the rising portion of the roof portion 36).

In case where the cross section of the liquid flow path section 3 is in a "victory stand"-like shape, the ink flow out of the outlet 51 would be easily retained at the rising portion of the roof portion 36 when the ink is ejected by voltage application. Further, capillary phenomenon causes the retained ink to move from the outlet 51 to the substrate 2, thereby increasing an amount of the ink accumulated on the substrate 2 overall.

An increase in the amount of the accumulated ink on the substrate 2 would cause (i) extraordinary ejection of the ink that the ink is ejected not from the outlet 51, (ii) ink leakage, or (iii) other problem.

In view of this, as illustrated in FIG. 25(*b*), the cross section of the liquid flow path section 3 may be such that the lower flow path layer 32 and the liquid flow path layer 34 are substantially identical with each other in size along the width direction, thereby not to have such a rising portion as illustrated in FIG. 25(*a*). That is, as illustrated in FIG. 25(*b*), the cross section of the liquid flow path section 3 is shape to have a roof portion 36 tilted outwardly from the top surface to the lower portion, and a wall portion 37 substantially perpendicular with the top surface of the substrate 2.

As an alternative, the cross section of the liquid flow path section 3 may be as illustrated in FIG. 25(*c*), in other words, may be modified from that of the cross section of FIG. 25(*b*) by tilting the wall portion 37 inwardly such that an interior angles of the outer periphery of the cross section of the liquid flow path section 3, that is, of the outer shell 31 is greater than 90° but smaller than 180°.

Compared with the liquid flow path section 3 having the cross section configuration as illustrated in FIG. 25(*b*), the liquid flow path section 3 having the cross section configuration as illustrated in FIG. 25(*c*) is more advantageous in that it allows more stable ejection of the ink.

More specifically, the cross section configuration of the liquid flow path section 3 as illustrated in FIG. 25(*b*) is such that the junction between the upper flow path layer 33 and the insulating layer 21 is substantially perpendicular with the insulating layer 21, and an edge portion thereat is sharp. This makes it difficult to concentrate an electric field at a center of the outlet 51 stably (i.e., this causes concentration of the electric field at the edge portion) when the ink is ejected by voltage application. Therefore, ejection direction will be unstable.

On the other hand, in the configuration as illustrated in FIG. 25(*c*) where the wall portion 37 of the upper flow path layer 33 is slightly tilted inwardly and the angles at the edge portions of the outer periphery of the cross section configuration of the liquid flow path section 3, that is, the interior angles of the outer shell 31 are all greater than 90° but smaller than 180°, the cross section configuration can have a close-to-circle shape. This makes it possible to concentrate the electric field at the center portion of the outlet 51.

Therefore, the liquid flow path section 3 with the cross section configuration illustrated in FIG. 25(*c*) is more advantageous than the one illustrated in FIG. 25(*b*) in that it can stabilize the ejection direction of the ink ejection.

Moreover, the liquid flow path section 3 with the cross section configuration illustrated in FIG. 25(*b*) or 25(*c*) can have dramatic improvement in resistance against peeling at the junction between the upper flow path layer 33 and the lower flow path layer 32. That is, the resistance against peeling can be improved with a configuration in which the junction between the upper flow path layer 33 and the lower flow path layer 32 is substantially parallel with a lamination direction of the liquid flow path section 3.

Realized as follows is a method for preparing the cross section configuration of any upper flow path layer 33 of the liquid flow path sections 3 illustrated in FIGS. 25(*a*) to 25(*c*), especially, of the liquid flow path section 3 in FIG. 25(*c*).

For example, in case where the upper flow path layer 33 is formed by selective plating, the plating is carried out with a resist patterned by photolithography. Generally, a positive type resist is used as a resist material thereof.

Moreover, it is possible to shape a side surface of the resist into a taper shape by proximity exposure and post baking treatment. By using the shape of the resist, the wall portion 37 of the upper flow path layer 33 is formed with internal inclination. Thereby, the cross section configuration of the liquid flow path section 3 as illustrated in FIG. 25(*c*) can be attained.

The cross section of the liquid flow path section 3 illustrated in FIG. 25(*c*) is such that the side surface of the lower flow path layer 32 is tilted away from the surface of the substrate 2 outwardly sideways. That is, the lower flow path layer 32 has a bottom part that is smaller than its top part. Thus, the side surface of the lower flow path layer 32 is tilted inwardly with respect to the cross section of the liquid flow path section 3.

This allows the peeling stress on the side surface of the lower flow path layer 32 to contribute to attaining higher junction intensity at the upper-surface junction of the lower flow path layer 32. This improves the overall junction intensity.

Figures 26, 27:
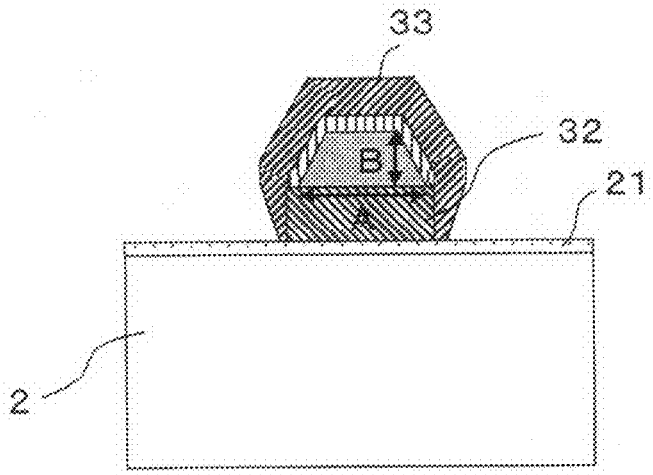
FIG. 26 illustrates an example of the cross sectional view regarding the liquid flow path section according to the present embodiment, and illustrates a relationship between a flow path width and a flow path height of the liquid flow path layer.
FIG. 27 illustrates relationship between the flow path width and flow path height of the liquid flow path layer in the inkjet head according to the present embodiment.

Here, the cross section configuration of the liquid flow path layer 34 is explained referring to FIG. 26. FIG. 26 is a view illustrating an example of the cross section configuration of the liquid flow path section 3 according to the present embodiment. FIG. 26 shows a relationship between the flow path width and flow path height of the flow path layer 34. FIG. 27 is a table illustrating the size of the liquid flow path layer 34 in the width direction and height direction along the cross section configuration. In FIG. 27, it is assumed that the liquid flow path layer 34 is 2 μm in size (thickness) along the height direction and is varied in size along the width direction.

More specifically, it is put in FIG. 27 that the flow path width A is a length of that portion of the cross section of the lower flow path layer 32 which is in contact with the lower flow path layer 32, and the flow path height B is a distance between the lower flow path layer 32 and the upper flow path layer 33. A ratio of the flow path width over the flow path height is B/A. FIG. 27 shows the flow path widths A, flow path heights B, their ratios B/A, and whether the flow path configuration changed or not between before and after the removal of the filler (liquid flow path layer 34) inside of the liquid flow path, which is a part of the process for producing the head.

From FIG. 27, it is understood that the smaller ratio B/A of the flow path width over height made the flow path configuration less stable. This is because the ratio B/A smaller than 0.05 did not give enough wall surface intensity of the upper flow path layer 33 and thus resulted in lower flow path heights when the flow path was hollowed by removing the filler from the inside of the flow path. That is, it is preferable in this arrangement that the cross section configuration of the liquid flow path section 3 be formed to have the ratio B/A of greater than 0.05 by the steps for producing the shape of the flow path.

With the configuration having the ratio B/A of smaller than 0.05, it is the shape of the flow path will not be deformed in the production process such as etching, manifold attachment, etc., in charging and ejecting the ink, and in other occasions. That is, there will no change in flow path resistance inside the flow path, whereby the ink can be ejected in a constant ejection amount always.

Figure 8:
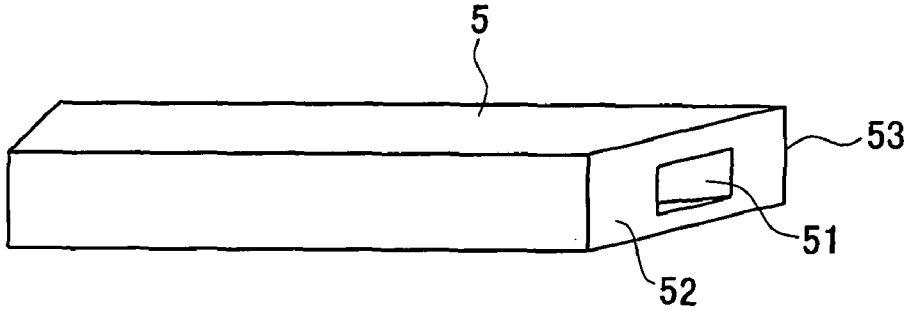
FIG. 8 is a perspective view schematically illustrating a structure of another shape of an ejection section of an inkjet head according to the present embodiment, FIG. 8 illustrating the vicinity of a tip portion of the ejection section.

Moreover, each inkjet head 1 discussed above is such that the edge surface (surface from which the liquid is to be ejected) on which the outlet 51 of the ejection section 5 is formed is substantially perpendicular with respect to the longitudinal direction of the liquid flow path section 3. However, the edge surface of the ejection section 5 is not limited to this shape, may be, for example, in a shape as illustrated in FIG. 8. FIG. 8 is a perspective view schematically illustrating a structure of the ejection section 5 in the vicinity of the tip of edge surface, illustrating another structure of the ejection section 5 provided to the inkjet head 1 according to the present embodiment.

More specifically, as illustrated in FIG. 8, a edge surface 52 of the ejection section 5 is tilted with respect to the liquid low path section 3, and one side surface of the outer shell 31 is protruded farther in length than the other beyond the edge section 22, where the side surfaces of the outer shell 31 are substantially perpendicular to the surface on which the substrate 2 is formed, and crosses the edge section 22 of the substrate 2 at the right angle.

In this configuration, the outer shell 31 has a sharp tip portion 53, which is protruded. The sharp tip portion 53 is the portion of that side surface of the outer shell 32 which is protruded farther than the other. With this configuration, the electric field formed in the vicinity of the outlet 51 is concentrated at the sharp tip portion 53. The liquid droplets are ejected from a tip portion of the sharp tip portion 53 to the print target object.

With this, a position from which the liquid starts to fly can be fixed to the sharp tip portion 53 of the outer shell 31 stably. Therefore, with the configuration in which the ejection section 5 has the edge surface 52 as illustrated in FIG. 8, it is possible to hit the print target object with the liquid droplets more accurately thereby to improve resolution of the printing pattern.

Figure 9:
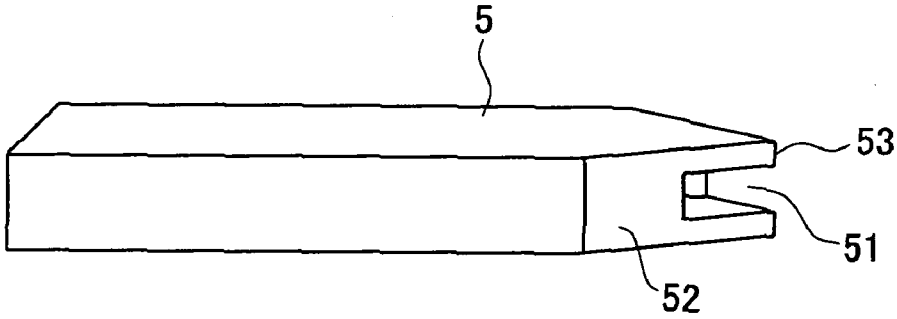
FIG. 9 is a perspective view schematically illustrating a structure of another shape of an ejection section of an inkjet head according to the present embodiment, FIG. 9 illustrating the vicinity of a tip portion of the ejection section.

Moreover, the outlet 51 of the ejection section 5 of the inkjet head 1 may have an edge surface (from which the liquid is ejected) in a shape illustrated in FIG. 9. FIG. 9 is a perspective view schematically illustrating a structure of the ejection section 5 in the vicinity of the tip of edge surface, illustrating still another structure of the ejection section 5 provided to the inkjet head 1 according to the present embodiment.

As illustrated in FIG. 9, the ejection section 5 may have such a shape that side surfaces of the outer shell 31 are tilted toward the center portion of the edge surface along the longitudinal direction, whereby a sharp tip portion 53 is formed at the substantially center of the edge of the ejection section 5.

With such an edge surface shape of the ejection section 5 as illustrated in FIG. 9, the electric field in the vicinity of the tip of the outlet 51 is concentrated at a tip of the sharp tip portion 53, so that the liquid droplets fly from the tip of the sharp tip portion 53 to the print target object. Thus, the configuration in which the ejection section 5 has the edge surface shape as illustrated in FIG. 9 also fixes the position from which the liquid starts to fly. With this, it is possible to hit the print target object with the liquid droplets more accurately thereby to improve resolution of the printing pattern.

In the following, methods for producing the inkjet heads 1 respectively with the different edge surface shapes are described.

Figure 10A:
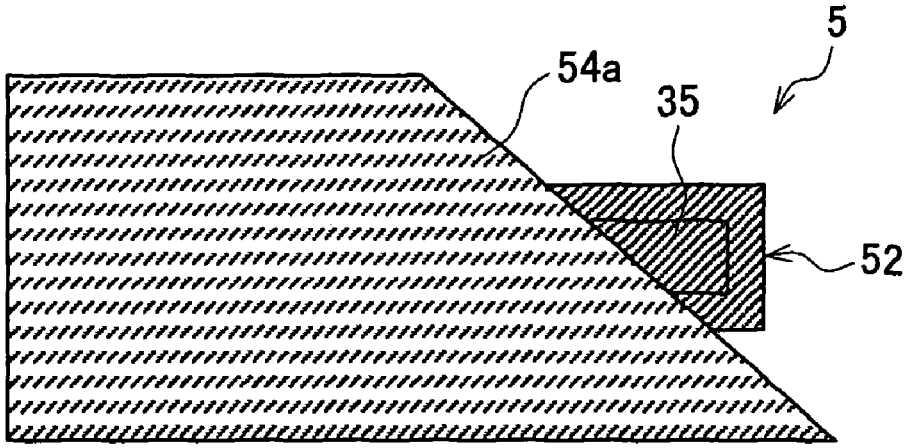
FIG. 10(*a*) is a plane view of a liquid flow path section and explains a resist patterning process in a step for fabricating the ejection section of the inkjet head according to the present embodiment.
Figure 10B:
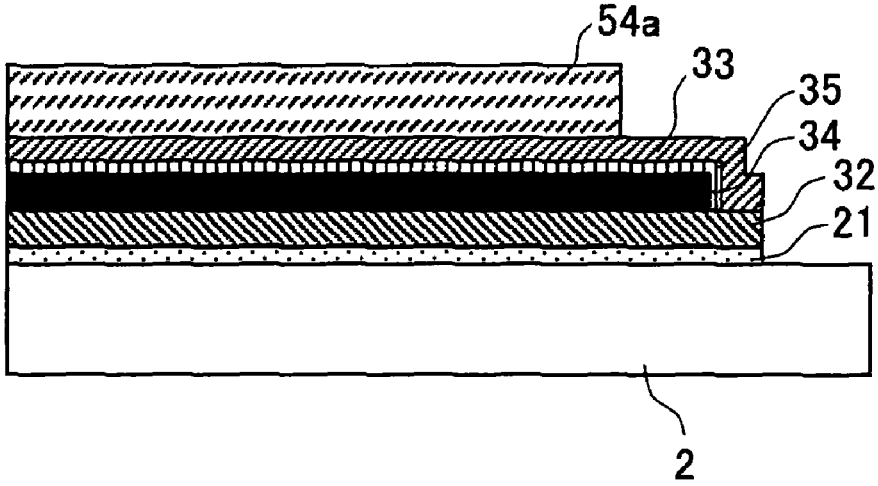

Firstly, the method for producing the inkjet head 1 having the edge shape as illustrated in FIG. 8 is explained referring to FIGS. 10(*a*), 10(*b*), 11(*a*), and 11(*b*). FIGS. 10(*a*) and 10(*b*) are views for explaining how to carry out resist patterning in the step of producing the vicinity of the outlet 51 of the inkjet head 1 according to the present embodiment. FIG. 10(*a*) is a plane view of the ejection section 5, whereas FIG. 10(*b*) is a cross sectional view of the ejection section 5 along its longitudinal direction.

Figure 11:
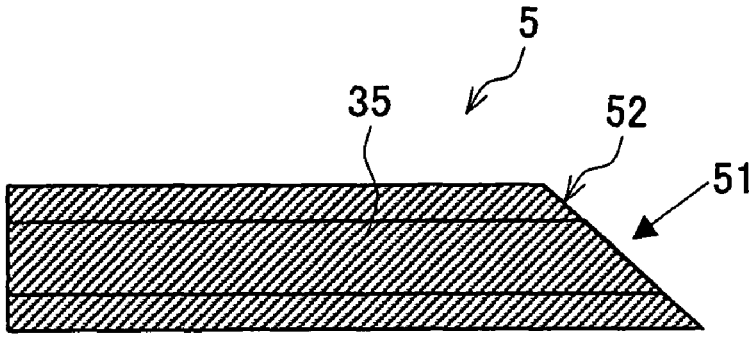
FIG. 11(*a*) is a plane view of the ejection section of the inkjet head according to the present embodiment, illustrating the ejection section after the etching process and resist removal in the fabrication of the inkjet head.
Figure 11:
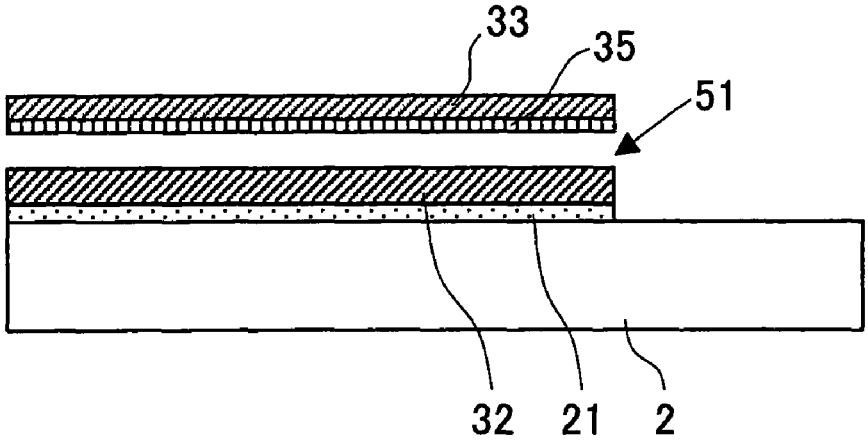

FIGS. 11(*a*) and 11(*b*) are views illustrating the ejection section 5 of the inkjet head 1 according to the present embodiment after the etching process and removal of the resist in the step of producing the ejection section 5. FIG. 11(*a*) is a plane view illustrating the ejection section 5, whereas FIG. 11(*b*) is a cross section view of the ejection section 5 along its longitudinal direction.

To being with, the liquid flow path section 3 is formed on the substrate 2 via the steps illustrated in FIGS. 5(*a*) to 5(*e*).

Next, the edge surface 52 of the ejection section 5 of the liquid flow path section 3 is etched. This etching is carried out as follows.

As illustrated in the views with the title "RESIST PATTERNING" (FIGS. 10(*a*) and 10(*b*), a resist pattern 54*a* tilted with respect to the longitudinal direction of the ejection section 5 is formed.

As illustrated in FIG. 10(*a*), the plane view of the ejection section 5, the resist pattern 54*a* thus formed has side surfaces, which are substantially parallel with the side surfaces of the ejection section 5 and one of which is protruded farther than the other beyond the substrate 2. The resist pattern 54*a* has a shape tilted with respect to the longitudinal direction of the liquid flow path section 3. Moreover, as illustrated in FIG. 10(*b*), the resist pattern 54*a* is formed on the upper flow path layer 33.

Then, the edge surface 52 of the liquid flow path section 3 is etched according to the resist pattern 54*a*. This etching may be carried out by dry-etching, wet-etching, etc.

The etching with the resist pattern 54*a* shapes the edge surface 52 of the ejection section 5 into a shape tilted with respect to the longitudinal direction of the ejection section 5, as illustrated in the view titled as "AFTER ETCHING AND RESIST REMOVAL" (FIG. 11(*a*)). After this step, steps similar to those illustrated in FIGS. 5(*f*), 5(*g*), and 6(*a*) to 6(*e*) are carried out. FIG. 11(*b*) illustrates a cross section of the ejection section 5 of the thus formed liquid flow path section 3 along its longitudinal direction.

Figure 12A:
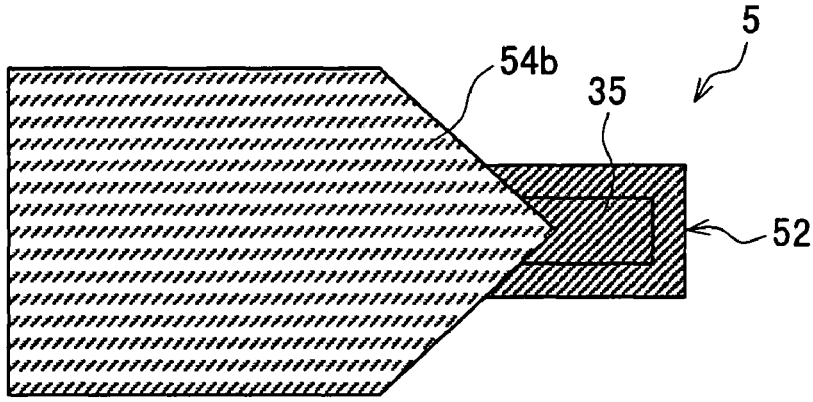
FIG. 12(*a*) is a plane view of a liquid flow path section and explains the resist patterning process in the fabrication of the ejection section of the inkjet head according to the present embodiment.
Figure 12B:
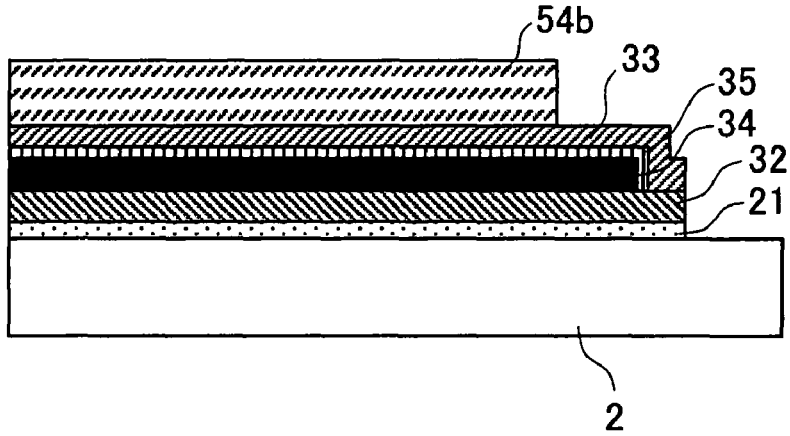

Next, the method for producing the inkjet head 1 having the edge surface shape as illustrated in FIG. 9 is explained referring to FIGS. 12(*a*), 12(*b*), 13(*a*), and 13(*b*). FIG. 12(*a*) is a plane surface view of the ejection section 5 and FIG. 12(*b*) is a cross section view taken along the longitudinal direction of the ejection section 5.

Figure 13A:
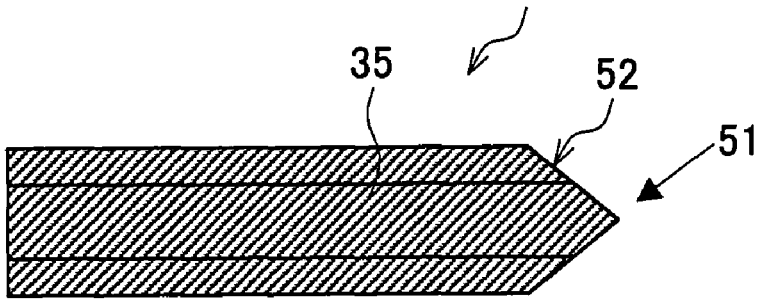
FIG. 13(*a*) is a plane view of the ejection section of the inkjet head according to the present embodiment, and illustrates the ejection section after the etching process and resist removal in the fabrication of the ejection section.
Figure 13B:
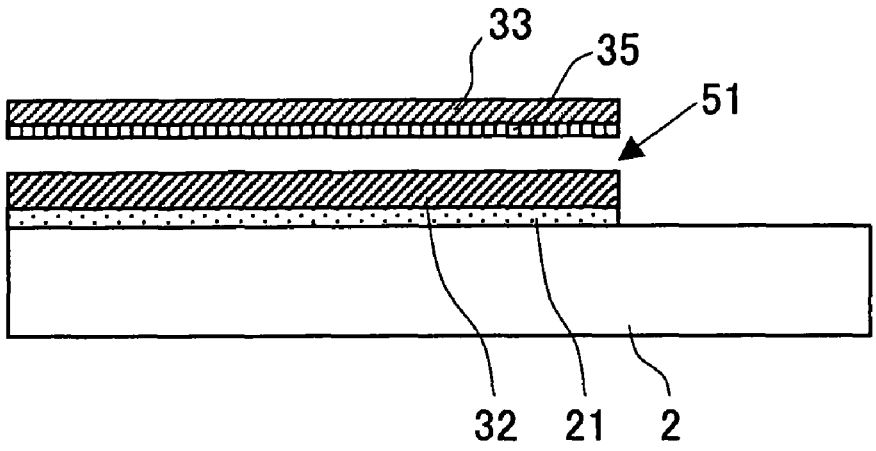

Moreover, FIGS. 13(*a*) and 13(*b*) are views illustrating the ejection section 5 of the inkjet head 1 after the etching process and resist removal in the production process. FIG. 13(*a*) is a plane view illustrating the ejection section 5 and FIG. 13(*b*) is a cross sectional view taken along the longitudinal direction of the ejection section 5.

Firstly, the liquid flow path section 3 is formed on the substrate 2 via the steps illustrated in FIGS. 5(*a*) to 5(*e*), in a similar manner to the production method of the inkjet head 1 having the tip surface configuration as illustrated in FIG. 8.

Next, the edge portion 52 of the ejection section 5 of the liquid flow path section 3 is etched away in a similar manner to the production method of the inkjet head 1 having the tip surface configuration as illustrated in FIG. 8, except that the resist pattern 54*b* used in the etching is different from that resist pattern 54*a* used in the production method of the inkjet head 1 having the tip surface configuration as illustrated in FIG. 8.

More specifically, as illustrated in FIG. 12(*a*), the tip surface configuration in FIG. 9 has such a shape that both sides surface of the resist pattern 54*b* are longitudinally tilted toward a substantially center portion of the ejection section 5 in the plane view of the ejection section 5. The resist pattern 54*b* is formed on the upper flow path layer 33 as illustrated in FIG. 12(*b*).

After that, the edge surface 52 of the liquid flow path section 3 is etched away according to the resist pattern 54*b*. This etching is carried out in the same manner as in the production method of the inkjet head 1 having the edge surface configuration as illustrated in FIG. 8.

The etching according to the resist pattern 54*b* gives the edge surface 52 of the ejection section 5 such a shape that both the sides surfaces of the ejection section 5 are longitudinally tilted toward the center portion and the tip of the edge surface is pointed out as illustrated in the view titled as "AFTER ETCHING AND RESIST REMOVAL" (FIG. 13(*b*)). After this step, the same steps as illustrated in FIGS. 5(*f*), 5(*g*), and 6(*a*) to 6(*e*) are carried out. FIG. 13(*b*) illustrates a cross section of the ejection section 5 of the liquid flow path section 3 along its longitudinal direction.

As described above, an inkjet head according to the present embodiment is such that the liquid flow path section 3 is formed on the surface of the substrate 2. Therefore, the shape of the edge surface 52 of the ejection section 5 can be easily changed by changing the resist pattern for use in the etching.

This makes it possible to produce an inkjet head 1 with ejection property designed with more freedom to be suitable for its usage.

Moreover, the inkjet head 1 according to the present embodiment is configured such that the lower flow path layer 32 and the upper flow path layer 33 are so located that the edge surface of the ejection section is substantially perpendicular to the upper surface of the substrate 2. That is, the upper flow path layer 33 and the lower flow path layer 32 are so formed that the outlet 51 formed on the edge surface of the outlet section 5 forms a surface substantially perpendicular to the upper surface of the substrate 2.

However, the edge surface configuration of the ejection section 5 is not limited to this. The edge surface configuration of the ejection section 5 may be such that at least that part of the upper flow path layer and the lower flow path layer, in which an edge surface of the ejection section 5 (i.e., outlet 51), is protruded beyond the edge portion 22 of the substrate 2 farther in the longitudinal direction of the ejection section 5 than a rest of the upper flow path layer and the lower flow path layer, the part including the edge surface (the outlet 51) of the ejection section 5.

The longitudinal direction of the ejection section 5 is the flowing direction in which the liquid flows from the supplying section 4 to the ejection section 5 (i.e., the longitudinal direction of the liquid flow path section 3). The height direction is a direction vertical to that surface of the substrate 2 on which the liquid flow path section 3 is formed.

Figure 28:
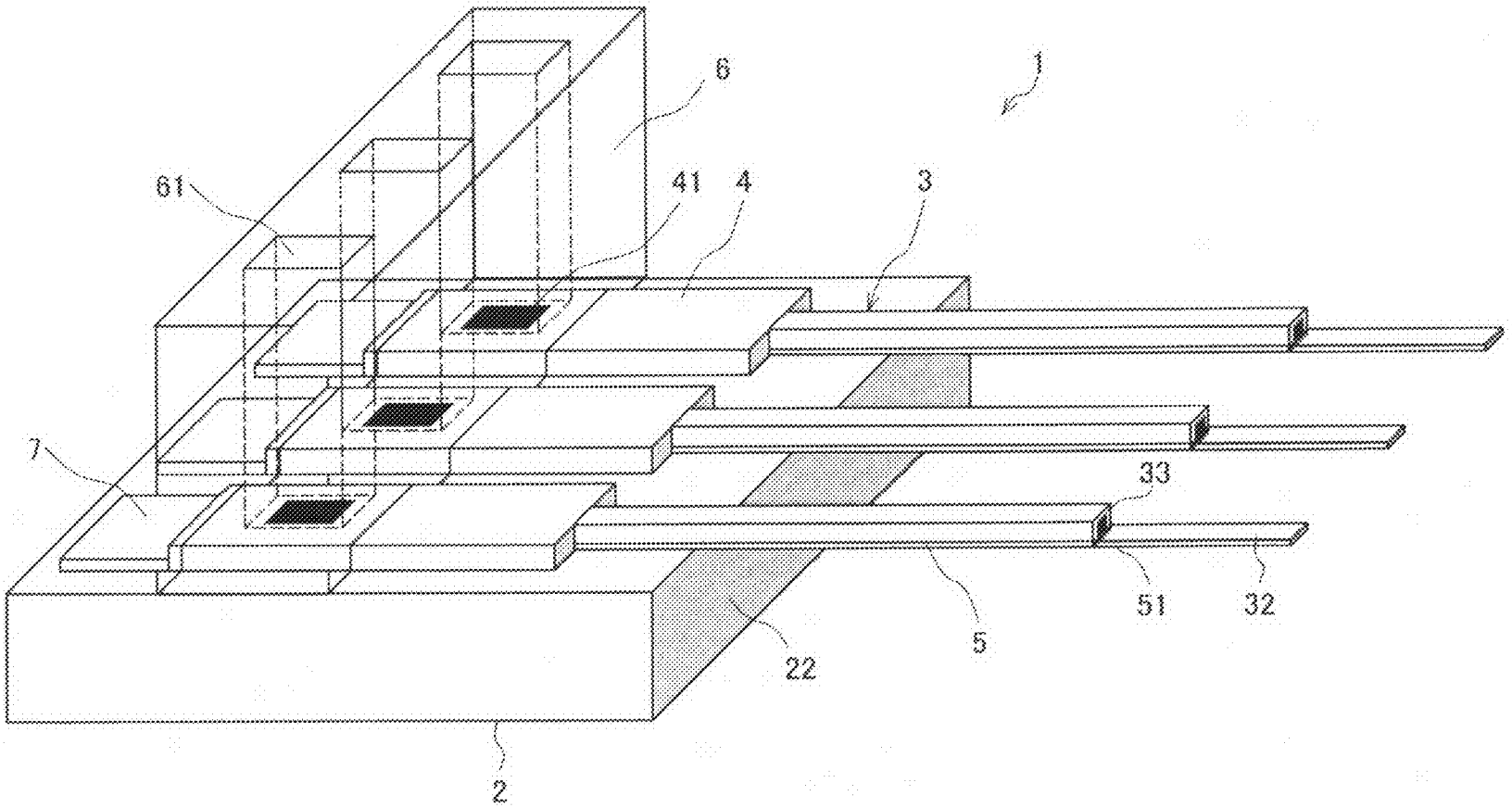
FIG. 28 is a perspective view schematically illustrating another inkjet head according to the present embodiment.

More specifically, an inkjet head 2 according to an present embodiment is, for example as illustrated in FIG. 28, may be configured such that an upper flow path layer 33 is shorter than a lower flow path layer 32 in a longitudinal direction of an ejection section 5 (in other words, the lower flow path layer 32 is protruded from the upper flow path layer 33). FIG. 28 is a perspective view schematically illustrating a structure of another example of an inkjet head according to another present embodiment of the present invention.

The inkjet head 1 illustrated in FIG. 28 is described explaining what is different from the inkjet head in FIG. 1, without repeating the explanations on what is sections identical with the inkjet head in FIG. 1.

Moreover, the inkjet head 1 illustrated in FIG. 28 is configured such that the ejection section 5 has a lamination structure including the lower flow path layer 32 and the upper flow path layer 33. The lower flow path layer 32 is protruded from an edge surface of the substrate 2 farther than the upper flow path layer 33 in the longitudinal direction of the ejection section 5. In a specific example of this present embodiment, the lower flow path layer 32 is 2 μm in thickness and 7 μm in width, and protruded by 20 μm in length (protrusion length) from the upper flow path layer 33.

The configuration of the inkjet head 1 as illustrated in FIG. 28 allows an electric field in the vicinity of the outlet 51 to be efficiently concentrated at a tip of the lower flow path layer 32. With this, voltage application will cause a greater attraction force to pull the liquid toward the tip.

On the other hand, in terms of the other parameters such as its opening diameter, flow path resistance, etc., which contributes the ejection of the liquid, the outlet 51 is almost identical with the configuration in which the lower flow path layer 32 and the upper flow path layer 33 are positioned identically in the direction substantially perpendicular to the upper surface of the substrate 2 (i.e., the surface of the outlet 51 is substantially perpendicular to the upper surface of the substrate 2). This allows using a lower voltage to apply.

Figure 29:
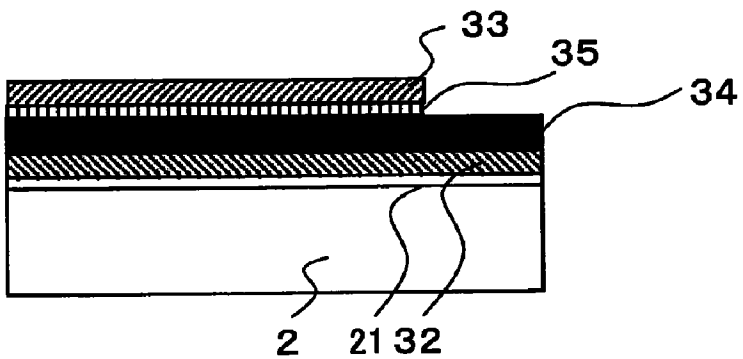
FIG. 29(*a*) illustrates a method for producing the inkjet head according to the present embodiment, and a cross sectional view taken on longitudinal direction of a liquid flow path section at a step in the production of the inkjet head.
Figure 29:
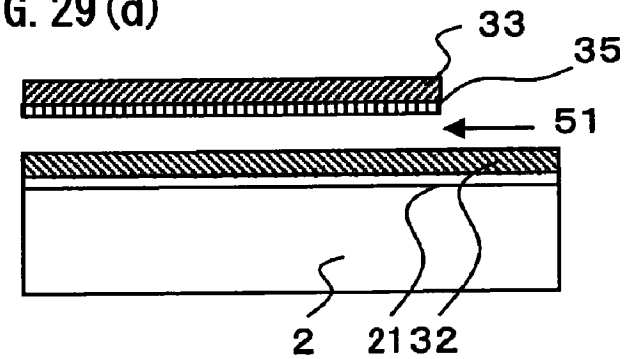
Figure 29:
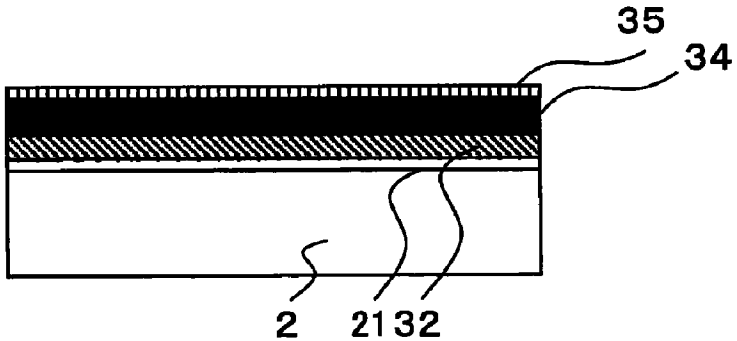
Figure 29:
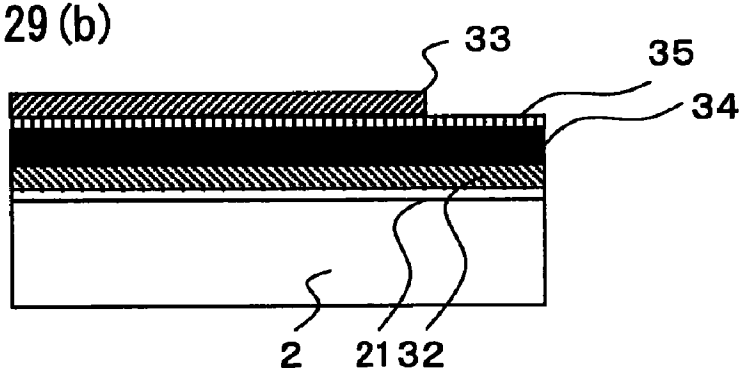

Here, a method for producing an inkjet head 1 having the ejection section 5 having the edge surface configuration as illustrated in FIG. 28 is described, referring to FIGS. 29(*a*) and 29(*d*). FIG. 29 illustrate the method for producing the inkjet head 1 of the another example according to this present embodiment, and are cross sectional views taken along the longitudinal direction of the liquid flow path section 3. The inkjet head 1 of FIGS. 29(*a*) and 29(*d*) is described here to explain what is different from the above-mentioned one, without repeating the explanations on what is identical with the above-mentioned one.

Here, via the steps illustrated in FIGS. 5(*a*) to 5(*d*), an insulating layer 21, the lower flow path layer 32, the liquid flow path layer 34, and an under layer 35 have been formed (FIG. 29(*a*)). Next, plating is carried out to form, on the under layer 35, the upper flow path layer 33, whose main component is Ni. The upper flow path layer 33 is formed in a 2 μm thickness in a region restricted by a resist pattern patterned by photolithography.

That is, the liquid flow path layer 34 is covered with the under layer 35 in forming the upper flow path layer 33, but the resist pattern is formed on that part of the under layer 35 which covers the end portion of the liquid flow path layer 34. This prevents the upper flow path layer 33 from being formed on the end portion by plating. The plating is carried out to form the upper flow path layer 33 with the resist pattern covering part of the under layer 35 (i.e., end portion of the liquid flow path layer 35) (FIG. 29(*b*)).

After that, the resist pattern is peeled off. Then, the under layer 35 is removed by dry-etching using Ar, or RIE using $CF_4$ gas, thereby to expose the liquid flow path layer 34 (FIG. 29(*c*)).

Next, wet-etching is carried out with a solution that can dissolve the liquid flow path layer 34, thereby to form the outlet 51 (FIG. 29(*d*)).

In the process illustrated in FIG. 29, the formation of the outlet 51 does not require a resist layer like one explained for the step of FIG. 6(*a*). This results in reduction in raw materials, and omission of the step of forming the resist layer and removing the resist layer. Thereby, it is possible to provide an inkjet head 1 at a lower cost.

The shape and the protrusion length of the ejection section 5 can be determined as appropriate depending on the shape of the lower flow path layer 32, and positions of the upper flow path layer 33 and the lower flow path layer 32. By changing the pattern for the formation of the lower flow path layer 32 and the upper flow path layer 33, it is possible to arbitrarily change the shape and protrusion length of the ejection section 5 according to usage.

Furthermore, the shape of the ejection section 5 is determined by the patterning of the lower flow path layer 32. This makes it possible to control the shape of the ejection section 5 more easily than in the process of FIG. 6 in which wet-etching is carried out to form the ejection section 5. Furthermore, this configuration reduces re-deposition of the etching material in the vicinity of the outlet 51, compared with the configuration in which dry-etching or RIE using the $CF_4$ gas. This reduces roughness of that surface of the outlet 51 which faces the medium. This prevents the ejection section 5 from being produced unstable in shape. Thereby, it is possible to prevent unstable formation of tailor cone. As a result, it is possible to provide an inkjet head 1 of high reliability, which is capable of hitting the target with the fine droplets highly accurately.

An inject head 1 according to the present invention may be configured such that another section is protruded, instead of the lower flow path layer 32 being protruded beyond the edge portion 22 of the substrate 2 farther than the upper layer flow path layer 33 as in the configuration descried above. For example, the upper flow path layer 33 may be protruded farther than the lower flow path layer 32, contrarily. In this case, the liquid flow path layer 34 is formed on the lower flow path layer 32 such that the liquid flow path layer 34 is protruded from the substrate 2 farther than the lower flow path layer 32 (i.e., with a greater protrusion amount).

That is, at least part of that portion of the upper flow path layer 33 and the lower flow path layer 32, in which the outlet 51 is formed, is protruded beyond the edge portion 22 of the substrate 2 farther than a rest of the upper flow path layer 33 and the lower flow path layer 32.

Moreover, the cross sectional configuration of the liquid flow path section 3 according to the present embodiment is such that, as described above, the supplying section 4 is greater than the ejection section 5 in width and the cross sectional area of the liquid flow path section 3 is smaller in the ejection section 5 than in the supplying section 4.

However, the cross sectional configuration of the liquid flow path section 3 is not limited to this, and may be in any shape, as illustrated in FIGS. 14 to 17, which are plane views illustrating other shapes of the liquid flow path section 3 according to the present embodiment.

That is, the liquid flow path section 3 may have such a plane shape that the plane shape of the ejection section 5 gets narrower from the edge section 22 of the substrate 2 to the tip (outlet 51) in a step-wise manner. The liquid flow path of the ejection section 5 of this shape is also shaped as such because the outer shell constituting the liquid flow path has a constant thickness.

Figure 14:
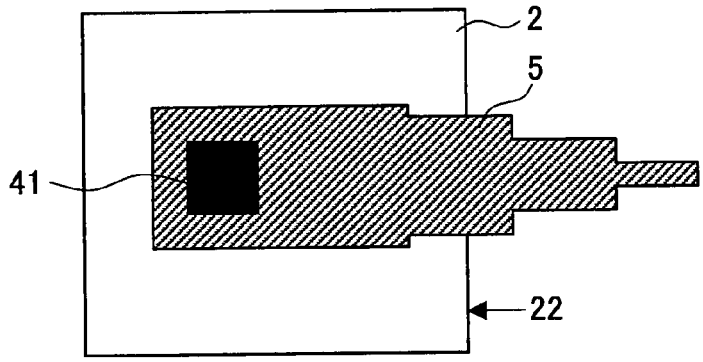
FIG. 14 is a plane view illustrating another shape regarding the liquid flow path according the present embodiment.

In case where the ejection section 5 is shaped as illustrated in FIG. 14, it is possible to reduce the flow path resistance of the liquid flow path without scarifying the fine shape of the outlet 51.

Therefore, the shape of the liquid flow path section 3 makes it possible to flow a highly viscous liquid to the outlet 51. Because of this, the inkjet head 1 having the liquid flow path section 3 of the shape as illustrated in FIG. 14 can stably eject even a highly viscous liquid to the printing target object.

Figure 15:
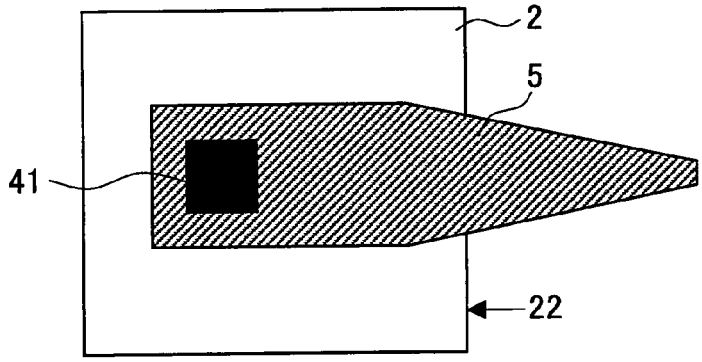
FIG. 15 is a plane view illustrating still another shape regarding the liquid flow path according the present embodiment.

Moreover, the liquid flow path section 3 may be in such a shape that, as illustrated in FIG. 15, the ejection section 5 is protruded from the edge portion 22 of the substrate 2 in such a manner that the ejection section 5 gets narrower, i.e., linearly tapered toward the outlet 51.

The liquid flow path section 3 of this shape can reduce the flow path resistance of the ejection section 5, like the liquid flow path section 3 of the shape illustrated in FIG. 14. Thus, the liquid flow path section 3 of this shape makes it possible to flow a highly viscous liquid to the outlet 51. Moreover, the flow path of the ejection section 5 is continuously changed in the liquid flow path section 3. This reduces the risk of turbulence in the flow path. Therefore, the inkjet head 1 having the liquid flow path section 3 of the shape illustrated in FIG. 15 can eject even highly viscous liquid to the printing target object more stably.

Figure 16:
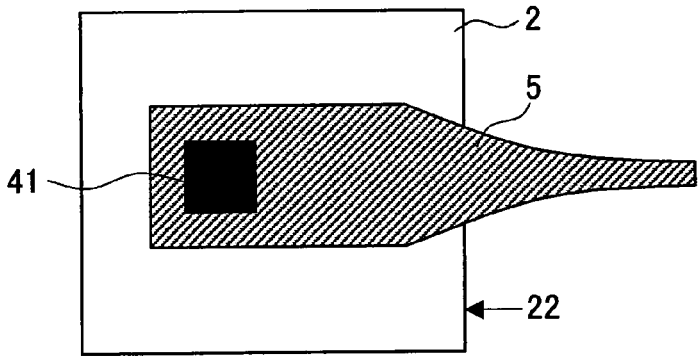
FIG. 16 is a plane view illustrating yet another shape regarding the liquid flow path according the present embodiment.

Moreover, the liquid flow path section 3 may be in such a shape that, as illustrated in FIG. 16, the ejection section 5 is protruded from the edge portion 22 of the substrate 2 in such a manner that the ejection section 5 gets narrower toward the outlet 51 with inward curvatures.

The liquid flow path section 3 of this shape can reduce the flow path resistance, like the liquid flow path section 3 of the shape illustrated in FIG. 15. Further, the liquid flow path section 3 of this shape can prevent turbulence in the liquid path. Furthermore, if the liquid flow path section 3 is internally shaped as illustrated 16, it is possible to reduce a gravitational mass applied on the ejection section 5, compared with the linearly tapered shape (in case the liquid flow path section 3 is shaped as illustrated in FIG. 15).

Therefore, the liquid flow path section 3 of the shape as illustrated in FIG. 16 can reduce vibration or deformation of the ejection section 5, which is caused by impact. That is, the liquid flow path section 3 of the shape is more durable against stress caused by scanning of the head or other causes.

Figure 17:
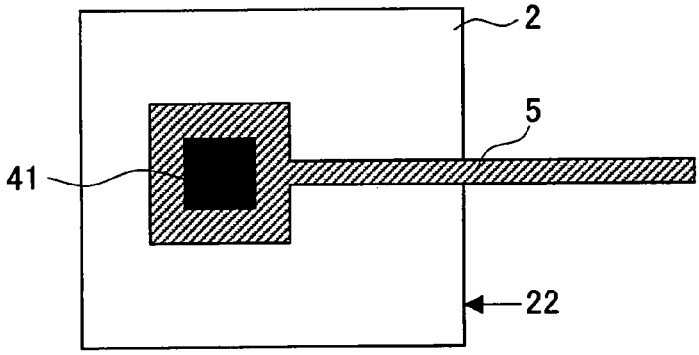
FIG. 17 is a plane view illustrating yet still another shape regarding the liquid flow path according the present embodiment.
Figure 18:
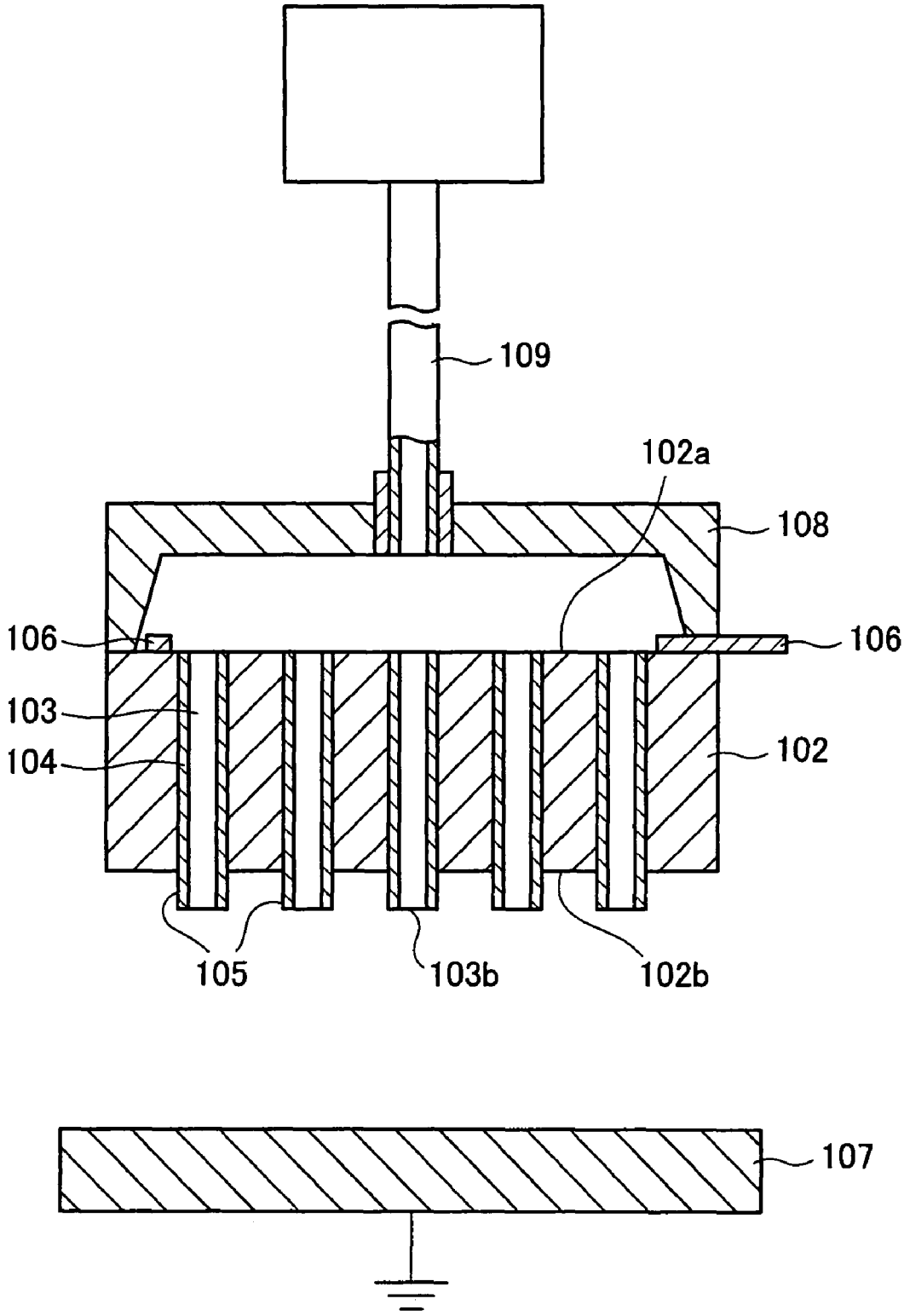
FIG. 18 illustrates a conventional art and is a cross sectional view illustrating various parts of a structure of a fine pattern forming device.
Figure 19A:
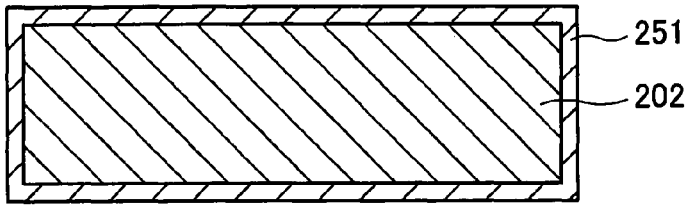
FIG. 19(*a*) illustrates a conventional art, and is a cross sectional view illustrating a method for producing fine nozzles.
Figure 19B:
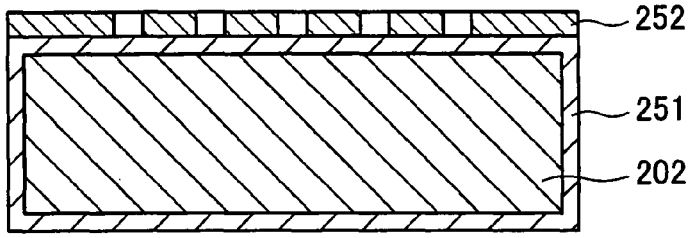
Figure 19C:
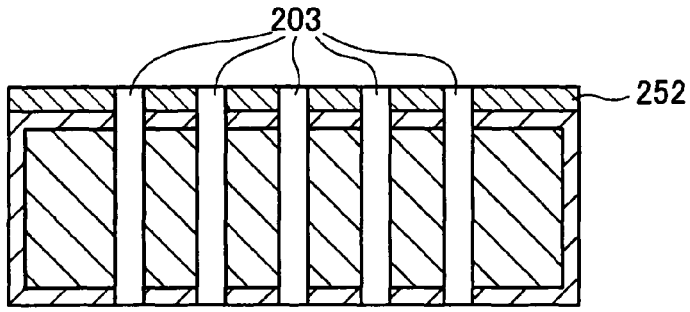
Figure 19D:
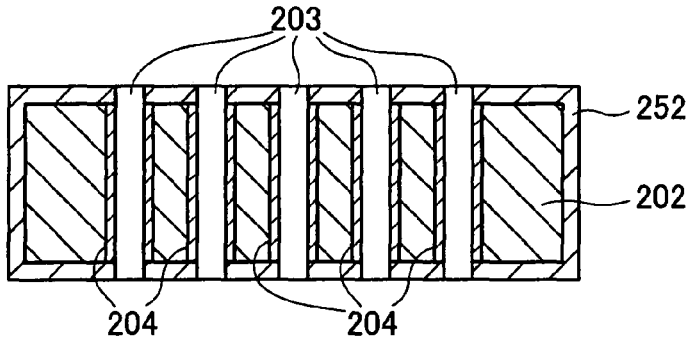
Figure 19E:
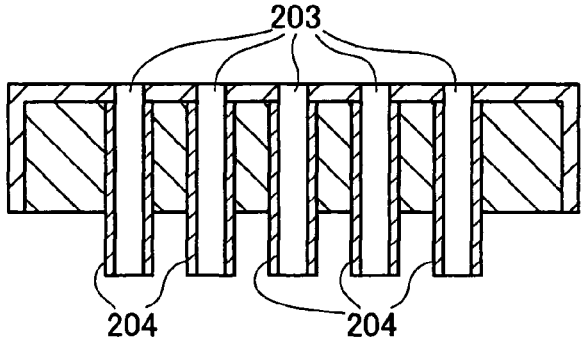
Figure 20:
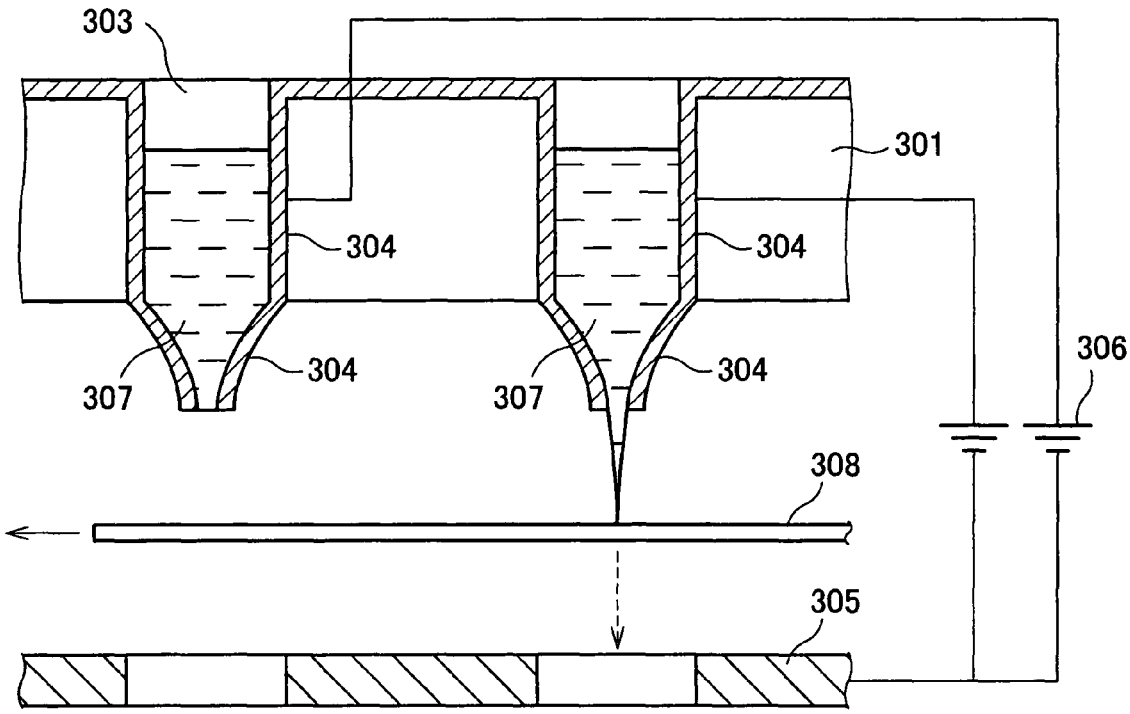
FIG. 20 illustrates a conventional art and is a cross sectional view schematically illustrating a structure of nozzles provided to an inkjet printer.
Figure 21:
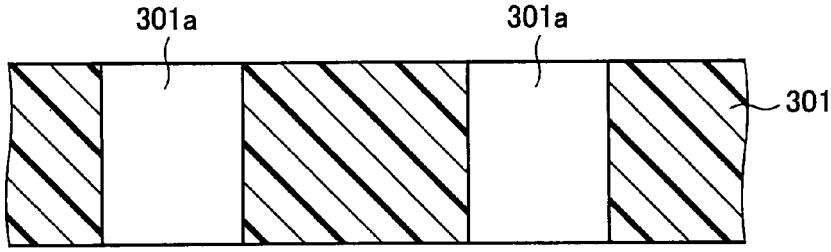
FIG. 21(*a*) illustrates the conventional art and is a view illustrating a method for producing the nozzle.
Figure 21:
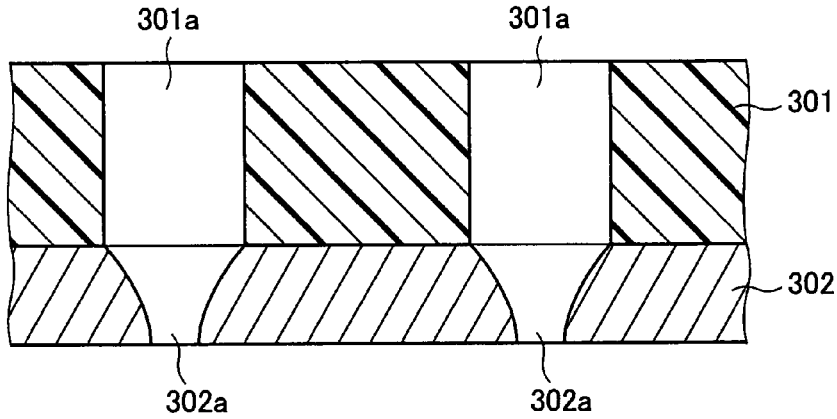
Figure 21:
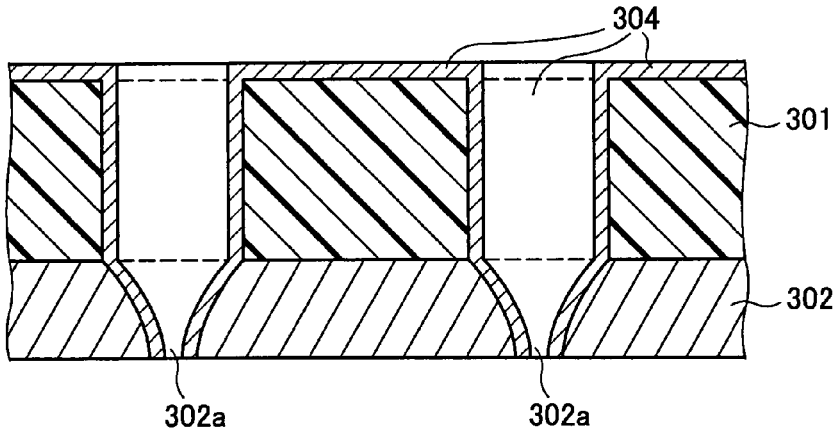
Figure 21:
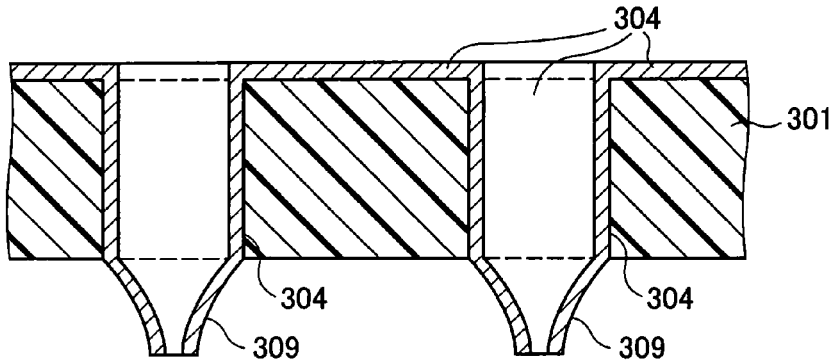

Moreover, the liquid flow path section 3 may be in such a shape that the supplying section 4 on the substrate 2 is shaped in the substantially same size as the ejection section 5 while the supplying section 4 has a wide width in the vicinity of the liquid inlet 41, as illustrated in FIG. 17.

The liquid flow path section 3 of the shape as illustrated in FIG. 17 can have a large flow path resistance to the flow of the liquid to the outlet 51. With this configuration, ejection of a liquid low in viscosity can be performed more stably in ejection amount, reducing excess supply of the liquid to the outlet 51.

As an alternative, the increase in the flow path resistance can be attained by meandering the liquid flow path of the liquid flow path section 3, apart from the configuration in which the liquid flow path section 3 is shaped as illustrated in FIG. 17.

The shapes of the liquid flow path section 3 illustrated in FIGS. 14 to 17 can be attained by changing the design of the above-described "steps of the production method of the inkjet head" in terms of the shape of the liquid flow path layer 34 and, accordingly, the shape of the outer shell 31 of the liquid flow path section 3. Therefore, it is possible to attain a most suitable liquid flow path very easily.

As described above, the inkjet head 1 according to the present embodiment is arranged such that the liquid flow path section 3 is formed by using the resist pattern. Thus, it is possible to quite easily form the liquid flow path section 3 in a difference shape as illustrated in FIGS. 14 to 17. Therefore, the inkjet head 1 according to the present embodiment allows easy designing of the liquid flow path according to desired ejection property.

Moreover, the ejection section 5 of the liquid flow path section 3 according to the present embodiment is protruded by 100 μm from the edge portion of the upper surface of the substrate 2. However, the present invention is not limited to this.

How much the ejection section 5 is protruded can be designed considering, stability of the liquid ejection, structural stability of the ejection section 5, and how much voltage is to be supplied for the concentration of the electric field in the vicinity of the outlet 51.

The liquid flow path section 3 according to the present embodiment is configured such that at least part of the ejection section 5 is protruded from the edge portion of the upper surface of the substrate 2. Especially, if the ejection section 5 is not necessarily protruded from the edge portion of the upper surface of the substrate 2, the outer shell to constitute the liquid flow path section 3 can be formed without forming the lower flow path layer 32, such that the liquid flow path layer 34 is concealed with the upper flow path layer 33 and the substrate 2.

Moreover, the inkjet head 1 according to the present embodiment can solve the problems associated with Patent Literatures discussed above as conventional arts.

That is, each of the nozzles of the inkjet heads in the configuration described in Patent Literature 3 is formed with a continuous plating film. Thus, the ejection signal for controlling the ejection of the liquid from the nozzle outlet is applied to all the nozzles at the same time. Thus, this configuration cannot apply the ejection signal on a particular nozzle to eject the liquid to the printing target object.

Moreover, the common electrode is provided in the common ink room and the ejection signal in phase synchronous is applied on all the nozzles in the configurations described in Patent Literatures 1 and 2. Thus, the configurations of Patent Literatures 1 and 2 cannot apply the ejection signal on a particular nozzle to eject the liquid to the printing target object, like the configuration of Patent Literature 3.

On the other hand, the inkjet head 1 according to the present embodiment is configured such that the liquid supplying holes 61 of the manifold are provided respectively to the liquid flow path sections 3, and the liquid supplying holes 61 are connected with the common liquid room at one end and with the corresponding supplying sections 4 of the liquid flow path sections 3 at the other ends. This configuration prevents cross talk. Thus, it is possible to apply the ejection signal on a particular liquid flow path section 3 to eject the liquid to the printing target object.

Moreover, the flow path of the liquid penetrates the substrate and the layer of a material highly resistive against etching means for the substrate is formed on the internal surface of the liquid flow path penetrating the substrate. Then, the ejection side of the substrate is etched to remove part of the substrate thereby to protrude the outlet of the liquid from the substrate.

The configurations as described in Patent Literatures 1 to 3 require the steps of forming the penetrating holes in the substrate, and of forming, on the internal wall of each penetrating hole, the layer that constitutes the liquid flow path.

A fine flow path is necessary for ejecting fine liquid droplets from the outlet. However, the fabrication of such a fine flow path becomes more difficult for a deeper hole. Further, the formation of a flow path inside a fine and deep hole becomes more difficult.

Thus, the formation of fine penetrating holes through the substrate requires the substrate to be thin to some extent. On this account, the etching of the substrate cannot protrude the outlet so much.

That is, the etching of the substrate cannot attain a protrusion amount of the outlet more than the pre-etching thickness of the substrate. Especially in case of the formation of the fine flow path in which the substrate cannot have a thick thickness, it is not possible to have a sufficient distance from the common ink room to the tip of the outlet. Thus, even if electrodes are independently provided to the respective nozzles of the inkjet head in any one of the configurations of Patent Literatures 1 to 3, it is difficult to eject the liquid from a particular nozzle due to the cross-talk of the ejection signal between adjacent nozzles via the common ink room.

However, for efficient concentration of the electric field at the tip of the outlet, it is preferable that the outlet be protruded. However, the protrusion amount of the outlet in the configurations described in Patent Literatures 1 to 3 is limited by the thickness of the substrate, and cannot be freely designed.

On the other hand, the inkjet head 1 according to the present embodiment is such that the liquid flow path section 3 is formed on the substrate and thus how much the ejection section 5 is protruded can be adjusted by etching the substrate 2 as described above. In the inkjet head 1 according to the present embodiment, it is possible to freely design the protrusion amount of the ejection section 3 of the liquid flow path section 3 as appropriate.

Moreover, the inkjet head 1 according to the present embodiment may be arranged as follows.

The inkjet head 1 may include at least one liquid flow path section 3, each of which is formed from an outer shell including a lower flow path layer 32 and an upper flow path layer 33 formed on a substrate 2, wherein the liquid flow path section 3 has an ejection section 5 in the vicinity of one end thereof, and a liquid inlet 41 in the vicinity of the other end, the ejection section 5 having an outlet 51 for liquid ejection and being protruded from an edge surface of the substrate at least partially.

In this configuration of the inkjet head 1, the liquid flow path section 3 is formed on the surface of the substrate 2 and the ejection section 5 having the outlet 51 at its end is protruded from the edge surface of the substrate 2. This allows efficient concentration of the electric field at the outlet 51, thereby allowing use of a lower voltage to apply for the ejection utilizing the electrostatic attraction.

Moreover, because this reduces a potential gradient between the inkjet head 1 and the printing medium, transport of the liquid in a large amount hardly occurs. This improves ejection stability. Moreover, the shape of the liquid flow path section 3 and the protrusion amount of the ejection section 5 can be changed easily by changing the pattern formed on the substrate 2 by the photolithography. This attains much greater degree of freedom in the structure of the inkjet head 1, and makes it very easy to attain an optimum structure 2 of the inkjet head 1 for a desired ejection property.

Furthermore, the inkjet head 1 may be configured such that the liquid flow path section 3 includes (i) an ejection section having an outlet 51 and (ii) a supplying section 4 having a liquid inlet 41, wherein the ejection section 5 has a flow path that is smaller in cross sectional area than that of the supplying section 4.

With this configuration of the inkjet head 1, the flow path of the supplying section 4 has a greater cross sectional area than that of the ejection section 5. This attains such supply of the liquid for ejection that has a greater flexibility to cope with an increase and decreases in the ejection amount, especially, with the increase in the ejection amount according to the printing pattern. Thereby, a shortage in the supply of the liquid to be ejected is prevented.

Moreover, the inkjet head 1 is preferably configured such that the ejection section 5 gets smaller in cross sectional area toward the outlet 51.

With this configuration of the inkjet head 1 in which the ejection section 5 gets smaller in cross sectional area toward the outlet 51, a ratio between an inertial mass and rigidity of the protruded portion of the ejection section 5 becomes smaller than in the configuration in which the ejection section 5 has a constant cross sectional area that is fixed to a cross sectional area at a junction of the ejection section 5 and the supplying section 4. Thus, this gives a greater rigidity to the protruded portion, thereby reducing a risk of deforming the protruded portion due to acceleration of scanning of the head etc. in the printing operation.

Moreover, the inkjet head 1 is preferably arranged such that the substrate 2 is a monocrystal substrate whose main component is silicon.

With this configuration of the inkjet head 1, in which the substrate 2 of the inkjet head 1 is made of monocrystal silicon, it is possible to only etch the substrate 2 with an etching solution such as a KOH aqueous solution. This makes it easier to form the protruded section.

The inkjet head 1 may be configured such that the outer shell 31 is formed on the substrate 2 with an insulating layer 21 therebetween.

With this configuration of the inkjet head 1, the substrate and the outer shell face each other via the insulating layer.

This reduces the risk of cross-talk between adjacent channels due to a current therebetween via the substrate.

Moreover, the inkjet head 1 is preferably configured such that the longitudinal direction of the outer shell 31 of the ejection section 5 is substantially perpendicular to the (110) surface of the substrate (silicon substrate) 2.

With this configuration of the inkjet head 1, the removal of the substrate 2 by using the KOH aqueous solution can be performed by vertical etching with respect to the (110) surface. The etching rate is fastest for the (110) surface. Therefore, the fabrication of the protruded shape of the ejection section 5 can be performed in a short time. This reduces the damage from the etching on the other parts of the inkjet head 1 as much as possible.

Furthermore, the (110) surface is selectively etched. This etching reduces roughness in the etching surface. In addition, the protrusion amount can be controlled by etching time. This makes it possible to easily produce the inkjet heads 1 with a stable protrusion amount.

Moreover, the inkjet head 1 may be configured such that the part of the substrate 2 on which the outer shell 31 is formed is higher than the rest of the surface of the substrate 2.

Compared with the configuration in which the liquid flow path section 3 is formed on a flat surface, this configuration of the inkjet head 1 has a greater resistance against electrical breakdown at the junction of the liquid flow path section 3 and the insulating layer 21. Thus, this reduces the risk of the cross-talk between adjacent liquid flow paths due to electrical breakdown even if a high voltage is applied in the ejection signal application. That is, this provides a greater allowance for the voltage to be applied, thereby attaining a better reliability in the ejection of the inkjet head.

The inkjet head 1 is preferably configured such that the surface of the substrate (silicon substrate) 2 on which the outer shell 31 is formed is a (100) surface, and at least the edge of the outer shell 31 of the supplying section 4 is substantially parallel with the <110> direction.

With this configuration of the inkjet head 1, in which the surface of the substrate 2 is a (100) surface and the edge of the supplying section 4 is substantially parallel with the <110> direction, the surface of the substrate 2 is etched with the KOH aqueous solution to expose the (111) surface from the edge of the supplying section 4. This results in such a shape that the supplying section is supported on the top of a trapezoidal shape.

That is, the formation of the protruded section can be performed concurrently with causing the protrusion of the part on which the outer shell 31 of the liquid flow path section 3, from the surface of the substrate 2.

Moreover, the inkjet head 1 may be configured such that at least one of the lower flow path layer 32 and the upper flow path layer 33 is made of Ni.

With this configuration of the inkjet head 1, a part of the outer shell 31 is made of a conductive material. The conductor material is extended from the supplying section 4 to the outlet 51. With this, the ejection by the electrostatic attraction does not need the ink to act as a medium to supply the electric charge to the outlet 51. Instead, the electric field can be applied on the ejection section 5 via the conductive material constituting the outer shell 31. This shortens time required for electric field formation necessary for the ejection performed by electrostatic attraction. As a result, the ejection can be performed with better responsibility, and accordingly printing speed and resolution of the printing are improved.

Moreover, in addition to the configuration discussed above, the inkjet head 1 is preferably configured such that a mounting section 7 is provided continuously with the supplying section 4 in the vicinity of the end of the supplying section 4 that is farther from the outlet 51, and that the mounting section 7 is electrically short-circuited with at least one of the lower flow path layer 32 and the upper flow path layer 33.

With this configuration of the inkjet head 1, it is possible to connect the outer shell 31 directly with a mounting wire for supplying the ejection signal from an external source of the ejection signal to the inkjet head 1, the outer shell 31 constituting the supplying section 4 or the ejection section 5. This attains a greater reliability in the transmission of the ejection signal. Further, because the mounting wire is connected to the mounting section 7 formed on the surface of the substrate 2, it is possible to performing the mounting with a greater pressure. Because of this the mounting wire and the mounting section 7 can be connected with a greater reliability.

Furthermore, the inkjet head 1 may be configured such that a plurality of the outer shells 31 constituting a plurality of the liquid flow path sections 3 are electrically insulated from each other.

With this configuration of the inkjet head 1, in which the adjacent liquid flow path sections 3 are electrically insulated from each other, it is possible to prevent so-called "cross-talk" in which the application of the ejection signal on a particular liquid flow path section 3 causes ejection of the liquid from an outlet 51 of a liquid flow path section adjacent thereto.

Moreover, the inkjet head 1 may be configured such that at least part of that edge surface of the ejection section 5 on which the outlet 51 is formed is tilted with respect to the longitudinal direction of the liquid flow path of the ejection section 5.

With this configuration of the inkjet head 1, the tip of the outlet 51 is tilted with respect to the longitudinal direction of the liquid flow path, that is, a part of the outer shell 31 is protruded farther than the other parts in the vicinity of the outlet 51. Therefore, the electric field formed in the vicinity of the outlet 51 is concentrated at the protruded edge portion and the liquid droplets flies from the tip of the protruded edge portion.

This stably fixes the flying start position of the liquid at the protruded portion of the outer shell 31. This stabilizes the ejection direction, resulting in higher accuracy in hitting position and better resolution of the printing pattern.

Moreover, a method for producing an inkjet head 1 preferably includes the steps of: forming the lower flow path layer 32 on the substrate 2; forming, on the lower flow path layer 32, the filler member (liquid flow path layer 34) from which the liquid flow path is to be formed; forming the upper flow path layer 33 on the lower flow path layer 32 or the filler member; removing part of the substrate 2; and removing the filler member.

According to the method, the outer shell 31 is formed such that the outer shell 31 including the lower path layer 32 and the upper flow path layer 33 conceals the filler member therein from which the liquid flow path will be formed. In this method, the shape of the filler member, which determines the shape of the liquid flow path, is controlled by photolithography. This allows stable formation of the liquid flow path. Further, this attains easy modification of the shape, which only requires changing the mask pattern for the photolithography, thereby giving much greater freedom in designing.

Moreover, the method is preferably arranged such that the forming the upper flow path layer 33 is carried out by plating.

According to this method, the upper flow path layer 33 is formed by plating. This allows controlling the internal stress of the upper flow path layer 33 that is formed by controlling current density. By this, it is possible to take a balance between stress to be applied from the upper flow path layer 33 onto the ejection section and stress to be applied from the lower flow path layer 32 onto the ejection section. By this, the ejection section 5 protruded from the edge portion of the substrate 2 is prevented from largely warping. Moreover, the plating allows a faster deposition rate in the formation of the upper flow path layer 33 than vapor-phase deposition such as vapor deposition, sputtering, etc. Therefore, this method improves throughput in the production.

The inkjet head 1 may be arranged such that, in the step of removing the part of the substrate, the part of the substrate 2 is etched away with an aqueous solution containing KOH.

According to the method, a part of the substrate (silicon substrate) is etched away with an aqueous solution containing KOH. This allows utilizing a large difference in etching rates in plane directions, thereby attaining easy formation of the protruded portion. Further, this allows controlling the etching time thereby to control the protrusion amount with ease. Further, if the outer shell 31 is made of a material (such as Ni), which is highly resistant against KOH etching, this method can reduce the etching damage of the outer shell 31 to a level that the etching damage does not affect fabrication accuracy. This makes it possible to produce a highly accurate inkjet head.

Moreover, the inkjet head 1 may be configured such that the side walls of the liquid flow path are tilted from the direction perpendicular to the surface of the substrate 2.

In this configuration, tilted are the angles between the surface of the substrate 2 and the respective side walls of the filler members that determine the shape of the liquid flow path. This facilitates deposition of the upper flow path layer 33 to the side walls of the filler member in the formation process of the upper flow path layer 33 that will constitute the liquid flow path. This allows the shape of the upper flow path layer 33 to be formed with higher stability in shape.

Moreover, the inkjet head 1 is preferably configured such that the side walls of the liquid flow path make angles of less than 90° but greater than 5° with the surface of the substrate 2.

With this configuration, the side wall is tilted at an angle between the side wall and substrate 2 is less than 90°, thereby facilitating the deposition of the upper flow path layer 33 or the under layer 35 for the upper flow path layer 33 to the side wall. Meanwhile, the angle between the side wall and the surface of the substrate 2 is greater than 5°, a filler member that can be easily removed can be formed without having a much wider pattern width. This makes it possible to form an inkjet head 1 for fine droplet ejection.

Moreover, the method for producing the inkjet head 1 may be arranged such that the filler member to be formed on the surface of the substrate 2 is made of an organic material, and the method includes heating the filler member.

According to the method, the heat shrinkage of the filler member makes it possible to tilt the angle between the side wall of the filler member and the surface of the substrate 2 from the perpendicular direction. Further, this method allows controlling the shape of the filler member with a great reproducibility by controlling the heating temperature and heating time. This allows producing the inkjet head 1 more stably in structure.

Moreover, the method is preferably arranged such that the filler member is heated by a temperature of not less than 120° C. but not more than 200° C. According to the method, the heating temperature of not less than 120° C. makes it possible to tilt the side wall of the filler member to the surface of the substrate 2 sufficiently. Further thermally deterioration caused by the heating temperature of not more than 200° C. to the filler member of the organic material is not significant. Therefore, the removal of the filler member can be performed successfully in the step of removing the filler member. That is, it is possible to produce the inkjet head with high stability.

The method for producing the inkjet head 1 according to the present invention is preferably arranged such that the formation of the filler member on the surface of the substrate 2 includes radiating ultraviolet rays before heating the filer member, which is a photosensitive organic material.

According to the method, the ultraviolet radiation softens the filler member, thereby making it possible to thermally change the shape largely. Further, this arrangement of the method facilitates the removal of the filler member in the step of removing the filler member. Because of this, the method produces the inkjet head 1 more stably in the structure of the inkjet head 1, and thus attains better process stability.

An inkjet head according to the present invention is an inkjet head, which receives liquid and has at least one outlet for ejecting, in response to voltage application, the liquid to a printing target object. In order to attain the object, the inkjet head according to the present invention includes: a substrate; and at least one outer shell on the substrate, each outer shell respectively forming a liquid flow path section along an upper surface of the substrate.

The liquid is a liquid material such as ink, or the like that is to be ejected to a printing target object. The liquid flow path section is a flow path for the liquid.

Moreover, the outer shell forming the liquid flow path section is disposed on the upper surface of the substrate in such a manner that the outer shell at least secures a hollow portion between the outer shell and the upper surface of the substrate, the hollow portion constituting the liquid flow path.

With this configuration, the inkjet head is provided with the outer shell being disposed on the substrate and forming the liquid flow path section. The inkjet head according to the present invention, therefore, allows easy design change in the shape of the outer shell on the substrate by changing in the pattern or the like.

Therefore, the inkjet head of the present invention can have a greater degree of freedom in designing the shape of the liquid flow path section.

Moreover, in addition to the above configuration, the inkjet head according to the present invention may be configured such that: the liquid flow path section is formed from the outer shell having (i) a lower flow path layer formed on the upper surface of the substrate and (ii) an upper flow path layer formed on the lower flow path layer; the liquid flow path section has an ejection section having one of the at least one outlet; and at least part of the ejection section is protruded from an edge portion of the upper surface of the substrate.

With this configuration, at least part (including the outlet from which the liquid is ejected, the outlet being located at the edge portion of the liquid flow path section) of the ejection section is protruded from the edge portion of the surface of the substrate. With this, it is possible to efficiently concentrate the electric field at the outlet of the liquid flow path section. This allows using a lower voltage to apply.

Moreover, in addition to the above configuration, the inkjet head according to the present invention is preferably configured such that at least part of that portion of the upper flow path layer and the lower flow path layer in which the outlet is formed is protruded beyond the edge portion of the substrate farther than a rest of the upper flow path layer and the lower flow path layer.

More specifically, the inkjet head according to the present invention with this configuration is such that the outlet (formed on the edge surface of the outer shell that is formed from the lower flow path layer and the upper flow path layer) has such a shape that part of that portion of the outer shell which forms the outlet is protruded farther than the rest of that portion beyond the edge portion of the substrate.

In the inkjet head according to the present invention with this configuration, therefore, the electric field in the vicinity of the outlet can be efficiently concentrated at the tip of the farther protruded portion of the outer shell. In this inkjet head, the voltage application thereby causes a greater force to pull the liquid to the tip portion.

Moreover, compared with the inkjet head having such a configuration that the lower flow path layer and the upper flow path layer, which constitute the outlet, are protruded beyond the edge portion of the substrate, the voltage application causes a greater force to pull the liquid without changing the diameter of the outlet and the flow path resistance of the liquid in this configuration. Thus, the inkjet head according to the present invention can use a lower voltage for the ejection voltage.

In addition to the above configuration, the inkjet head according to the present invention is preferably configured such that: the liquid flow path section has a supplying section having an inlet for receiving a flow of the liquid therein; the liquid flown into the inlet of the supplying section flows from the supplying section to the outlet of the ejection section; and the supplying section has a liquid flow path that is larger in cross sectional area than that of the ejection section.

With this configuration, in which the liquid flow path of the supplying section is greater in the cross sectional area than that of the outlet, the liquid to be supplied to the ejection section can be relatively greater in quantity than the liquid to ejected from the ejection sections. That is, the supply of the liquid to be ejected can be well enough in the inkjet head according to the present invention.

In this inkjet head, this prevents shortage in the supply of the liquid even if the amount of the liquid to be ejected is increased according to the printing pattern to be print on the printing target object.

Moreover, in addition to the above configuration, the inkjet head according to the present invention may be configured such that the ejection section has a cross sectional area that gets smaller towards the outlet.

Compared with such a configuration in which the ejection section is protruded with a constant cross sectional area up to its surface on which the outlet is formed, the shape of the ejection section in this configuration attains a smaller ratio of the inertial mass over the rigidity in the portion protruded from the edge portion of the surface of the substrate.

That is, the inkjet head according to the present invention with the ejection section in this shape can have a large rigidity of the protruded portion of the ejection section beyond the edge portion of the upper surface of the substrate.

This reduces vibration or deformation, caused by impact, of the protruded portion of the ejection section in the inkjet head according to the present invention.

Therefore, the inkjet head according to the present invention can reduce the vibration, deformation, etc. of the protruded portion, which are caused by impact. This gives the inkjet head a greater resistance against the stress caused by scanning or the like.

Moreover, in addition to the above configuration, the inkjet head according to the present invention is preferably configured such that along a substantially perpendicular direction to a flowing direction of the liquid, a flow path for the liquid has such a cross section that has a shape with an interior angle of less than 90° between a side portion and a bottom part of the cross section.

The bottom part of the cross section of the liquid flow path is the portion facing the substrate. The top portion of the cross section is on the opposite side of the bottom portion thereof. Moreover, the side portions are either sides of the cross section configuration.

The interior angles between the side portions and the bottom portion in the cross section are the angles therebetween facing toward the liquid flow path. The interior angels are less than 90° (that is, acute angles). Meanwhile, the exterior angles between the side portions of the flow path and the lower flow path layer on which the flow path is formed are more than 90° (that is, obtuse angels).

In the configuration in which the exterior angles between the side portion of the flow path and the lower flow path layer on which the flow path is formed are more than 90°, it is easy to deposit the material for constituting the upper flow path layer on the side portion. Compared with the configuration in which the cross sectional configuration of the liquid flow path is rectangular, this makes it easier to have an upper flow path layer that is thick at the side portion.

Therefore, the inkjet head according to the present invention can have a liquid flow path that is improved in strength against external force, compared with, for example, the configuration in which the liquid flow path has a rectangular cross sectional shape.

Here, the formation of the flow path may be carried out, for example, by forming a filler member between the lower flow path layer and the upper flow path layer, the filler member being removal in the later step. The formation of the filler member includes forming the filler member on the lower flow path layer and forming the upper flow path layer on the filler member. Moreover, the filler member defines the cross sectional shape of the liquid flow path.

For forming the upper flow path layer on the filler member, the deposition of the upper flow path layer onto the filler member can be improved in the inkjet head according to the present invention in which the cross sectional exterior angles between the side portions and the lower flow path layer on which the flow path is formed thereon are greater than 90°.

Therefore, it is possible to easily deposit the upper flow path layer on the filler member uniformly in the inkjet head according to the present invention.

Thus, the inkjet head according to the present invention can have the liquid flow path sections formed with a uniform flow path shape. That is, it is possible to form the flow path shape stably.

Moreover, the inkjet head according to the present invention is preferably configured such that the interior angle is greater than 5°.

In the inkjet head according to the present invention, for example, a larger cross sectional area of the liquid flow path is more preferable for the sake of easy removal of the filler member in case of the formation of the flow path, which is carried out by removing the filler member formed between the lower flow path layer and the upper flow path layer. However, such a large cross sectional area is in a "trading-off" relationship with the fine shape of the inkjet head, because such a large cross sectional area requires a wide flow path width.

Therefore, this configuration in which the angle between each side portion and bottom portion of the cross section of the liquid flow path is greater than 5° does not need a dramatically large flow path width, that is, does not need the flow path cross sectional shape to be significantly large in the direction substantially parallel with the surface of the substrate. Therefore, the present invention can have a fine shape.

Moreover, in case where the flow path shape is carried out by forming the filler member the lower flow path layer and the upper flow path layer, the filler member being removable in the later step, the angles of greater than 5° between the side portions and the lower flow path layer makes it easier to remove the filler member.

The range of the interior angles between the side portions of the liquid flow path cross section and the lower flow path layer is set in consideration of the easy formation of the liquid flow path and the fine shape the inkjet head according to the present invention is required to have.

The inkjet head according to the present invention is preferably configured such that a flow path for the liquid has such a cross section that a lower flow path layer has a side surface tilted away from the surface of the substrate outwardly sideways.

This configuration may be expressed in other words such that the lower flow path layer has a bottom portion smaller than a top portion, and the side surfaces of the lower flow path layer is tilted inwardly in the cross section of the liquid flow path section. This causes the peeling stress applied on the lower flow path layer to contribute to higher junction strength at the junction on the upper surface of the lower flow path layer. Thereby, it becomes possible to have a greater overall adhesion strength that prevents peeling.

Furthermore, in addition to the above configuration, the inkjet head according to the present invention is preferably configured such that along a substantial perpendicular direction to a flowing direction of the liquid, a flow path for the liquid has a cross section that has such a shape that a ratio of its width over its height is greater than 0.05.

In this configuration, the liquid flow path has a cross section that has such a shape that the ratio of its width over its height is greater than 0.05. Therefore, this configuration can prevent such a problem that a shortage in the wall surface strength of the upper flow path layer 33 results in lowering the flow path height when the filler member is removed from the inside of the flow path to hollow the flow path. Moreover, this configuration can prevent deformation in the flow path shape during the production process such as the attachment of the manifold etc., and during filling and ejecting the liquid.

Therefore, in the inkjet head according to the present invention, the flow path shape will not be deformed during the production process and filling and ejecting the liquid. Thus, the flow path resistance inside the flow path will not be changed, whereby the ejection property becomes such that the liquid can be ejected in the constant amount.

In addition to the configuration, the inkjet head according to the present invention is preferably configured such that along a substantial perpendicular direction to a flowing direction of the liquid, the liquid flow path section has such a cross section that the upper flow path layer is junctioned with a side surface of the lower flow path layer so as to form the outer shell.

According to this configuration, the upper flow payer is junctioned with the side surface of the lower flow path layer. At the junction of the side surface, the upward peeling stress acts as a shear stress. This gives the inkjet head according to the present invention a dramatically greater resistance against peeling at the junction between the upper flow path layer and the lower flow path layer.

In addition to the above configuration, the inkjet head according to the present invention is preferably configured such that on a cross section of the liquid flow path section, all interior angles of the outer shell are less than 1800°.

With this configuration, all the interior angles of the outer shell are less than 180°, that is, no portion of the outer periphery of the outer shell has an interior angle more than 180°.

This configuration avoids retaining the ejected liquid in the periphery of the outer shell of a liquid flow path section in the ejection of the liquid from the outlet of the inkjet head. The retained liquid would move from the outlet to the substrate by the capillary phenomenon and would increase the accumulated amount of the liquid in the overall substrate. This configuration, therefore, prevents such an increase in the accumulated amount of the liquid in the overall substrate.

Because this configuration prevents such an increase in the accumulated amount of the liquid in the overall substrate, extraordinary ejection, ink leakage, and the like problem can be prevented in the inkjet head according to the present invention.

In addition to the above configuration, the inkjet head according to the present invention is preferably configured such that, on a cross section of the liquid flow path section, all interior angles of the outer shell are greater than 90°.

According to this configuration, in which all the interior angles of the outer shell are greater than 90°, the cross sectional shape of the outer shell on the cross section of the liquid flow path section becomes closer to a circle. Therefore, it becomes possible to concentrate the electric field at a center portion of the outlet during the ejection of the liquid by voltage application. This stabilizes the ejection direction for the liquid.

Moreover, in addition to the above configuration, the inkjet head according to the present invention is preferably configured such that at least part of an edge surface on which the outlet is formed is tilted from a direction perpendicular to a direction in which the ejection section is protruded beyond the upper surface of the substrate.

That is, part of the edge surface on which the outlet is formed is protruded farther from the edge portion of the supper surface of the substrate than the rest of the edge surface.

In the case where the edge surface on which the outlet is formed is shaped as such, the voltage application of the liquid flow path section causes the electric field formed in the vicinity of the outlet to be concentrated at the protruded portion of the edge surface. Therefore, the liquid is ejected from the protruded portion toward the printing target object.

Therefore, it is possible to set the ejection start position for the liquid at the protruded portion of the edge surface. This stabilizes the ejection direction of the liquid to be ejected toward the printing target object.

The stabilized ejection direction of the ejected liquid improves the accuracy in the hitting position of the ejected liquid on the printing target object, thereby attaining a higher resolution of the printing pattern.

Moreover, in addition to the above configuration, the inkjet head according to the present invention is preferably configured such that one of the lower flow path layer and the upper flow path layer, which constitute the outer shell, is made of a conductive material.

In the inkjet head according to the present invention with this configuration, one of the lower flow path layer and the upper flow path layer, which constitute the outer shell, is made of a conductive material.

In order to supply, to the outlet of the ejection section, the electric charge necessary for the ejection by electrostatic attraction, the inkjet head according to the present invention can supply the electric charge to he outlet of the ejection section via the lower flow path layer or the upper flow path layer. Thus, it is not necessary to carry out the transfer of the electric charge via the ink.

Therefore, the time for forming the electric field necessary for the electrostatic-attraction ejection can be shorter in the inkjet head, thereby attaining a better response property in ejection.

Accordingly, the inkjet head according to the present invention improves the printing speed and printing resolution.

In addition to the above configuration, the inkjet head according to the present invention is preferably configured such that a mounting section on the surface of the substrate, for receiving electric power that is to be applied on the liquid flow path section in order to cause the liquid to be ejected to the printing target object, the mounting section being electrically short-circuited with that one of the lower flow path layer and the upper flow path layer which is made of the conductive material.

With this configuration, externally-applied electric power is received at the mounting section and then supplied to the liquid flow path section.

In this way, the electric power for the liquid ejection can be supplied to the liquid flow path section. This attains a higher reliability in transmission of the electric power to be applied to the liquid flow path section for the liquid ejection to the printing target object.

Moreover, the inkjet head according to the present invention includes the mounting section on the surface of the substrate, whereby the wiring can be adhered to the mounting section with a greater pressure applied thereon.

That is, it is not necessary to use the reverse side of the substrate (i.e., the reverse surface with respect to the surface on which the liquid flow path section is formed) in the inkjet head according to the present invention. Thus, the adhesion of the mounting section to the substrate can be easily carried out. Therefore, from above the upper surface (on which the liquid flow path section is formed), a large pressure can be applied for connecting the mounting wire to the mounting section.

Therefore, the inkjet head according to the present invention attains a higher reliability in the connection between the mounting section and the external apparatus for applying the electric power.

In addition to the above configuration, the inkjet head according to the present invention is preferably configured such that the liquid flow path section is formed on an upper surface of an insulating layer formed on the substrate.

With this configuration, in which the liquid flow path section made of the conductive material is formed on the upper surface of the insulating layer, it is possible to prevent the current flowing the liquid flow path section to flow to another member or the like via the substrate.

For example, in case where a plurality of the liquid flow path sections are formed on the same surface of the substrate, this configuration reduces the risk of the cross-talk between adjacent liquid flow path sections in which the current is flown from one to the other via the substrate.

Moreover, in addition to the above configuration, the inkjet head according to the present invention may be configured such that that portion of the substrate in which the upper surface of the substrate junctions with an insulating layer formed on the upper surface is higher than the other portion of the substrate along a direction from the upper surface to the insulating layer.

In this configuration, the portion of the substrate in which the insulating layer and the substrate junction with each other is higher than the rest of the substrate.

Compared with the configuration in which the insulating layer is formed on the rest part of the substrate, the inkjet head according to the present invention is such that the liquid flow path section formed on the insulating layer is higher than the other part of the substrate. In the inkjet head according to the present invention, the electric resistance against the current to flow from one liquid flow path to the other via the substrate, compared with the configuration in which the insulating layer is formed on the other part of the substrate.

Therefore, it is possible to reduce the risk of the cross-talk of the current from one liquid flow path section to the other via the substrate in applying a high voltage on the one liquid flow path section for the ejection of the liquid droplets.

In addition to the above configuration, the inkjet head according to the present invention is preferably configured such that the substrate is a monocrystal substrate whose main component is silicon.

In this configuration, in which the substrate on which the liquid flow path section is formed is a monocrystal substrate whose main component is silicon, it is easy to remove only the substrate with an etching solution such as a KOH aqueous solution.

Therefore, it is easy to form the shape of the liquid flow path section, for example, the protruded portion of the ejection section which is protruded from the edge portion of the surface of the substrate.

Moreover, in addition to the above configuration, the inkjet according to the present invention is preferably configured such that the ejection section is protruded beyond the upper surface of the substrate in a direction substantially perpendicular to a (110) surface that is perpendicular to the upper surface and includes the edge portion of the upper surface.

For example, in case where a part of the substrate is removed with an etching solution such as a KOH aqueous solution, the etching rate is fastest along the direction perpendicular to the (110) surface.

Therefore, in the configuration in which the ejection section is protruded beyond the upper surface of the substrate in a direction substantially perpendicular to the (110) surface that is perpendicular to the upper surface, the etching proceeds at the fastest rate in a direction opposite to the direction in which the ejection section is protruded.

Therefore, it is possible to form the protruded portion of the ejection section beyond the edge portion of the substrate in a short time.

Because the etching for forming the protruded portion can be carried out in a short time in the inkjet head according to the present invention, it is possible to reduce the damage from the etching solution on the other member of the inkjet head.

Moreover, the (110) surface is selectively etched. Thus, in case where the (110) surface would be rough, the etching would reduce the roughness of the surface.

Moreover, it is possible to control the size of the protruded portion by the etching time of etching the (110) surface of the substrate. Thus, it is possible to easily adjust the size of the protrusion section as desired.

In addition to the above configuration, the inkjet head according to the present invention is preferably configured such that that surface of the substrate on which the liquid flow path section is formed is a (100) surface; and one edge of a flat surface shape of the liquid flow path section formed on the surface of the substrate is substantially parallel with a <110> direction.

The flat surface shape is a shape of the liquid flow path section viewed from above that surface of the substrate on which the liquid flow path section is formed.

In this configuration, the surface of the substrate on which the liquid flow path section is formed is a (100) surface, and one edge of a flat surface shape of the liquid flow path section formed on the surface of the substrate is substantially parallel with a <110> direction.

With this, the etching of the substrate with an etching solution such as the KOH aqueous solution etches the surface of the substrate to expose the (111) surface from one edge of the flat surface shape. This results in the cross section of the substrate in which the one edge of the flat surface shape constitutes is remained in a substantially trapezoidal shape formed on the substrate. That is, the part of the substrate in which the liquid flow path section junctions with the surface of the substrate is protruded beyond the upper surface of the substrate in the direction toward the liquid flow path section.

Therefore, the inkjet head can have, by the etching, a shape in which at least part of the ejection section of the liquid flow path section is protruded from the edge portion of the surface of the substrate, and in which the liquid flow path section is formed on the portion of the substrate that is higher than the upper surface of the substrate in the direction toward the liquid flow path section.

Compared with the configuration in which the insulating layer is formed on the other portion of the substrate, the inkjet head according to the present invention is such that the liquid flow path section formed on the insulating layer is higher than the rest portion of the substrate. Therefore, compared with the configuration in which the insulating layer is formed on the other portion of the substrate, the electric resistance against the current flowing from one liquid flow path section to the other becomes larger.

Therefore, it is possible to reduce the risk of the cross-talk of the current from one liquid flow path section to the other via the substrate in applying a high voltage on the one liquid flow path section for the ejection of the liquid droplets.

In addition to the above configuration, the inkjet head according to the present invention is preferably configured such that a plurality of the liquid flow path sections are formed on the surface of the substrate; and the liquid flow path sections are electrically insulated from each other.

In this configuration, the inkjet head according to the present invention is provided with a plurality of the liquid flow path sections. Thus, compared with a configuration in which a single liquid flow path section is provided therein, it is possible to carry out more complex printing expression by ejecting the liquid to the printing target object. Moreover, it is possible to attain a high speed for the printing.

Furthermore, the plurality of the liquid flow path sections are electrically insulated from each other. Thus, it is possible to prevent the so-called "cross-talk" in which a voltage applied on a particular liquid flow path section erroneously causes another liquid flow path section that is for example adjacent to the particular liquid flow path section.

A method according to the present invention is a method for manufacturing an inkjet head, which receives liquid and ejects, in response to voltage application, fine droplets of the liquid to a printing target object. In order to attain the object, the method according to the present invention includes: forming a filler member along an upper surface of a substrate, the filler member defining a shape of a flow path of the liquid; forming an outer shell, so that the filler member is concealed with the outer shell and the surface of the substrate; and removing the filler member.

According to the method, the filler member is formed on the surface of the substrate. Thus, a shape of the filler member as desired can be easily attained by etching. Moreover, a shape of the upper flow path layer that conceals the filler member with the surface of the substrate can be attained easily by etching.

As described above, the method according to the present invention can improve the degree of the freedom in designing, because it makes it possible to have a desired shape of the liquid flow path or a desired shape of the upper flow path layer easily.

In addition to the above arrangement, the method according to the present invention is preferably arranged such that: the filler member is made of a thermally shrinkable material; and the method further comprises heating the filler member before the step of forming the outer shell.

In this method, the filler member is made of an organic material that is thermally shrinkable. This allows thermal shrinkage of the filler member by the step of heating. This makes it possible to tilt the angel between the side portion of the filler member and the surface of substrate easily as desired. The side portion of the filler member is the side portion of the cross section thereof substantially perpendicular to the flowing direction of the liquid.

Further, according to this method, it is possible to control the change in the shape of the filler member with good reproducibility by controlling the heating temperature and heating time.

Thus, the method according to the present invention makes it possible to form the filler member stably.

Moreover, in addition to the above arrangement, the method according to the present invention is preferably arranged such that the filler member is made of an organic material; and in the step of heating, the filler member is heated at a temperature not less than 120° C. and not more than 200° C.

Because the filler member is made of an organic material, it is easy to remove the filler member, e.g., by using an organic solvent or the like. Thus, it is possible to remove the filler member to produce the shape of the liquid flow path stably.

Thus, the method according the present invention allows stable production of the shape of the liquid flow path in the liquid flow path section.

Moreover, according to the method, the heating temperature of not less than 120° C. makes it possible to tilt the side portion of the filler member to the surface of the substrate sufficiently. Further thermally deterioration caused by the heating temperature of not more than 200° C. to the filler member of the organic material is not significant. Therefore, the removal of the filler member can be performed successfully in the step of removing the filler member.

Therefore, the method according to the present invention allows production of inkjet heads in a uniform shape.

Moreover, in addition to the above arrangement, the method according to the preset invention is preferably arranged such that the filler member is made of a photosensitive organic material; and prior to the step of heating, the method further comprises radiating ultraviolet rays on the filler member.

In the method according to the present invention, the filler member is made of a photosensitive organic material. Thus, the ultraviolet ray radiation can soften the filler.

Because the ultraviolet radiation softens the filler member, it is possible to thermally change the shape largely. Further, this arrangement of the method facilitates the removal of the filler member in the step of removing the filler member. Because of this, the method according to the present invention produces the inkjet head with a uniform shape, and makes it easy to remove the filler member in the step of removing the filler member.

In addition to the above arrangement, the method according to the present invention is preferably arranged such that the step of forming the filler member on the surface of the substrate comprises forming, along the upper surface of the substrate, a lower flow path layer on the substrate, and forming the filler member on the lower flow path layer located on the surface of the substrate; the step of forming the outer shell comprises forming an upper flow path layer, so that the filler member is concealed between the upper flow path layer and the lower flow path layer located on the surface of the substrate; and the method further comprises removing part of the substrate, so that one end portion of the outer shell is protruded beyond an edge portion of the surface of the substrate.

With this method, the filler member is concealed with the lower flow path layer and the upper flow path layer. The shape of the filler member can be controlled by the etching in which for example photolithography is used. Thus, it is possible to form a desired shape of the filler member easily.

Further, as to the shape of the outer shell including the upper flow path layer and the lower flow path layer, desired shapes of the upper flow path layer and the lower flow path layer can be easily attained by etching.

Moreover, according to the present invention, it is possible to attain protrusion of one end portion of the outer shell beyond the edge portion of the surface of the substrate by removing the part of the substrate. The removal of the substrate can by carried out by using an etching solution or the like.

Thus, it is possible to attain the protrusion of the outer shell in a desired length (protrusion amount) by controlling the time of the etching the substrate with the etching solution.

Therefore, the method according to the present invention makes it possible to attain the shape of the liquid flow path, the shape of the outer shell, the protrusion amount of the outer shell from the edge portion of the surface of the substrate easily as desired. Thus, this method improves the degree of freedom in designing.

In addition to the above arrangement, the method according to the present invention may be arranged such that the step of forming the filler member on the surface of the substrate comprises forming a lower flow path layer on the substrate, and forming the filler member on the lower flow path layer located on the surface of the substrate; the step of forming the outer shell comprising forming the upper flow path layer, so that the upper flow path layer covers the filler member except that one end portion of the filler member which is closer to an edge portion of the surface of the substrate beyond which the outer shell is to be protruded; and the method further comprises removing part of the substrate, so that one end portion of the outer shell is protruded beyond the edge portion of the surface of the substrate.

According to the method, the filler member is formed on the lower flow path layer. Thus, it is also possible to form the filler member that is protruded farther than the lower flow path layer, for example. Moreover, the method is arranged such that, as to the outer shell, the upper flow path layer is formed so that the upper flow path layer covers the filler member except that one end portion of the filler member which is closer to an edge portion of the surface of the substrate beyond which the outer shell is to be protruded.

Therefore, the method according to the present invention can easily expose the filler member from the outer shell.

Thus, such a structure of the inkjet head can be obtained by the step of removing the filler member that at least part of the end surface of the lower flow path layer and the upper flow path layer on which the outlet is formed is protruded farther than the rest beyond the edge portion of the upper surface of the substrate.

Because of this, the step of removing the filler member in order to form the outlet does not need such a process as etching, dicing etc. to expose filler member. This improves the throughput of the production of the inkjet head. Further, damage on the outer shell, which would be given by such a step, can be avoided, thereby forming the outlet stably.

Moreover, it is possible to adjust the outlet as appropriate in terms of its position, shape, opening diameter by the formation of the filler member. Moreover, the protrusion amount the protruded portion of the outer shell beyond the surface of the substrate can be adjust as appropriate in consideration of the area in which the upper flow path layer is formed.

Thus, the method according to the present invention makes it possible to easily design the inkjet head such that the amount of the liquid supplied from the outlet is appropriately controlled while a strong electrostatic force is generated. That is, the method according to the present invention can improve the degree of freedom in designing the inkjet head to produce.

Furthermore, the method according to the present invention can cause the protrusion of one end of the outer shell beyond the edge portion of the surface of the substrate by removing part of the substrate. The removal of the substrate may be carried out with an etching solution or the like.

Thus, it is possible to attain a desired length (protrusion amount) of the protruded portion of the outer shell by controlling the etching time of the etching of the substrate with the etching solution.

Therefore, the method according to the present invention makes it possible to easily attain a desired shape of the liquid flow path, a desired shape of the outer shell, or a desired protrusion amount of the outer shell beyond the edge portion of the surface of the substrate. Thus, the method according to the present invention can attain a significantly greater degree of freedom in designing.

In addition to the above arrangement, the method according to the present invention is preferably arranged such that the forming the upper flow path layer is carried out by plating.

According to the method in which the upper flow path layer is formed by plating, it is possible to control the internal stress of the upper flow path layer by controlling the current density.

Therefore, it is possible to take a balance between the stress of the upper flow path layer and that of the lower flow path layer. The warping of the protruded portion beyond the substrate would be caused when a portion formed by the upper flow path layer and the lower flow path layer is removed; especially a part of the substrate is removed. The method of this arrangement can prevent such warping.

Moreover, in the arrangement in which the upper flow path layer is formed by plating, the growth rate of the upper flow path layer is faster than in the arrangement in which it is formed by vapor deposition method, such as vapor deposition, sputtering or the like. Thus, the method attains a greater throughput in the production of the inkjet head.

Moreover, in addition to the above arrangement, the method according to the present invention is preferably arranged such that the substrate is a monocrystal substrate whose main component is silicon; and in the step of removing the part of the substrate, the part of the substrate is etched away with an aqueous solution containing KOH.

With this method, part of the silicon substrate is etched away with the aqueous solution containing KOH. This allows utilizing a large difference in etching rates in plane directions. Further, this allows controlling the etching time thereby to control the protrusion amount with ease.

As described above, an inkjet head according to the present invention is an inkjet head, which receives liquid and has at least one outlet for ejecting, in response to voltage application, the liquid to a printing target object. The inkjet head according to the present invention includes a substrate; and at least one outer shell on the substrate, each outer shell respectively forming a liquid flow path section along an upper surface of the substrate.

With this configuration, the inkjet head is provided with the outer shell being disposed on the substrate and forming the liquid flow path section. The inkjet head according to the present invention, therefore, allows easy design change in the shape of the outer shell on the substrate by changing in the pattern or the like.

Therefore, the inkjet head of the present invention can have a greater degree of freedom in designing the shape of the liquid flow path section.

As described above, a method according to the present invention is a method for manufacturing an inkjet head, which receives liquid and ejects, in response to voltage application, fine droplets of the liquid to a printing target object. The method according to the present invention includes: forming a filler member along an upper surface of a substrate, the filler member defining a shape of a flow path of the liquid; forming an outer shell, so that the filler member is concealed with the outer shell and the surface of the substrate; and removing the filler member.

According to the method, the filler member is formed on the surface of the substrate. Thus, a shape of the filler member as desired can be easily attained by etching. Moreover, a shape of the upper flow path layer that conceals the filler member with the surface of the substrate can be attained easily by etching.

As described above, the method according to the present invention can improve the degree of the freedom in designing, because it makes it possible to have a desired shape of the liquid flow path or a desired shape of the upper flow path layer easily.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

An inkjet head 1 according to the present embodiment which can be formed on a substrate 2 has a large degree of freedom in designing because a shape of a liquid flow path section 3 or a shape of a flow path in which a liquid will flow can be freely modified. Therefore, the present invention is applicable to various inkjet heads which are required depending on properties of the liquid to be ejected or kinds of printing target objects to which the liquid will be ejected.

The invention claimed is:

1. An inkjet head, which receives liquid and has at least one outlet for ejecting, by electrostatic repulsive force caused by voltage application, the liquid to a printing target object, the inkjet head comprising:

a substrate; and at least one outer shell on the substrate, each outer shell respectively forming a liquid flow path section along an upper surface of the substrate, wherein the liquid flow path section concentrates an eclectic field at the at least one outlet for ejecting, by the voltage application, the liquid flow path section has an ejection section having one of the at least one outlet for ejecting, and at least part of the ejection section is protruded from an edge portion of the upper surface of the substrate.

2. The inkjet head as set forth in claim 1, wherein:

the liquid flow path section is formed from the outer shell having (i) a lower flow path layer formed on the upper surface of the substrate and (ii) an upper flow path layer formed on the lower flow path layer.

3. The inkjet head as set forth in claim 2 wherein:

least part of that portion of the upper flow layer and the lower flow path layer in which outlet is formed is protruded beyond the edge portion of the substrate farther than a rest of the upper flow path layer and the lower flow path layer.

4. The inkjet head as set forth in claim 2, wherein:

the liquid flow path section has a supplying section having an inlet for receiving a flow of the liquid therein;

the liquid flown into the inlet of the supplying section flows from the supplying section to the outlet of the ejection section; and the supplying section has a liquid flow path that is larger in cross sectional area than that of the ejection section.

5. The inkjet head as set forth in claim 2, wherein:

the ejection section has a cross sectional area that gets smaller towards the outlet.

6. The inkjet head as set forth in claim 2, wherein:

along a substantial perpendicular direction to a flowing direction of the liquid, the liquid flow path section has such a cross section that the upper flow path layer is junctioned with a side surface of the lower flow path layer so as to form the outer shell.

7. The inkjet head as set forth in claim 2, wherein:

at least part of an edge surface on which the outlet is formed is tilted from a direction perpendicular to a direction in which the ejection section is protruded beyond the upper surface of the substrate.

8. The inkjet head as set forth in claim 1, wherein:

along a substantially perpendicular direction to a flowing direction of the liquid, a flow path for the liquid has such a cross section that has a shape with an interior angle of less than 90° between a side portion and a bottom part of the cross section.

9. The inkjet head as set forth in claim 8 wherein:

the interior angle is greater than 5°.

10. The inkjet head as set forth in claim 1, wherein:

a flow path for the liquid has such a cross section that a lower flow path layer has a side surface tilted away from the surface of the substrate outwardly sideways.

11. The inkjet head as set forth in claim 1, wherein:

along a substantial perpendicular direction to a flowing direction of the liquid, a flow path for the liquid has a cross section that has such a shape that a ratio of its width over its height is greater than 0.05.

12. The inkjet head as set forth in claim 1, wherein:

on a cross section of the liquid flow path section, all interior angles of the outer shell are less than 180°.

13. The inkjet head as set forth in claim 1, wherein on a cross section of the liquid flow path section, all interior angles of the outer shell are greater than 90°.

14. The inkjet head as set forth in claim 2, wherein:

one of the lower flow path layer and the upper flow path layer, which constitute the outer shell, is made of a conductive material.

15. The inkjet head as set forth in claim 14, comprising:

a mounting section on the surface of the substrate, for receiving electric power that is to be applied on the liquid flow path section in order to cause the liquid to be ejected to the printing target object, the mounting section being electrically short-circuited with that one of the lower flow path layer and the upper flow path layer which is made of the conductive material.

16. The inkjet head as set forth in claim 14, wherein:

the liquid flow path section is formed on an upper surface of an insulating layer formed on the substrate.

17. The inkjet head as set forth in claim 16, wherein:

that portion of the substrate in which the upper surface of the substrate junctions with an insulating layer formed on the upper surface is higher than the other portion of the substrate along a direction from the upper surface to the insulating layer.

18. The inkjet head as set forth in claim 1 wherein:

the substrate is a monocrystal substrate whose main component is silicon.

19. The inkjet head as set forth in claim 18, wherein:

the ejection section is protruded beyond the upper surface of the substrate in a direction substantially perpendicular to a surface that is perpendicular to the upper surface and includes the edge portion of the upper surface.

20. The inkjet head as set forth in claim 18, wherein:

that surface of the substrate on which the liquid flow path section is formed is an upper surface thereof; and one edge of a flat surface shape of the liquid flow path section formed on the upper surface of the substrate is substantially parallel with a direction perpendicular to a surface perpendicular to said upper surface and includes an edge portion of said upper surface.

21. The inkjet head as set forth in any one of claims 1 to 20, wherein:

a plurality of the liquid flow path sections are formed on the surface of the substrate; and the liquid flow path sections are electrically insulated from each other.

22. A method for manufacturing an inkjet head, which receives liquid and ejects, by electrostatic repulsive force caused by voltage application, fine droplets of the liquid to a printing target object, the method comprising:

forming a filler member along an upper surface of a substrate, the filler member defining a shape of a flow path of the liquid;

forming an outer shell, so that the filler member is concealed with the outer shell and the surface of the substrate;

removing the filler member; and removing part of the substrate, so that one end portion of the outer shell is protruded beyond an edge portion of the surface of the substrate, wherein an electric field is concentrated at the one end portion of the outer shell by voltage application.

23. The method as set forth in claim 22, wherein:

the filler member is made of a thermally shrinkable material; and the method further comprises heating the filler member before the step of forming the outer shell.

24. The method as set forth in claim 23, wherein:

the filler member is made of an organic material; and in the step of heating, the filler member is heated at a temperature not less than 120° C. and not more than 200° C.

25. The method as set forth in claim 23, wherein:

the filler member is made of a photosensitive organic material; and prior to the step of heating, the method further comprises radiating ultraviolet rays on the filler member.

26. The method as set forth in claim 22, wherein:

the step of forming the filler member on the surface of the substrate comprises forming, along the upper surface of the substrate, a lower flow path layer on the substrate, and forming the filler member on the lower flow path layer located on the surface of the substrate; and the step of forming the outer shell comprises forming an upper flow path layer, so that the filler member is concealed between the upper flow path layer and the lower flow path layer located on the surface of the substrate.

27. The method as set forth in claim 26, wherein:

the forming the upper flow path layer is carried out by plating.

28. The method as set forth in any one. of claims 26 to 27, wherein:

the substrate is a monocrystal substrate whose main component is silicon; and in the step of removing the part of the substrate, the part of the substrate is etched away with an aqueous solution containing KOH.

29. The method as set forth in claim 22, wherein:

the step of forming the filler member on the surface of the substrate comprises forming a lower flow path layer on the substrate, and forming the filler member on the lower flow path layer located on the surface of the substrate; and the step of forming the outer shell comprises forming the upper flow path layer, so that the upper flow path layer covers the filler member except that one end portion of the filler member which is closer to an edge portion of the surface of the substrate beyond which the outer shell is to be protruded.

* * * * *